US010124572B2

(12) United States Patent
Hayashi et al.

(10) Patent No.: US 10,124,572 B2
(45) Date of Patent: Nov. 13, 2018

(54) METHOD AND DEVICE FOR ADJUSTING CONTACT PRESSURE OF INTAGLIO PRINTER WIPING ROLLER

(71) Applicant: KOMORI CORPORATION, Tokyo (JP)

(72) Inventors: Kenji Hayashi, Tsukuba (JP); Soichi Nakamura, Tsukuba (JP); Norihiro Kumagai, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 15/511,925

(22) PCT Filed: Sep. 11, 2015

(86) PCT No.: PCT/JP2015/075783
§ 371 (c)(1),
(2) Date: Mar. 16, 2017

(87) PCT Pub. No.: WO2016/043129
PCT Pub. Date: Mar. 24, 2016

(65) Prior Publication Data

US 2017/0259556 A1 Sep. 14, 2017

(30) Foreign Application Priority Data

Sep. 17, 2014 (JP) ..... 2014-188445
Sep. 17, 2014 (JP) ..... 2014-188446

(51) Int. Cl.
*B41F 9/08* (2006.01)
*B41F 9/10* (2006.01)

(52) U.S. Cl.
CPC . *B41F 9/08* (2013.01); *B41F 9/10* (2013.01)

(58) Field of Classification Search
None
See application file for complete search history.

(56) References Cited

U.S. PATENT DOCUMENTS 3,762,319 A * 10/1973 Gazzola ..... B41F 9/08 101/152
4,935,683 A * 6/1990 Kobler ..... B41F 13/14 101/148

(Continued)

FOREIGN PATENT DOCUMENTS

EP 2 524 809 A1 11/2012
JP 11-348231 A 12/1999

(Continued)

OTHER PUBLICATIONS

Extended European Search Report dated Mar. 15, 2018 issued in corresponding European Application No. 15842694.0.

*Primary Examiner* — Jill Culler
(74) *Attorney, Agent, or Firm* — Birch, Stewart, Kolasch & Birch, LLP

(57) ABSTRACT

Provided is a method for automatically adjusting the contact pressure between an intaglio cylinder and a wiping roller that further limits the amount of defective prints generated. The method adjusts said contact pressure by changing the position of the wiping roller shaft center with respect to the intaglio cylinder shaft center using a contact pressure adjustment motor. At least the position of the wiping roller shaft center at low speed and the position of the wiping roller shaft center during printing operation for which the contact pressures have been optimized during a previous printing are stored. Before starting the current printing operation, the wiping roller is moved to the stored low speed position. Then when the current printing operation is started, the wiping roller is moved to the stored printing operation position.

14 Claims, 30 Drawing Sheets

(56) References Cited

U.S. PATENT DOCUMENTS

| | | | | |
|---|---|---|---|---|
| 5,152,220 | A * | 10/1992 | Lindner | B41F 9/1018 101/155 |
| 9,132,624 | B2 * | 9/2015 | Otake | B41F 9/028 |
| 2005/0072328 | A1 * | 4/2005 | Gilliam | B41F 33/0072 101/247 |
| 2011/0297028 | A1 | 12/2011 | Otake et al. | |

FOREIGN PATENT DOCUMENTS

| | | | |
|---|---|---|---|
| JP | 2002-307649 | A | 10/2002 |
| JP | 2010-5940 | A | 1/2010 |
| JP | 2011-251504 | A | 12/2011 |
| JP | 2011-251506 | A | 12/2011 |
| JP | 2012-96372 | A | 5/2012 |
| JP | 2012-96373 | A | 5/2012 |

* cited by examiner

METHOD AND DEVICE FOR ADJUSTING CONTACT PRESSURE OF INTAGLIO PRINTER WIPING ROLLER

TECHNICAL FIELD

The present invention relates to a method of and a device for adjusting the contact pressure of a wiping roller of an intaglio printing press. In particular, the present invention relates to a method of and a device for adjusting the contact pressure of a wiping roller on an intaglio cylinder (hereinafter referred to as the nip pressure).

BACKGROUND ART

In a wiping device of a conventional intaglio printing press, a wiping roller is thermally expanded by the heat generated by the rotation of the printing press, which increases the nip pressure between an intaglio cylinder and the wiping roller. As a result, the wear of the surface of the wiping roller is abnormally increased, thereby shortening the life of the wiping roller. Moreover, ink adhering to the intaglio cylinder is excessively wiped off, thereby making it impossible to obtain proper printing products.

For this reason, the operator must firstly manually adjust the nip pressure between the intaglio cylinder and the wiping roller by checking printing products printed in test printing in a printing preparation phase, which involves low-speed rotation; then, after the speed is raised to a printing speed and the printing press reaches a heat generating state, the operator must manually adjust the nip pressure again by checking the conditions of printing products printed in final printing. This has been a first problem and caused a burden on the operator and also produced a large amount of defective printing products and wasted printing materials due to the manual adjustment from the beginning.

Also, in the wiping device of the conventional intaglio printing press, the wiping roller is brought into pressure contact with the intaglio cylinder and further is rotated in the opposite direction to wipe excess ink off the intaglio cylinder at the contacting portion. Thus, the rubber at the surface of the wiping roller gradually wears.

For this reason, the operator moves the position of the axis of the wiping roller closer to the axis of the intaglio cylinder by the amount of the wear to adjust and maintain the appropriate contact pressure between the intaglio cylinder and the wiping roller so that proper printing products can always be obtained.

Then, the larger the wear becomes, that is, the longer the time passes, the closer the axis of the wiping roller gets to the axis of the intaglio cylinder.

Thus, when the wiping roller wears out and becomes no longer able to properly wipe off ink, the wiping roller is replaced with a new wiping roller.

Here, the axis of the wiping roller has been moved closer to the axis of the intaglio cylinder by the amount of the wear. Thus, if printing is started in such a state, the wear of the surface of the wiping roller will be abnormally large, thereby shortening the life of the wiping roller. Moreover, ink adhering to the intaglio cylinder will be excessively wiped off, thereby making it impossible to obtain proper printing products.

For this reason, the operator must manually adjust the nip pressure between the intaglio cylinder and the wiping roller again by checking printing products printed in test printing or final printing. This has been a second problem and caused a burden on the operator and also produced a large amount of defective printing products and wasted printing materials due to the manual adjustment from the beginning.

In this connection, Patent Document 1 (Japanese Patent Application Publication No. 2011-251504) has proposed a method which includes measuring load applied to a wiping-roller drive motor (the value of current flowing through the motor) configured to drive a wiping roller, and performing control such that this value will be a reference value.

However, the control of Patent Document 1 is complicated and takes time, effort, and cost to incorporate into a machine, and it is therefore frequently the case that the operator still performs manual adjustment.

PRIOR ART DOCUMENT

Patent Document

Patent Document 1: Japanese Patent Application Publication No. 2011-251504

SUMMARY OF THE INVENTION

Problems to be Solved by the Invention

It is an object of the present invention to solve the above-mentioned first problem by: storing the position of a wiping roller in a low-speed state manually adjusted by the operator, at the start of printing, and automatically storing the position of the wiping roller in a printing-speed state (high-speed state) manually adjusted by the operator, at the end of the printing; and in the next printing, automatically moving the wiping roller to the stored position of the wiping roller in the low-speed state before the start of the printing, and automatically moving the wiping roller to the stored position of the wiping roller in the high-speed state upon elapse of a waiting time from the start of the printing to the start of thermal expansion.

It is also an object of the present invention to solve the above-mentioned first and second problems by: storing the position of a wiping roller in a low-speed state manually adjusted by the operator, at the start of printing with the wiping roller replaced with a new roller, and automatically storing the position of the wiping roller in a printing-speed state (high-speed state) manually adjusted by the operator, at the end of the printing; and in printing following replacement of the wiping roller with another new roller, automatically moving the wiping roller to the stored position of the wiping roller in the low-speed state before the start of the printing, and automatically moving the wiping roller to the stored position of the wiping roller in the high-speed state upon elapse of a waiting time from the start of the printing to the start of thermal expansion.

It is also an object of the present invention to solve the above-mentioned second problem by: storing the position of a wiping roller manually adjusted by the operator after replacement of the wiping roller with a new roller; and automatically moving the wiping roller to the position stored after the replacement of the wiping roller with the new roller, in a case where the wiping roller is replaced with another new roller.

It is also an object to keep the operator free from manually controlling the position storing timing at each single occasion by: automatically storing the position of a wiping roller in a low-speed state when the rotation speed of the printing press reaches a high speed at the start of printing; and automatically storing the position of the wiping roller in a high-speed state when the printing press stops printing at the end of the printing.

Means for Solving the Problems

A method of adjusting a contact pressure of a wiping roller of an intaglio printing press according to claim 1 of the present invention for solving the above-mentioned problems is a method of adjusting a contact pressure of a wiping roller of an intaglio printing press including an intaglio cylinder, the wiping roller configured to wipe excess ink off the intaglio cylinder, a contact-pressure adjustment mechanism configured to adjust the contact pressure of the wiping roller on the intaglio cylinder, and a contact-pressure adjustment motor configured to move the wiping roller by driving the contact-pressure adjustment mechanism, characterized in that the method of adjusting a contact pressure comprises: storing an adjusted position of the wiping roller in a low-speed state at a time at or before a start of final printing; storing an adjusted position of the wiping roller in a printing-speed state at a time at or after an end of the final printing; and controlling the contact-pressure adjustment motor in a next printing operation in such a way as to move the wiping roller at a time at or before a start of final printing to the position stored at the time at or before the start of the final printing in the last printing operation, and move the wiping roller at a time at or after the start of the final printing to the position stored at the time at or after the end of the final printing in the last printing operation.

A method of adjusting a contact pressure of a wiping roller of an intaglio printing press according to claim 2 of the present invention for solving the above-mentioned problems is the method according to claim 1 characterized in that the time at or before the start of the final printing in the last printing operation includes when a rotation speed of the printing press reaches a high speed, the time at or after the end of the final printing in the last printing operation includes when the printing press stops printing, the time at or before the start of the final printing in the next printing operation includes when the wiping roller is thrown onto the intaglio cylinder, and the time at or after the start of the final printing in the next printing operation includes when the rotation speed of the printing press reaches the high speed.

A method of adjusting a contact pressure of a wiping roller of an intaglio printing press according to claim 3 of the present invention for solving the above-mentioned problems is the method according to claim 2 characterized in that the time at or after the start of the final printing in the next printing operation includes when a predetermined period of time elapses since the rotation speed of the printing press reaches the high speed.

A method of adjusting a contact pressure of a wiping roller of an intaglio printing press according to claim 4 of the present invention for solving the above-mentioned problems is the method according to claim 1 characterized in that the method further comprises: storing an adjusted position of the wiping roller in the low-speed state at a time at or before a start of final printing following replacement of the wiping roller with a new roller; storing an adjusted position of the wiping roller in the printing-speed state at a time at or after an end of the final printing following the replacement of the wiping roller with the new roller; and controlling the contact-pressure adjustment motor after replacement of the wiping roller with another new roller in such a way as to move the wiping roller at a time at or before a start of final printing to the position stored at the time at or before the start of the final printing following the replacement of the wiping roller with the new roller, and move the wiping roller at a time at or after the start of the final printing to the position stored at the time at or after the end of the final printing following the replacement of the wiping roller with the new roller.

A method of adjusting a contact pressure of a wiping roller of an intaglio printing press according to claim 5 of the present invention for solving the above-mentioned problems is the method according to claim 4 characterized in that the time at or before the start of the final printing following the replacement of the wiping roller with the new roller includes when a rotation speed of the printing press reaches a high speed, the time at or after the end of the final printing following the replacement of the wiping roller with the new roller includes when the printing press stops printing, the time at or before the start of the final printing following the replacement of the wiping roller with the another new roller includes when the wiping roller is thrown onto the intaglio cylinder, and the time at or after the start of the final printing following the replacement of the wiping roller with the another new roller includes when the rotation speed of the printing press reaches the high speed.

A method of adjusting a contact pressure of a wiping roller of an intaglio printing press according to claim 6 of the present invention for solving the above-mentioned problems is the method according to claim 5 characterized in that the time at or after the start of the final printing following the replacement of the wiping roller with the another new roller includes when a predetermined period of time elapses since the rotation speed of the printing press reaches the high speed.

A device for adjusting a contact pressure of a wiping roller of an intaglio printing press according to claim 7 of the present invention for solving the above-mentioned problems is a device for adjusting a contact pressure of a wiping roller of an intaglio printing press including an intaglio cylinder, the wiping roller configured to wipe excess ink off the intaglio cylinder, a contact-pressure adjustment mechanism configured to adjust the contact pressure of the wiping roller on the intaglio cylinder, and a contact-pressure adjustment motor configured to move the wiping roller by driving the contact-pressure adjustment mechanism, characterized in that the device is configured to: store an adjusted position of the wiping roller in a low-speed state into a first memory at a time at or before a start of final printing; store an adjusted position of the wiping roller in a printing-speed state into a second memory at a time at or after an end of the final printing; and control the contact-pressure adjustment motor in a next printing operation in such a way as to move the wiping roller at a time at or before a start of final printing to the position stored into the first memory at the time at or before the start of the final printing in the last printing operation, and move the wiping roller at a time at or after the start of the final printing to the position stored into the second memory at the time at or after the end of the final printing in the last printing operation.

A device for adjusting a contact pressure of a wiping roller of an intaglio printing press according to claim 8 of the present invention for solving the above-mentioned problems is the device according to claim 7 characterized in that the time at or before the start of the final printing in the last printing operation includes when a rotation speed of the printing press reaches a high speed, the time at or after the end of the final printing in the last printing operation includes when the printing press stops printing, the time at or before the start of the final printing in the next printing operation includes when the wiping roller is thrown onto the intaglio cylinder, and the time at or after the start of the final printing in the next printing operation includes when the rotation speed of the printing press reaches the high speed.

A device for adjusting a contact pressure of a wiping roller of an intaglio printing press according to claim 9 of the present invention for solving the above-mentioned problems is the device according to claim 8 characterized in that the time at or after the start of the final printing in the next printing operation includes when a predetermined period of time elapses since the rotation speed of the printing press reaches the high speed.

A device for adjusting a contact pressure of a wiping roller of an intaglio printing press according to claim 10 of the present invention for solving the above-mentioned problems is the device according to claim 7 characterized in that the device is further configured to: store an adjusted position of the wiping roller in the low-speed state into a third memory at a time at or before a start of final printing following replacement of the wiping roller with a new roller; store an adjusted position of the wiping roller in the printing-speed state into a fourth memory at a time at or after an end of the final printing following the replacement of the wiping roller with the new roller; and control the contact-pressure adjustment motor after replacement of the wiping roller with another new roller in such a way as to move the wiping roller at a time at or before a start of final printing to the position stored into the third memory at the time at or before the start of the final printing following the replacement of the wiping roller with the new roller, and move the wiping roller at a time at or after the start of the final printing to the position stored into the fourth memory at the time at or after the end of the final printing following the replacement of the wiping roller with the new roller.

A device for adjusting a contact pressure of a wiping roller of an intaglio printing press according to claim 11 of the present invention for solving the above-mentioned problems is the device according to claim 10 characterized in that the time at or before the start of the final printing following the replacement of the wiping roller with the new roller includes when a rotation speed of the printing press reaches a high speed, the time at or after the end of the final printing following the replacement of the wiping roller with the new roller includes when the printing press stops printing, the time at or before the start of the final printing following the replacement of the wiping roller with the another new roller includes when the wiping roller is thrown onto the intaglio cylinder, and the time at or after the start of the final printing following the replacement of the wiping roller with the another new roller includes when the rotation speed of the printing press reaches the high speed.

A device for adjusting a contact pressure of a wiping roller of an intaglio printing press according to claim 12 of the present invention for solving the above-mentioned problems is the device according to claim 11 characterized in that the time at or after the start of the final printing following the replacement of the wiping roller with the another new roller includes when a predetermined period of time elapses since the rotation speed of the printing press reaches the high speed.

A method of adjusting a contact pressure of a wiping roller of an intaglio printing press according to claim 13 of the present invention for solving the above-mentioned problems is the method according to claim 1 characterized in that the method comprises: storing a position of the wiping roller after replacement of the wiping roller with a new roller, instead of storing the adjusted positions of the wiping roller in the low-speed state and the printing-speed state; and moving the wiping roller to the position stored after the replacement of the wiping roller with the new roller, after replacement of the wiping roller with another new roller, instead of moving the wiping roller in the next printing operation to the position stored at the time at or before the start of the final printing in the last printing operation and to the position stored at the time at or after the end of the final printing in the last printing operation.

A device for adjusting a contact pressure of a wiping roller of an intaglio printing press according to claim 14 of the present invention for solving the above-mentioned problems is the device according to claim 7 characterized in that the device is configured to:

store a position of the wiping roller after replacement of the wiping roller with a new roller into a third memory or a fourth memory, instead of storing the adjusted positions of the wiping roller in the low-speed state and the printing-speed state into the first memory and the second memory; and move the wiping roller to the position stored into the third memory or the fourth memory after the replacement of the wiping roller with the new roller, after replacement of the wiping roller with another new roller, instead of moving the wiping roller in the next printing operation to the position stored into the first memory and the second memory at the time at or before the start of the final printing in the last printing operation and at the time at or after the end of the final printing in the last printing operation.

Effects of the Invention

In the present invention, the position of the wiping roller in the low-speed state manually adjusted by the operator is stored at the start of printing, and the position of the wiping roller in the printing-speed state (high-speed state) manually adjusted by the operator is automatically stored at the end of the printing; in the next printing, the wiping roller is automatically moved to the stored position of the wiping roller in the low-speed state before the start of the printing, and the wiping roller is automatically moved to the stored position of the wiping roller in the high-speed state upon elapse of the waiting time from the start of the printing to the start of thermal expansion. In this way, the above-mentioned first problem is solved, which causes a heavy burden on the operator, produces a large amount of defective printing products, and wastes printing materials.

Also, in the present invention, the position of the wiping roller in the low-speed state manually adjusted by the operator is stored at the start of printing with the wiping roller replaced with a new roller, and the position of the wiping roller in the printing-speed state (high-speed state) manually adjusted by the operator is automatically stored at the end of the printing; in printing following replacement of the wiping roller with a next new roller, the wiping roller is automatically moved to the stored position of the wiping roller in the low-speed state before the start of the printing, and the wiping roller is automatically moved to the stored position of the wiping roller in the high-speed state upon elapse of the waiting time from the start of the printing to the start of thermal expansion. In this way, the above-mentioned first and second problems are solved, which cause a heavy burden on the operator, produce a large amount of defective printing products, and waste printing materials.

In the present invention, the position of the wiping roller manually adjusted by the operator is stored after replacement of the wiping roller with a new roller; and the wiping roller is automatically moved to the position stored after the replacement of the wiping roller with the new roller, in a case where the wiping roller is replaced with another new roller. In this way, the above-mentioned second problem is solved, which causes a heavy burden on the operator, produces a large amount of defective printing products, and wastes printing materials.

Also, the position of the wiping roller in the low-speed state is automatically stored when the rotation speed of the printing press reaches the high speed at the start of printing; and the position of the wiping roller in the high-speed state is automatically stored when the printing press stops printing at the end of the printing. In this way, the operator no longer needs to manually control the position storing timing at each single occasion.

BRIEF DESCRIPTION OF THE DRAWINGS

FIG. 100 is an operation flowchart mainly of the nip-pressure adjustment device of the intaglio printing press in the second embodiment of the present invention.

MODES FOR CARRYING OUT THE INVENTION

Figure 1A:
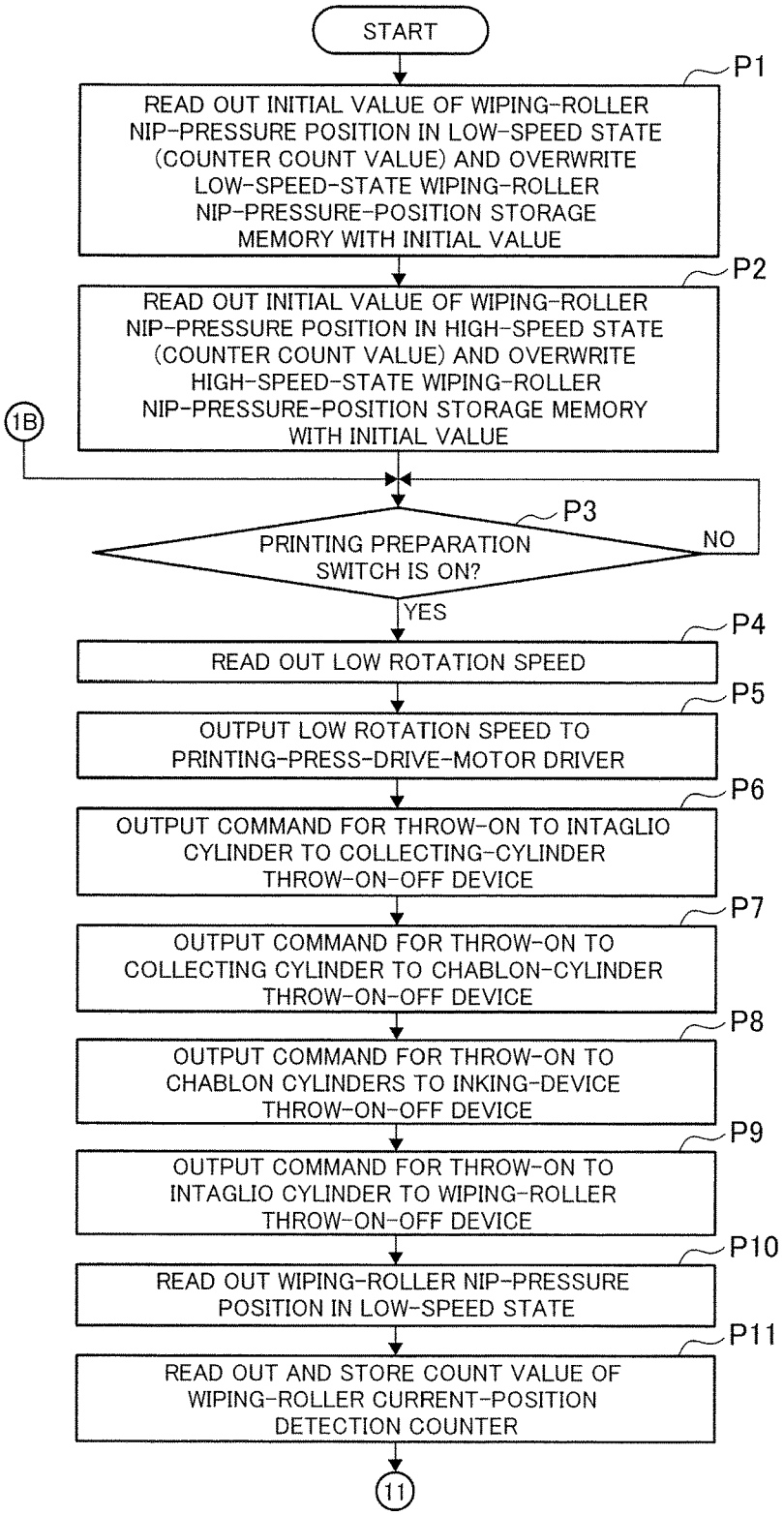
FIG. 1A is an operation flowchart mainly of a nip-pressure adjustment device of an intaglio printing press in a first embodiment of the present invention.
Figure 1B:
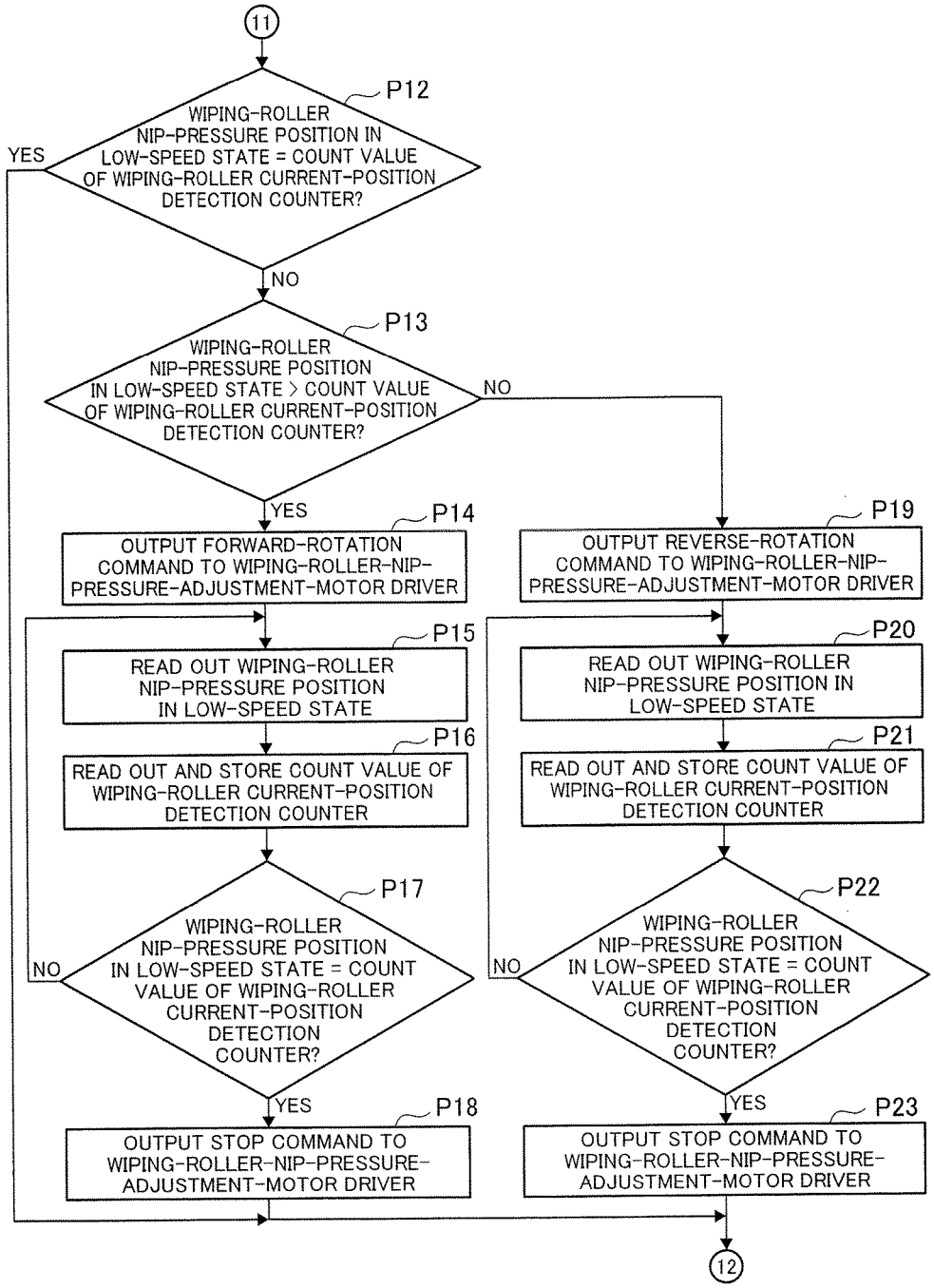
FIG. 1B is an operation flowchart mainly of the nip-pressure adjustment device of the intaglio printing press in the first embodiment of the present invention.
Figure 1C:
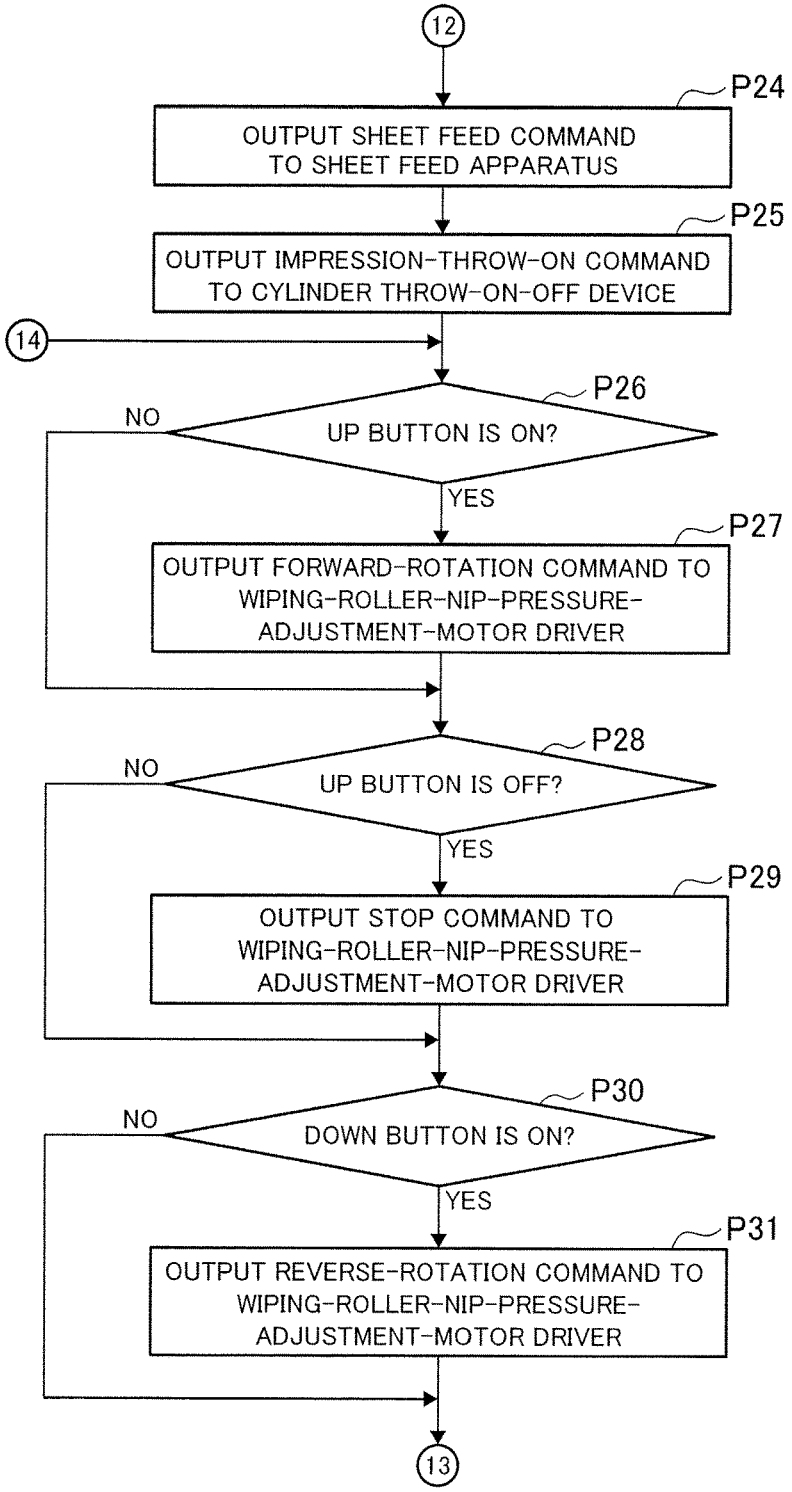
FIG. 1C is an operation flowchart mainly of the nip-pressure adjustment device of the intaglio printing press in the first embodiment of the present invention.
Figure 1D:
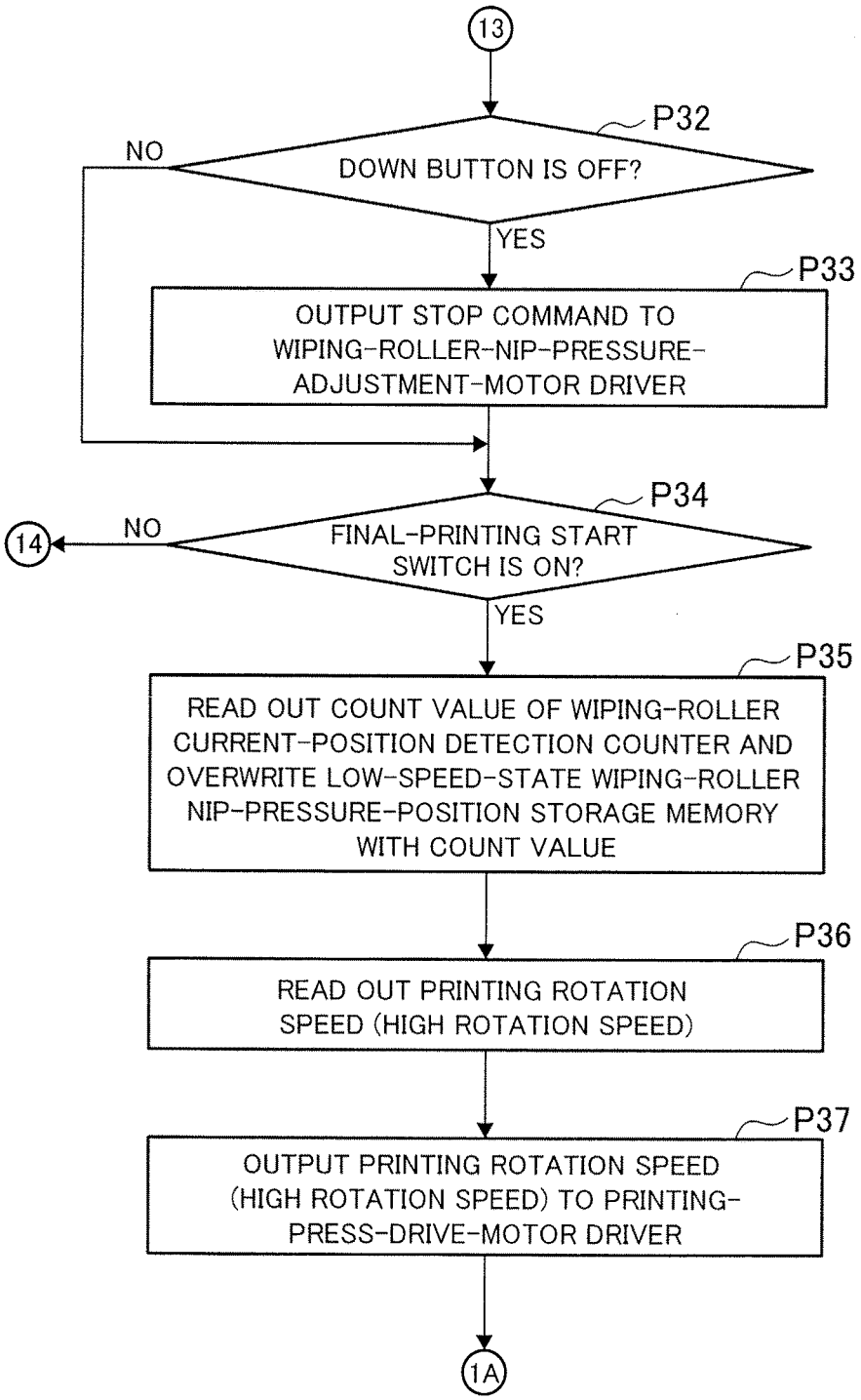
FIG. 1D is an operation flowchart mainly of the nip-pressure adjustment device of the intaglio printing press in the first embodiment of the present invention.
Figure 2A:
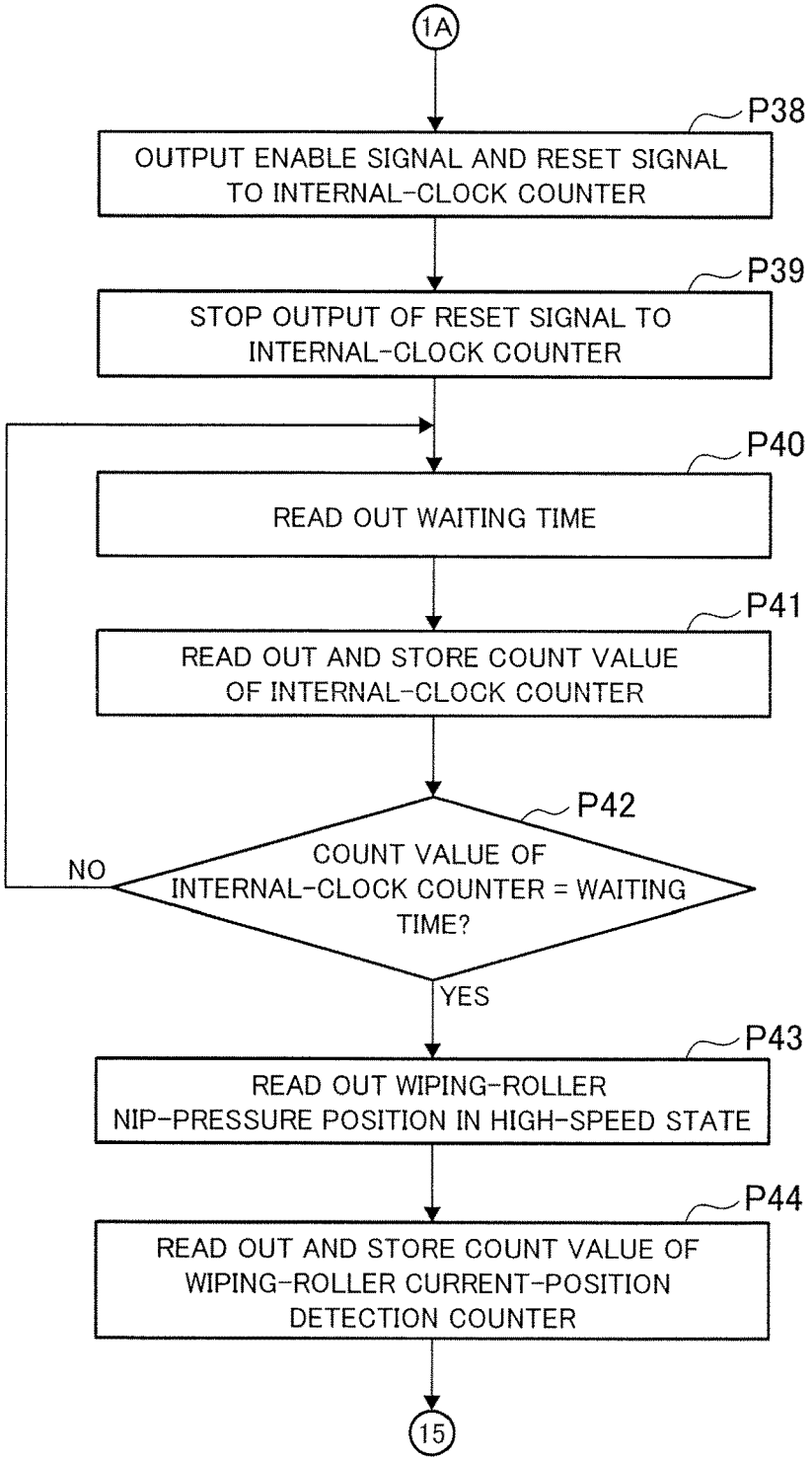
FIG. 2A is an operation flowchart mainly of the nip-pressure adjustment device of the intaglio printing press in the first embodiment of the present invention.
Figure 2B:
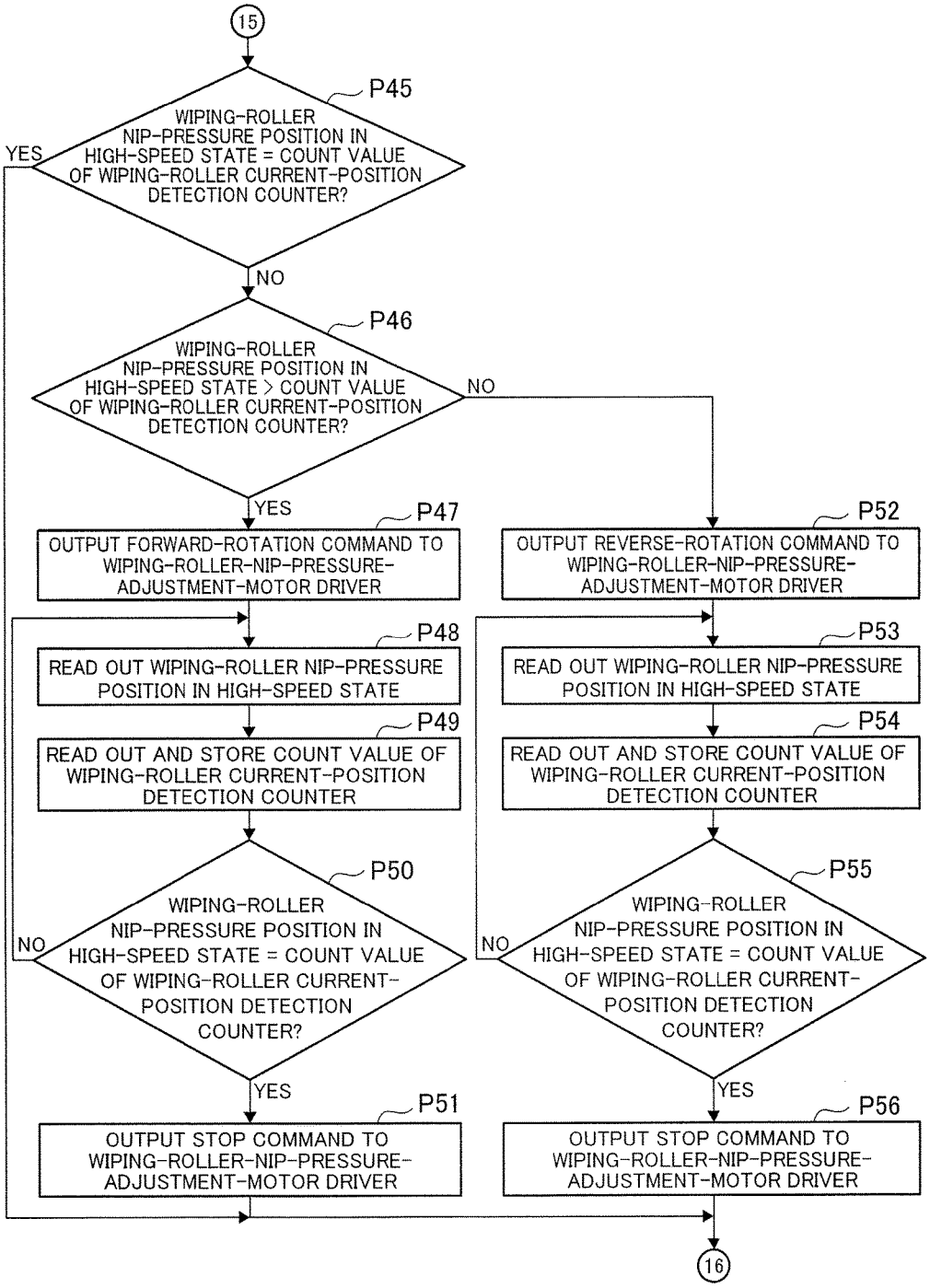
FIG. 2B is an operation flowchart mainly of the nip-pressure adjustment device of the intaglio printing press in the first embodiment of the present invention.
Figure 2C:
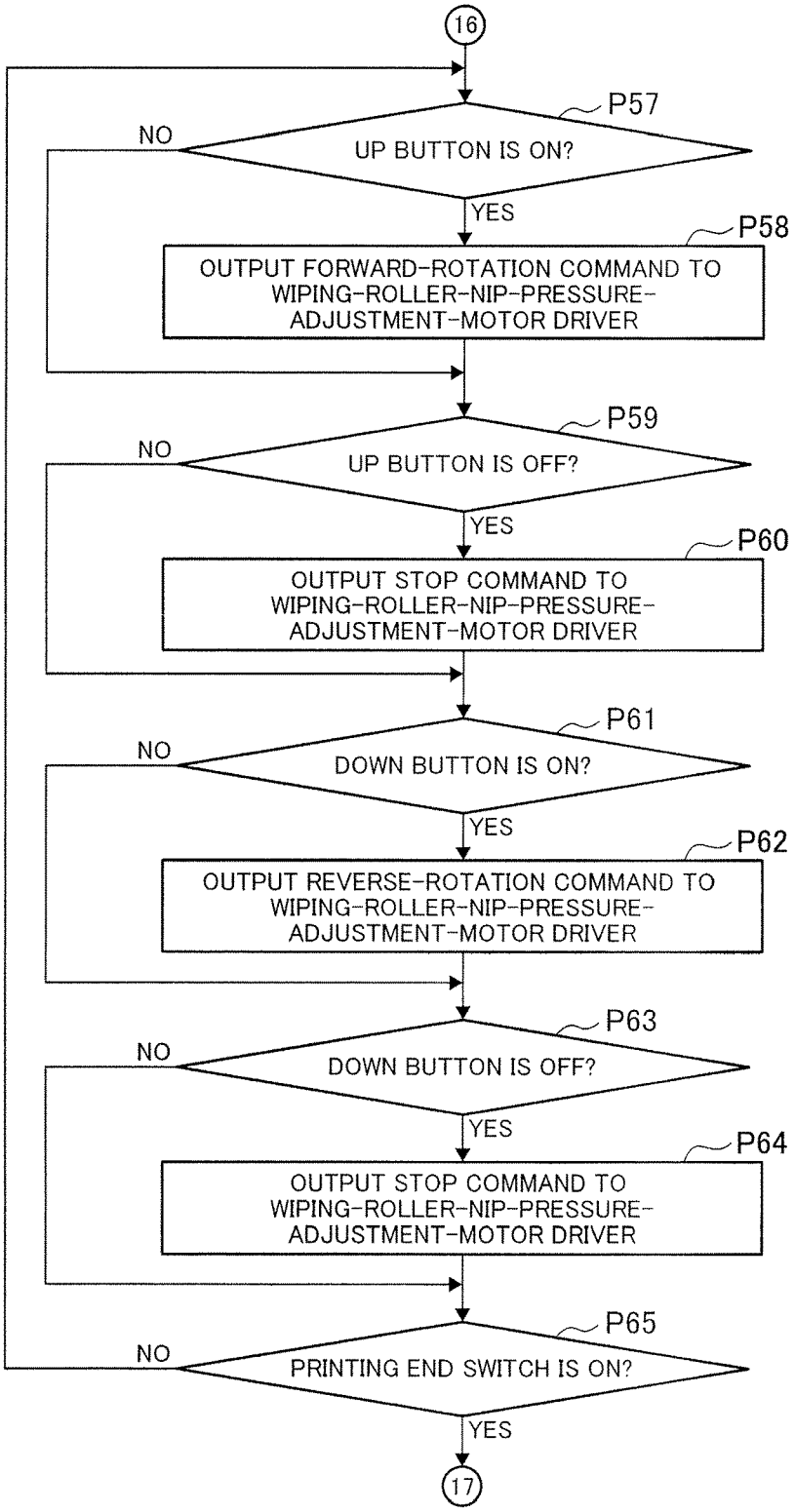
FIG. 2C is an operation flowchart mainly of the nip-pressure adjustment device of the intaglio printing press in the first embodiment of the present invention.
Figure 2D:
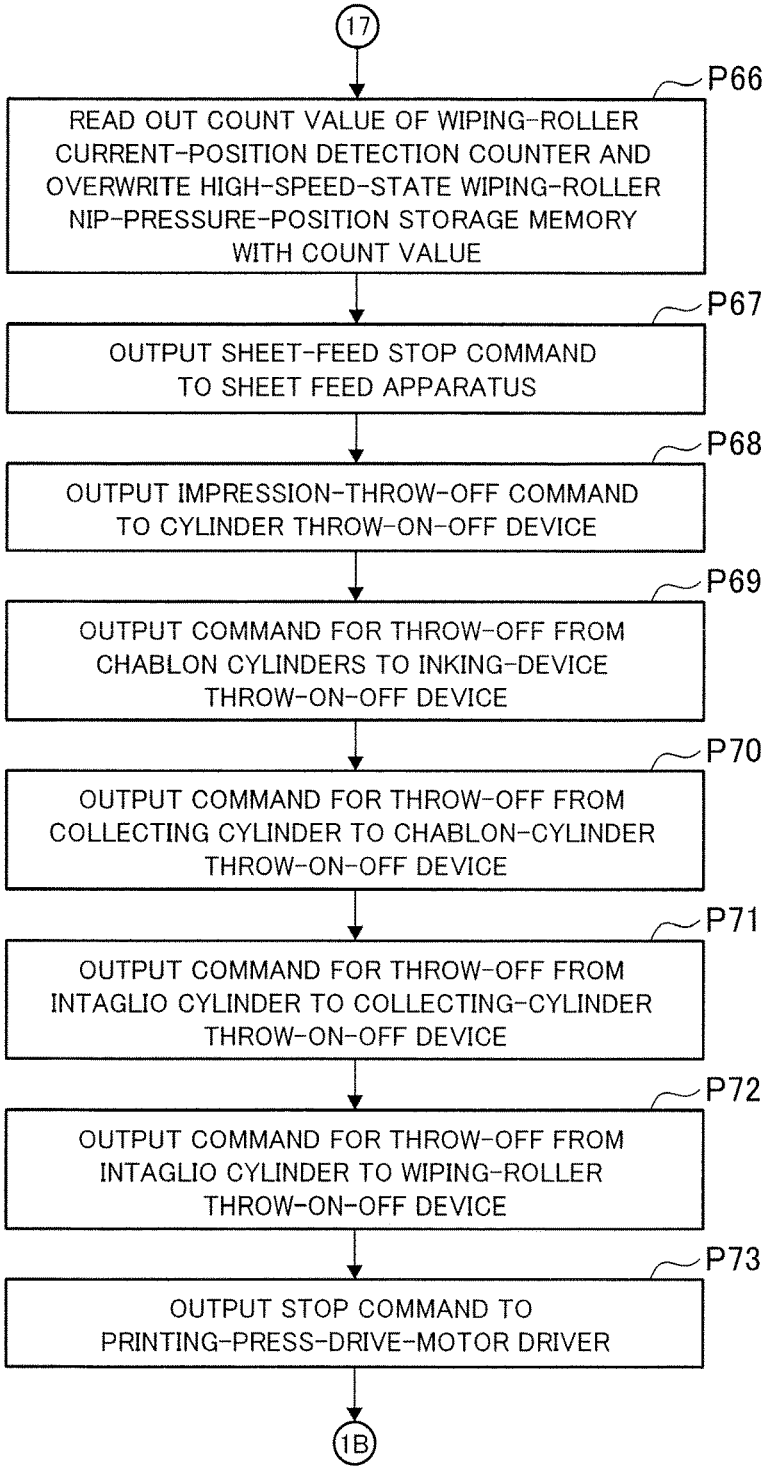
FIG. 2D is an operation flowchart mainly of the nip-pressure adjustment device of the intaglio printing press in the first embodiment of the present invention.

The present invention will be described below in detail with reference to embodiments illustrated in the drawings.

Embodiment 1

Figure 3A:
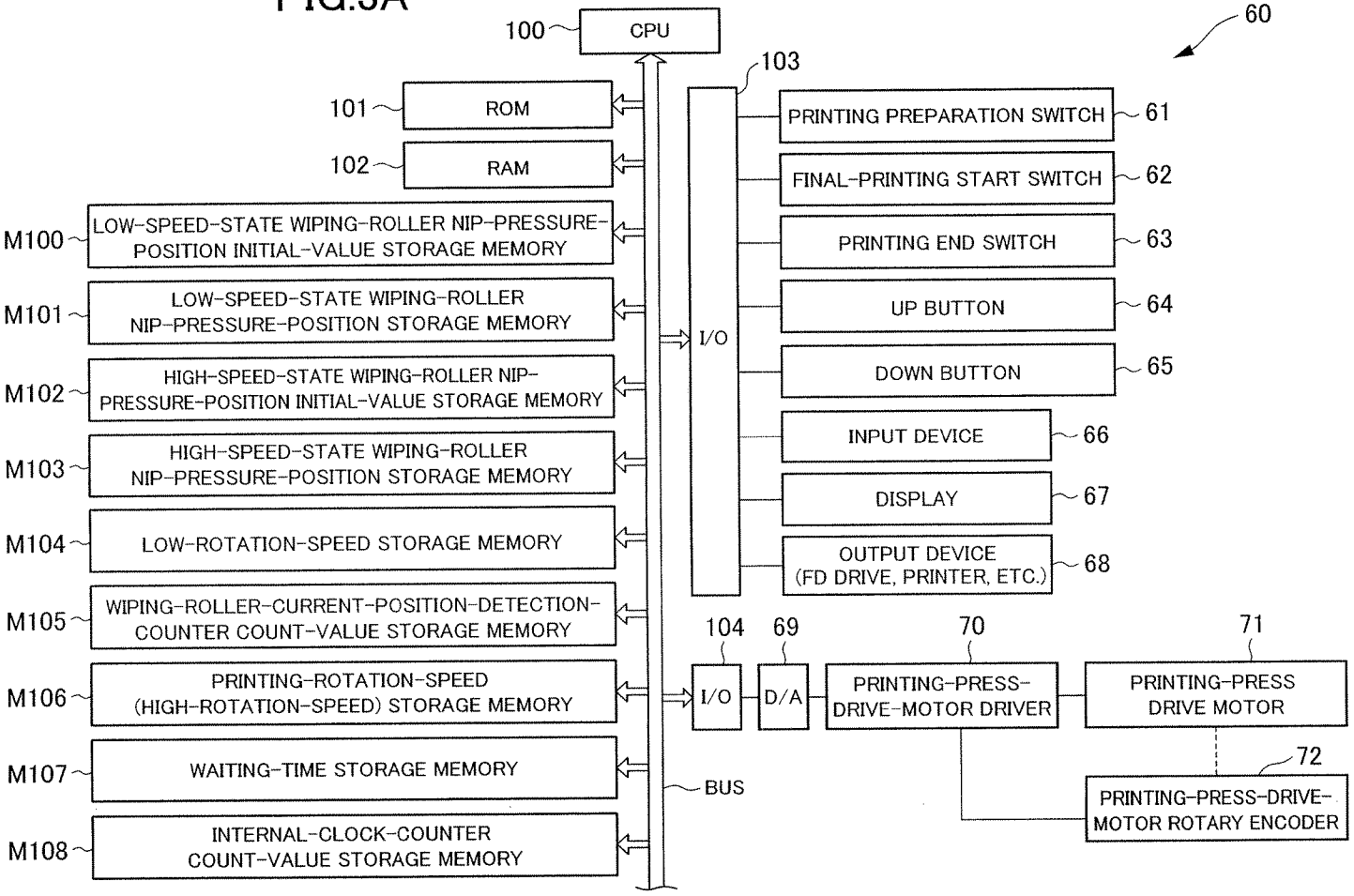
FIG. 3A is a hardware block diagram mainly of the nip-pressure adjustment device of the intaglio printing press in the first embodiment of the present invention.
Figure 3B:
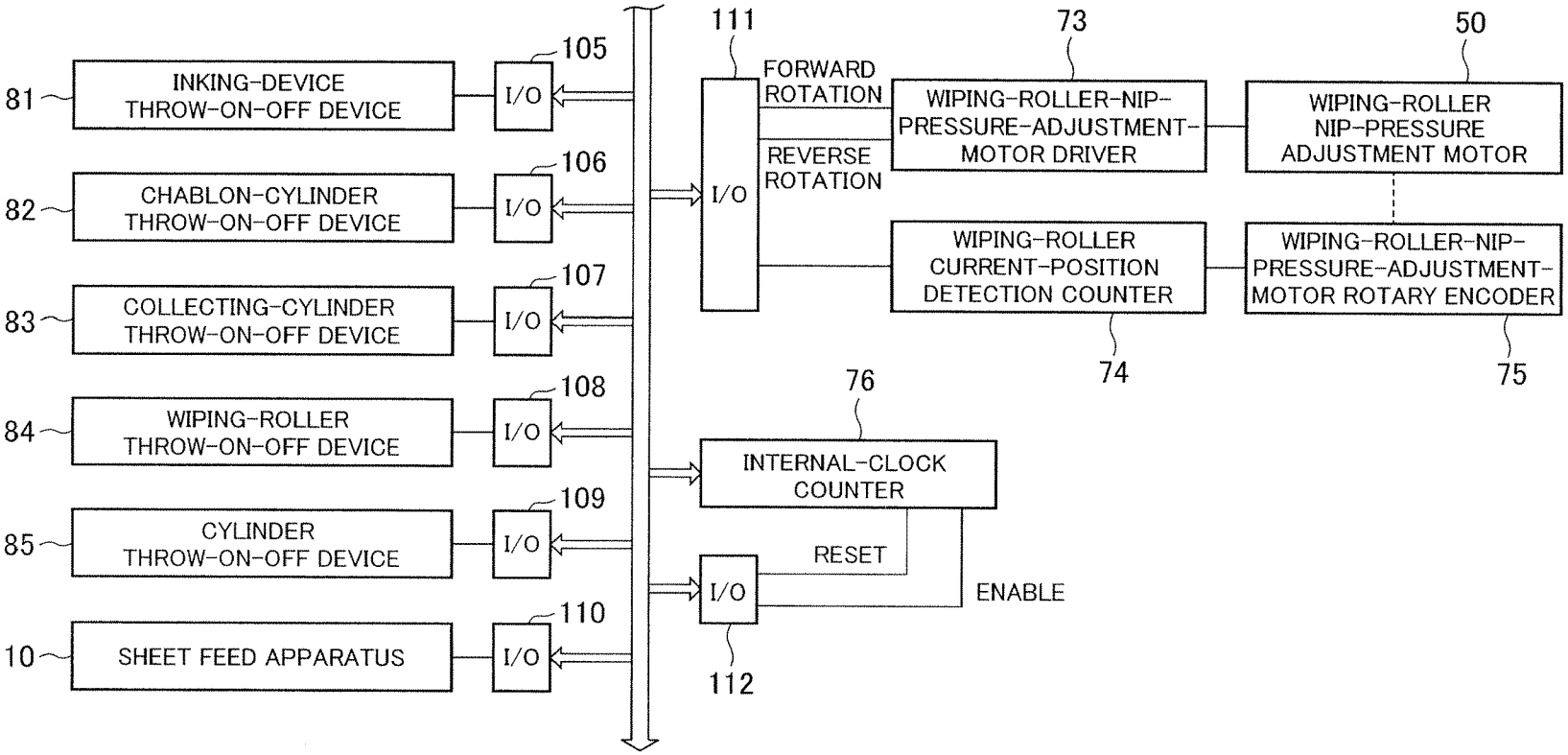
FIG. 3B is a hardware block diagram mainly of the nip-pressure adjustment device of the intaglio printing press in the first embodiment of the present invention.
Figure 4:
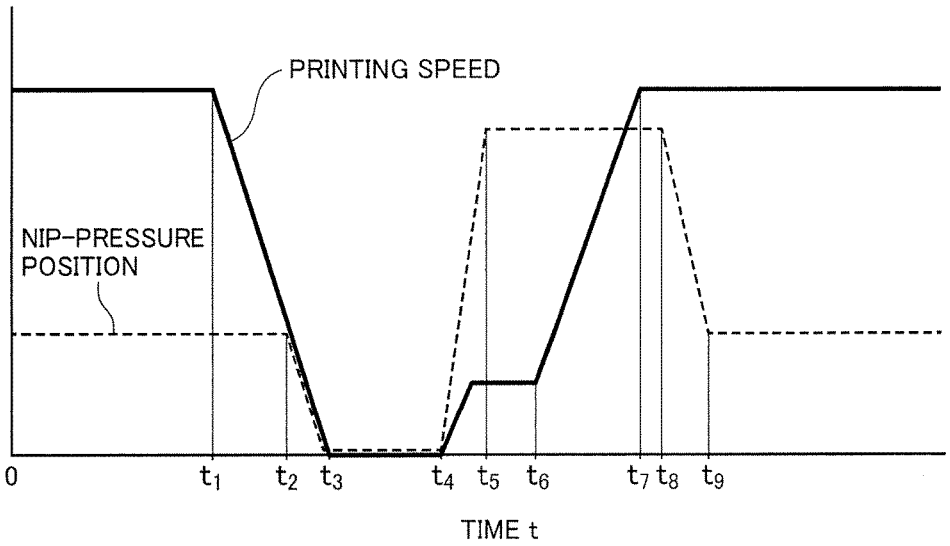
FIG. 4 is a timing chart of a nip-pressure position and a printing speed.
Figure 5:
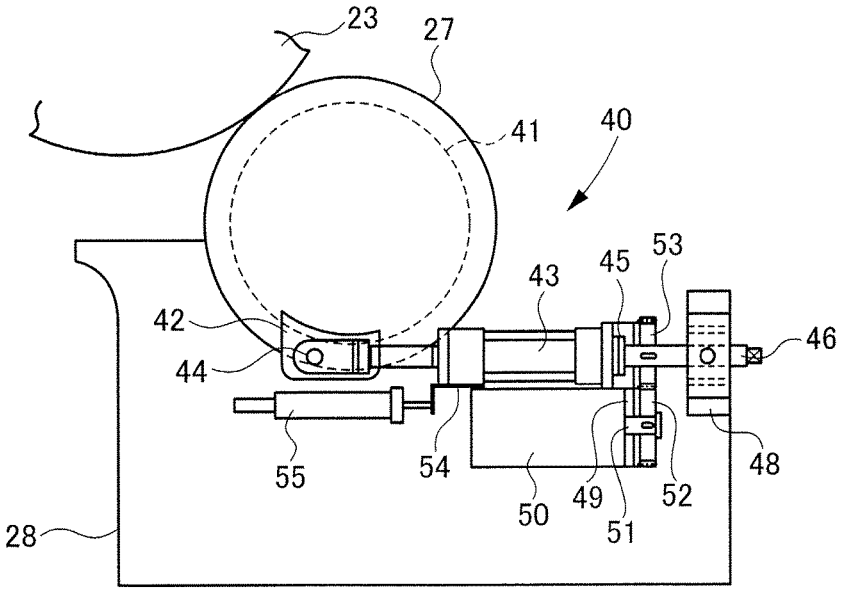
FIG. 5 is a side view of the nip-pressure adjustment device in a wiping device.
Figure 6:
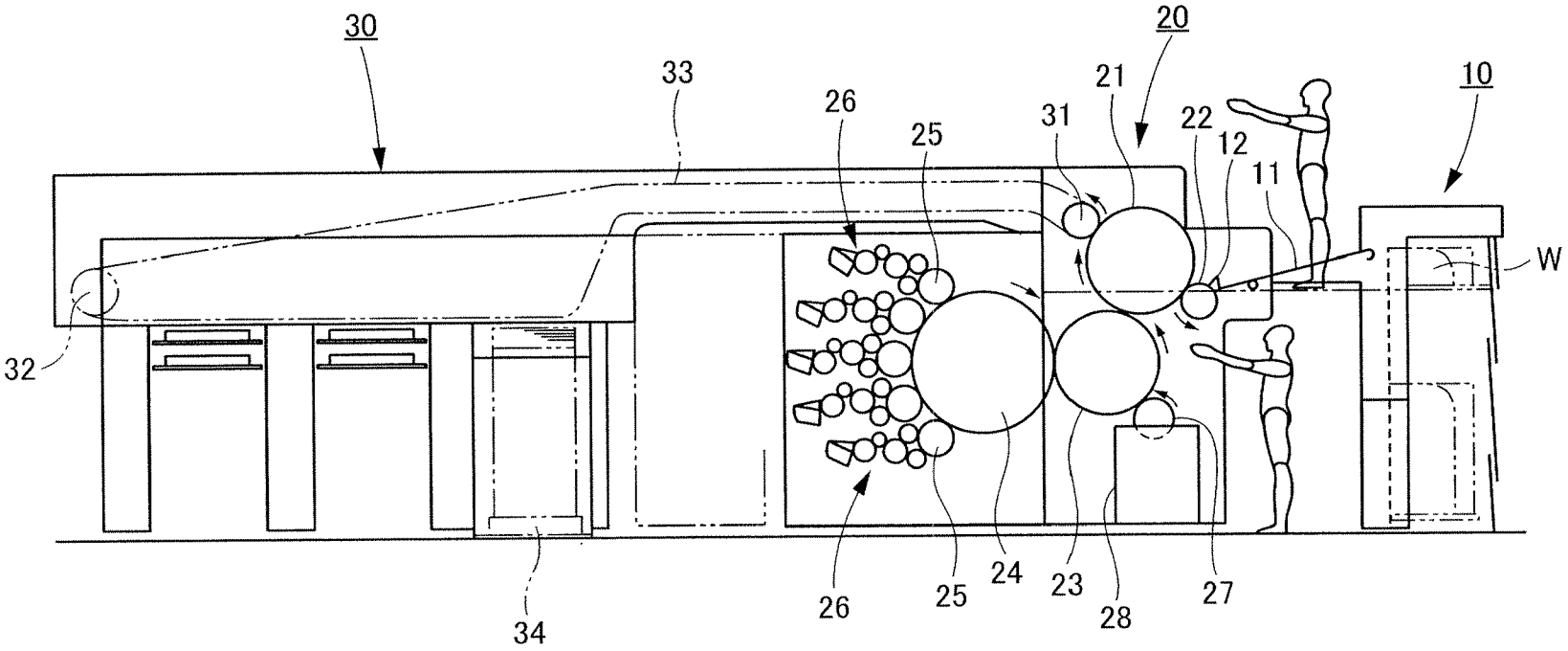
FIG. 6 is an entire side view of the intaglio printing press.
Figure 7A:
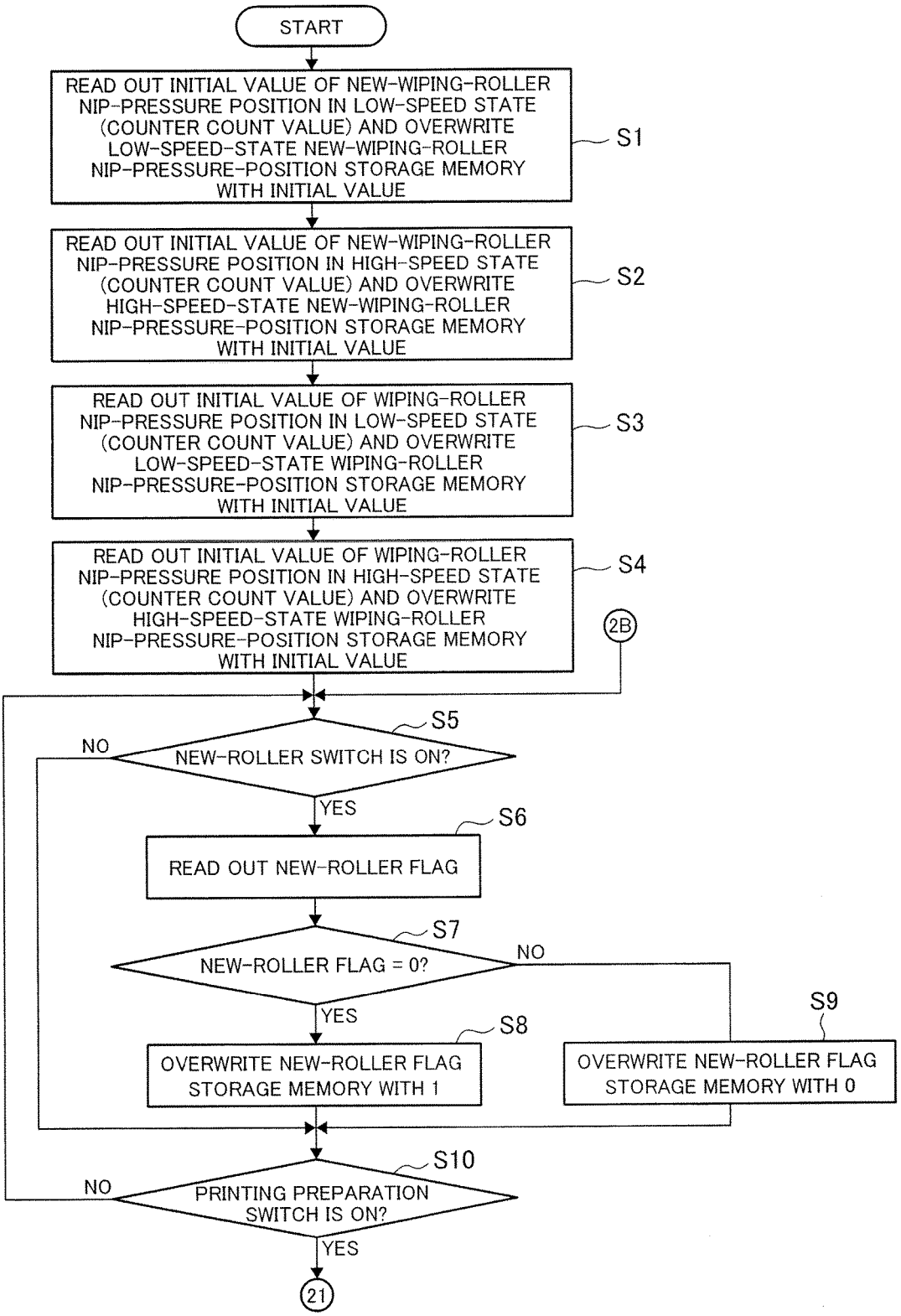
FIG. 7A is an operation flowchart mainly of a nip-pressure adjustment device of an intaglio printing press in a second embodiment of the present invention.
Figure 7B:
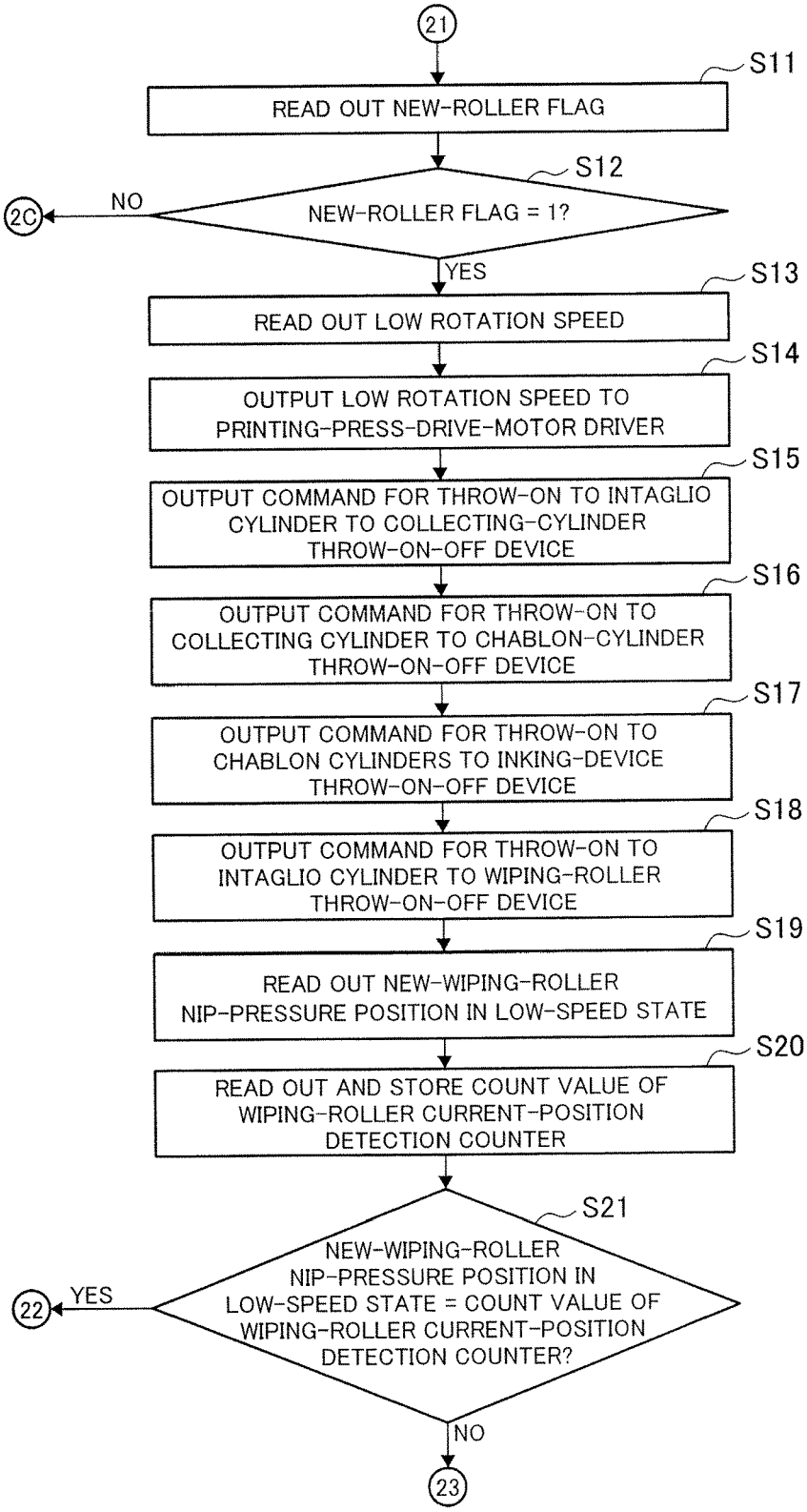
FIG. 7B is an operation flowchart mainly of the nip-pressure adjustment device of the intaglio printing press in the second embodiment of the present invention.
Figure 7C:
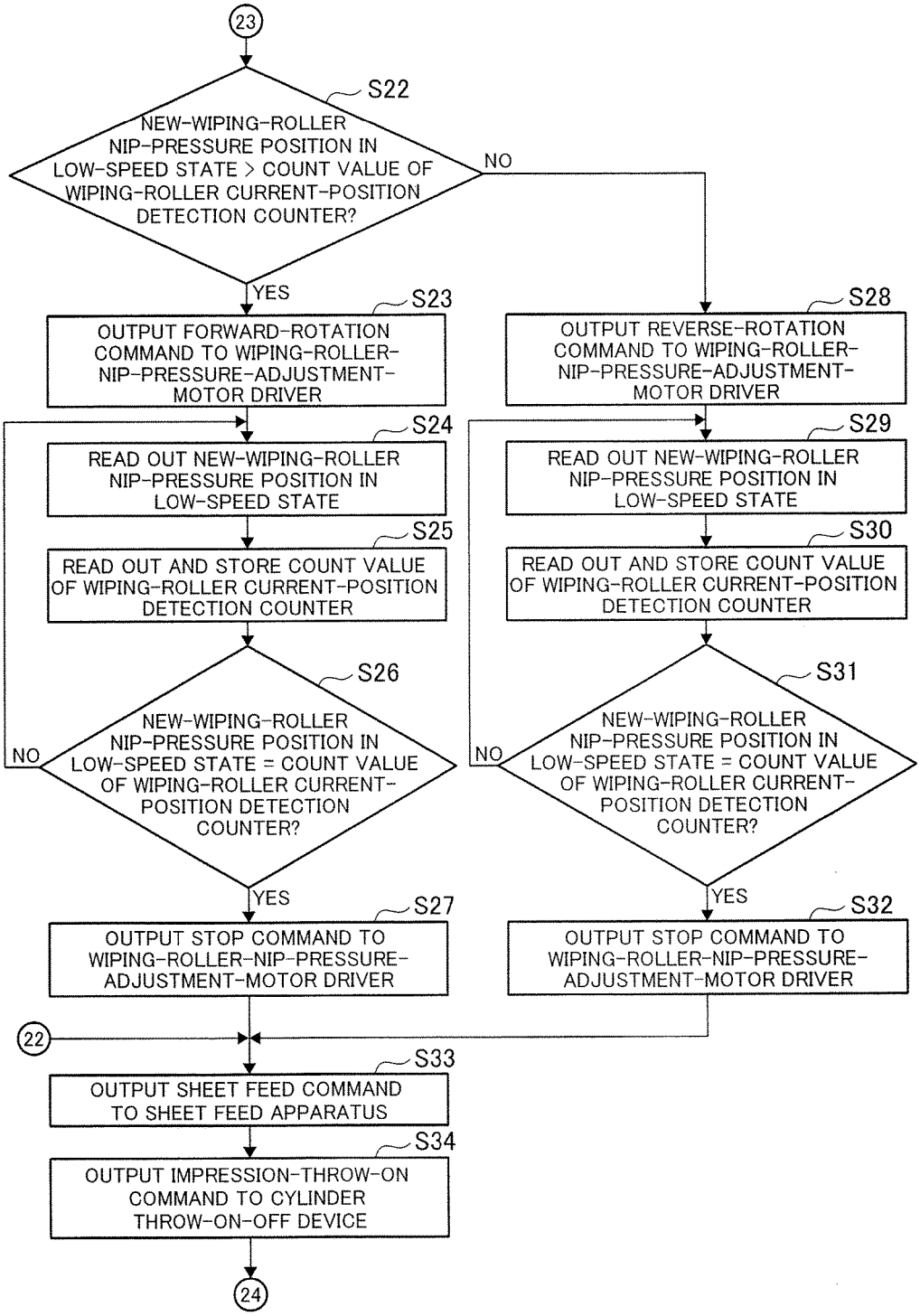
FIG. 7C is an operation flowchart mainly of the nip-pressure adjustment device of the intaglio printing press in the second embodiment of the present invention.
Figure 7D:
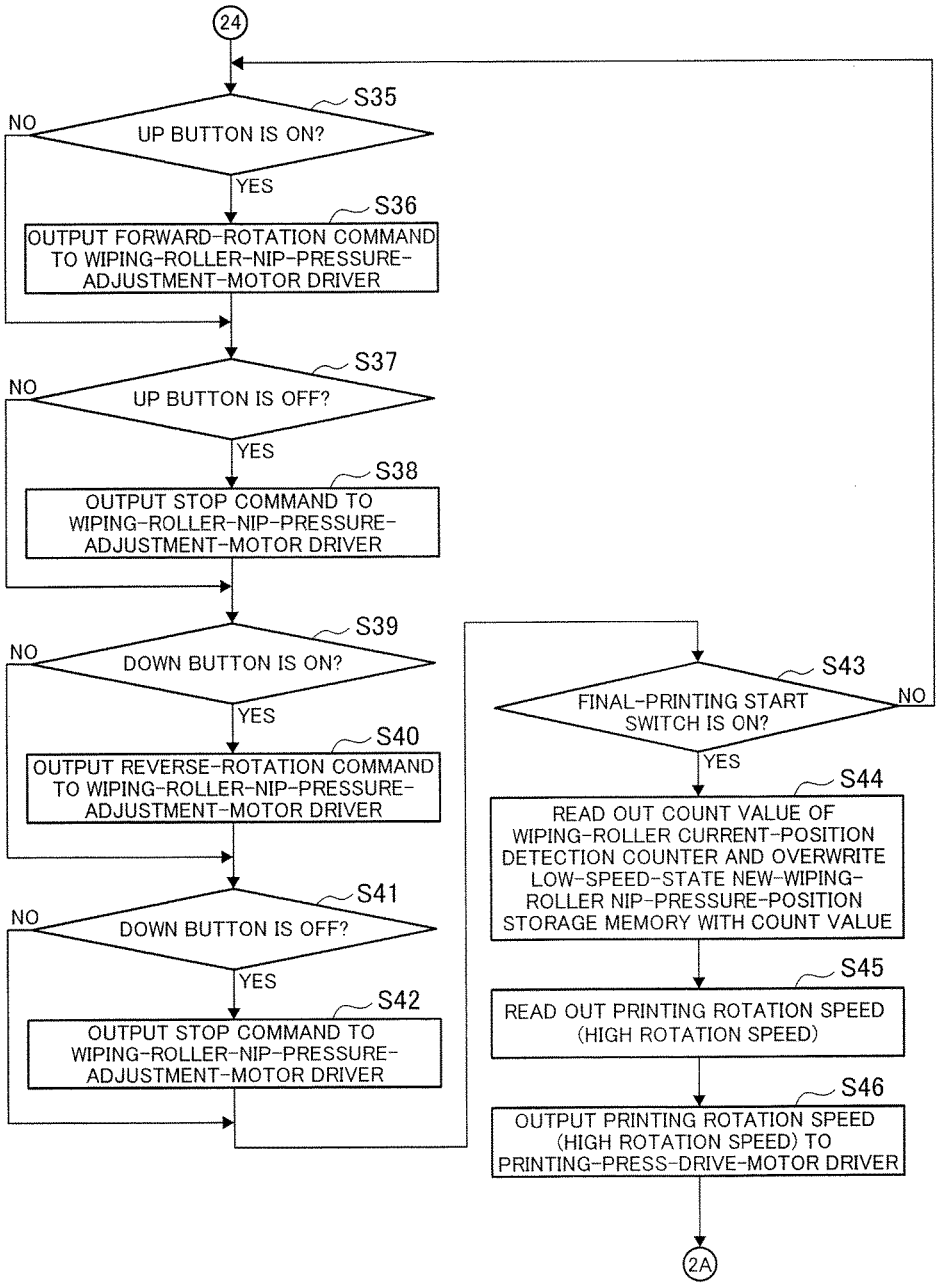
FIG. 7D is an operation flowchart mainly of the nip-pressure adjustment device of the intaglio printing press in the second embodiment of the present invention.
Figure 8A:
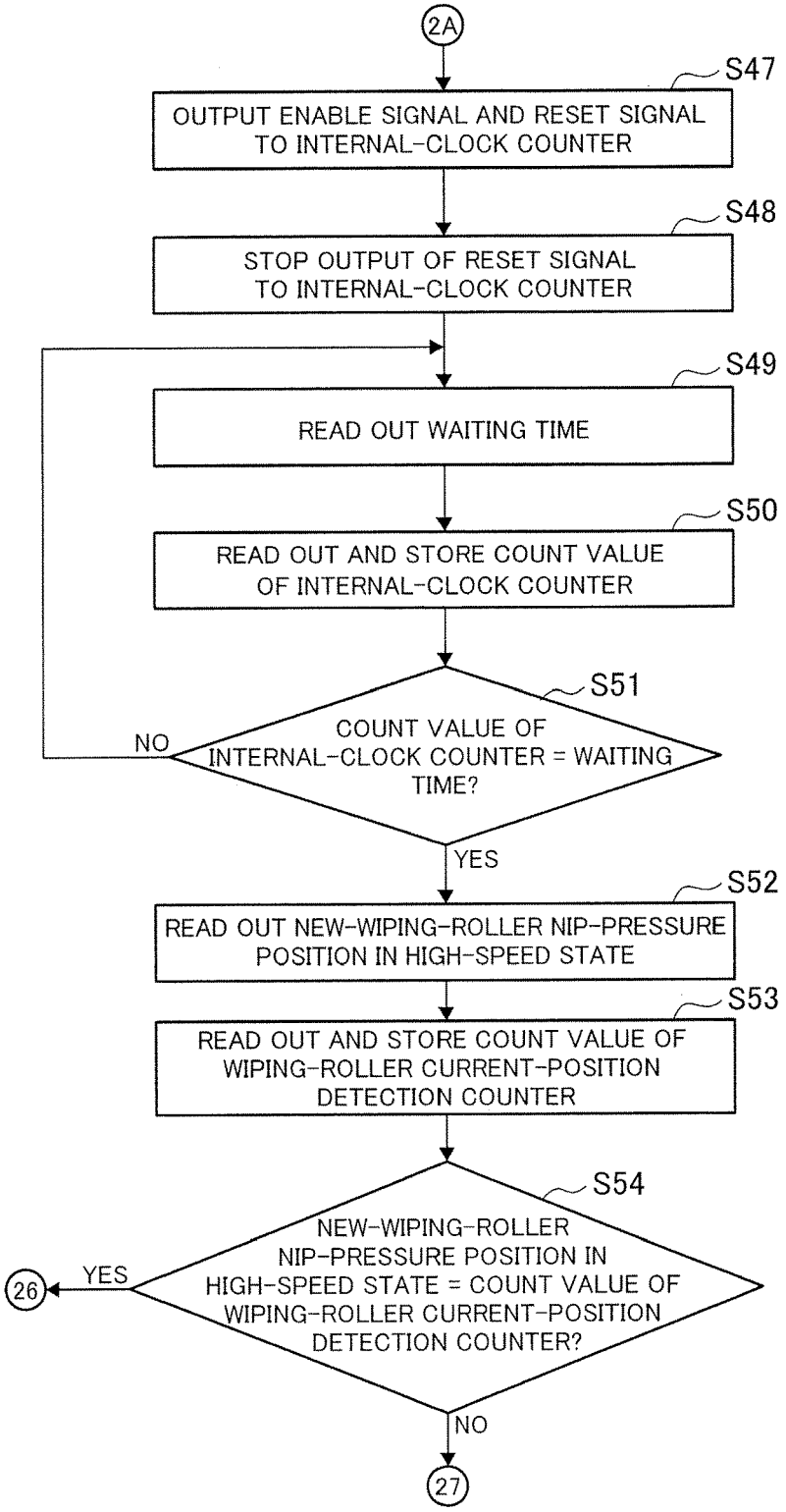
FIG. 8A is an operation flowchart mainly of the nip-pressure adjustment device of the intaglio printing press in the second embodiment of the present invention.
Figure 8B:
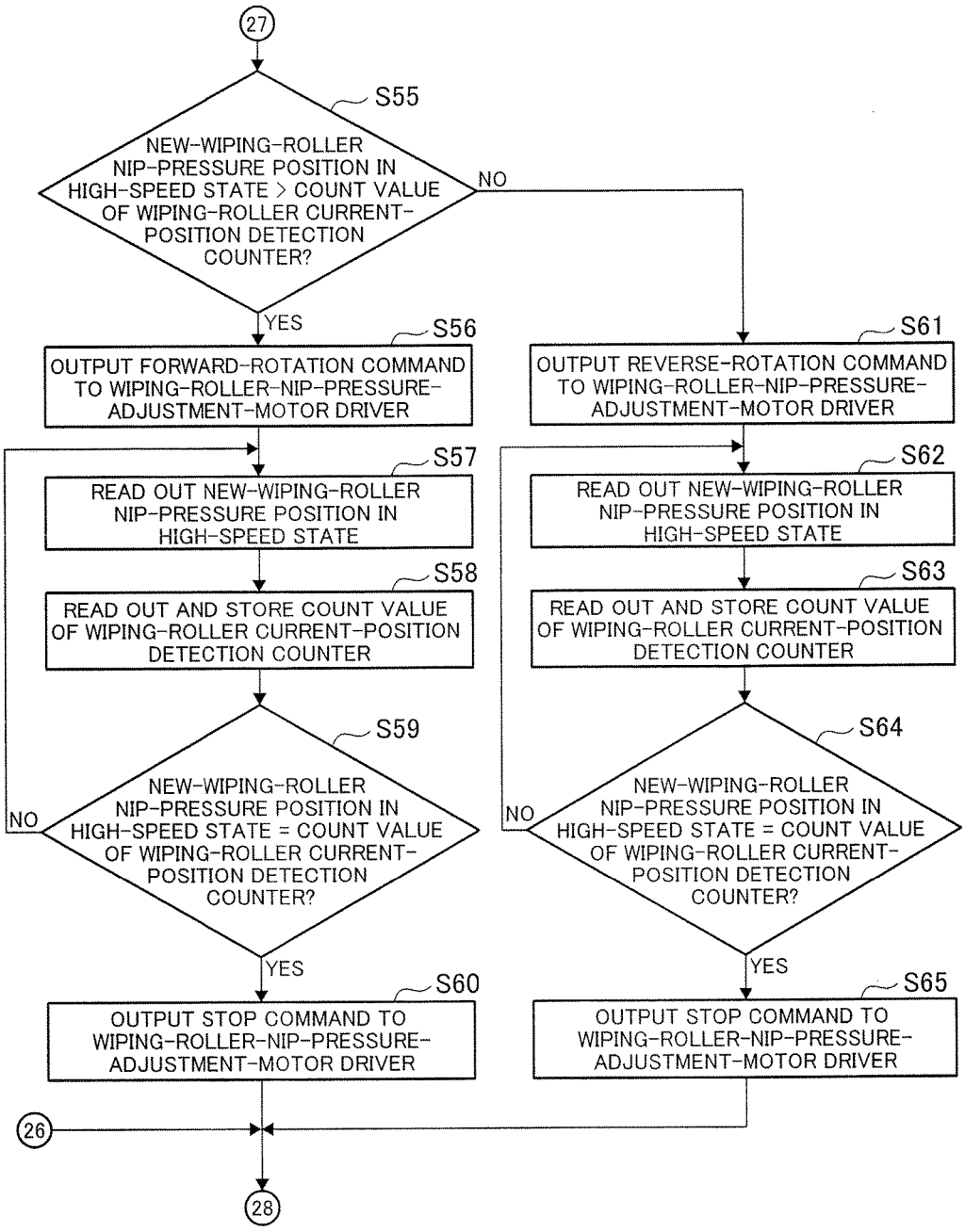
FIG. 8B is an operation flowchart mainly of the nip-pressure adjustment device of the intaglio printing press in the second embodiment of the present invention.
Figure 8C:
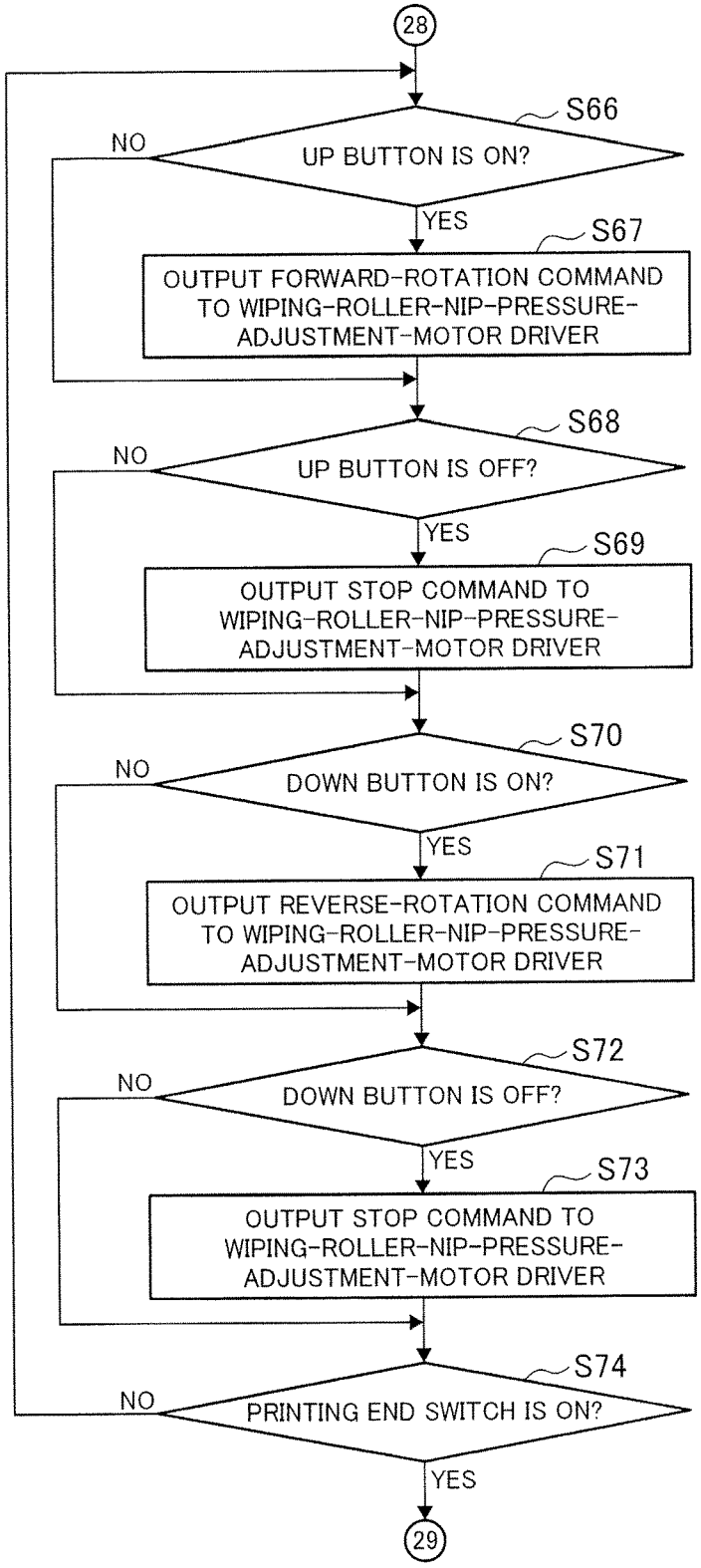
FIG. 8C is an operation flowchart mainly of the nip-pressure adjustment device of the intaglio printing press in the second embodiment of the present invention.
Figure 8D:
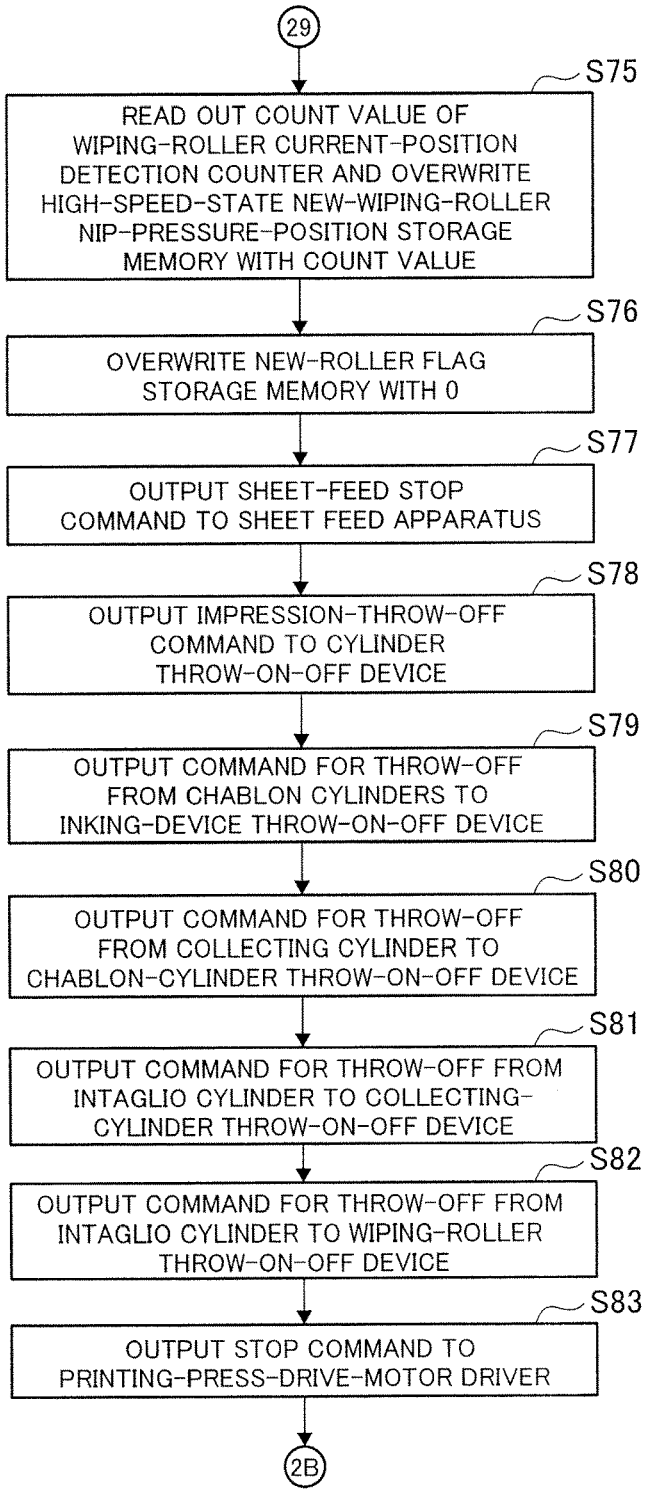
FIG. 8D is an operation flowchart mainly of the nip-pressure adjustment device of the intaglio printing press in the second embodiment of the present invention.
Figure 9A:
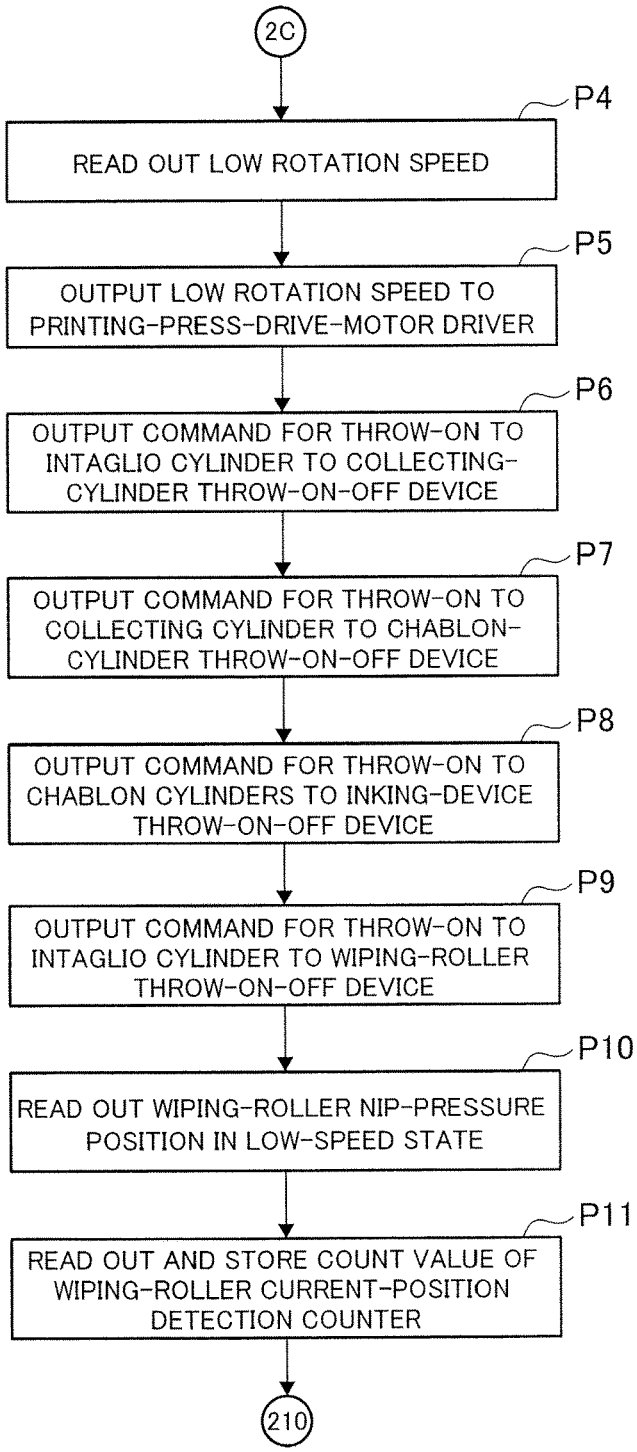
FIG. 9A is an operation flowchart mainly of the nip-pressure adjustment device of the intaglio printing press in the second embodiment of the present invention.
Figure 9B:
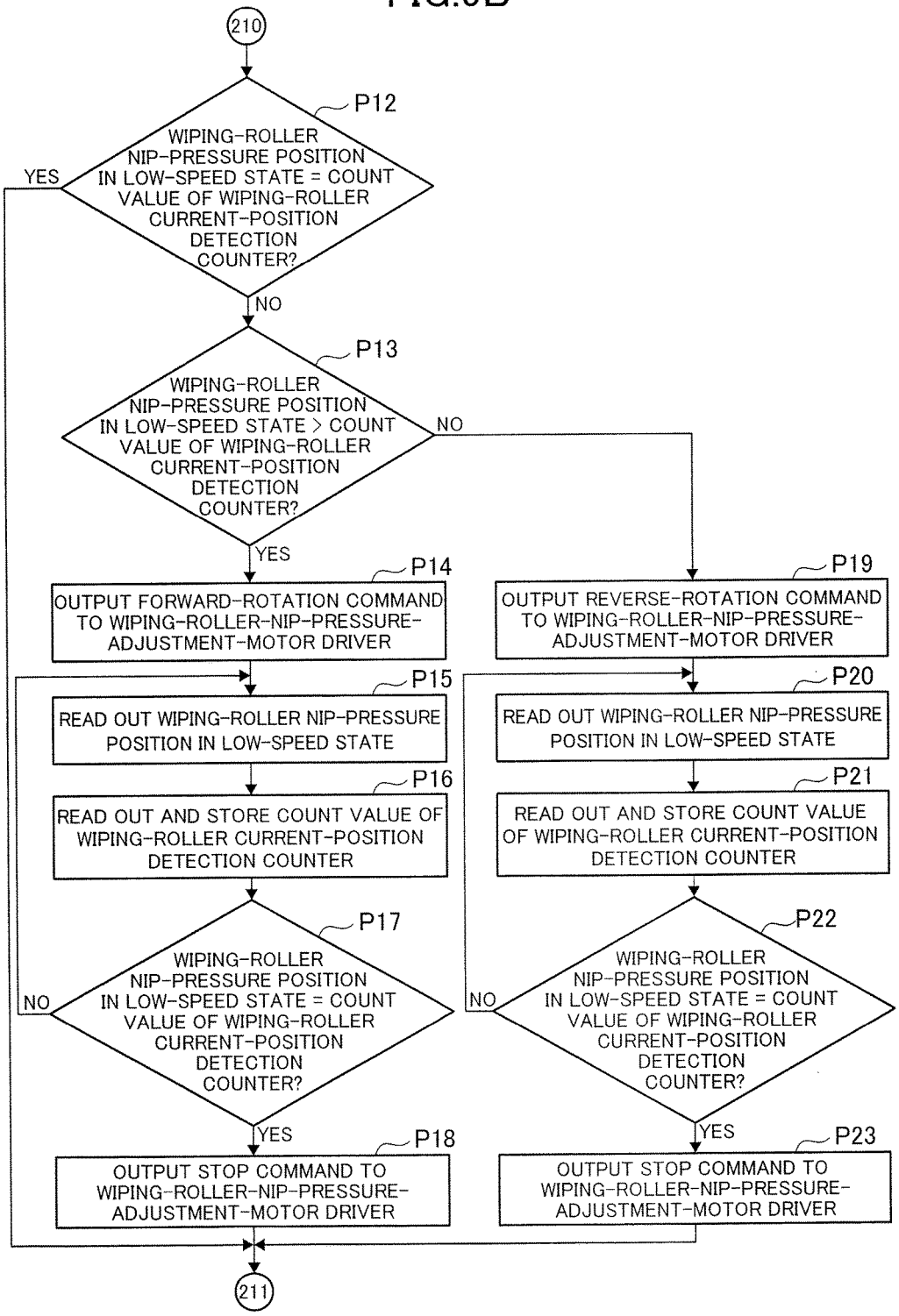
FIG. 9B is an operation flowchart mainly of the nip-pressure adjustment device of the intaglio printing press in the second embodiment of the present invention.
Figure 9C:
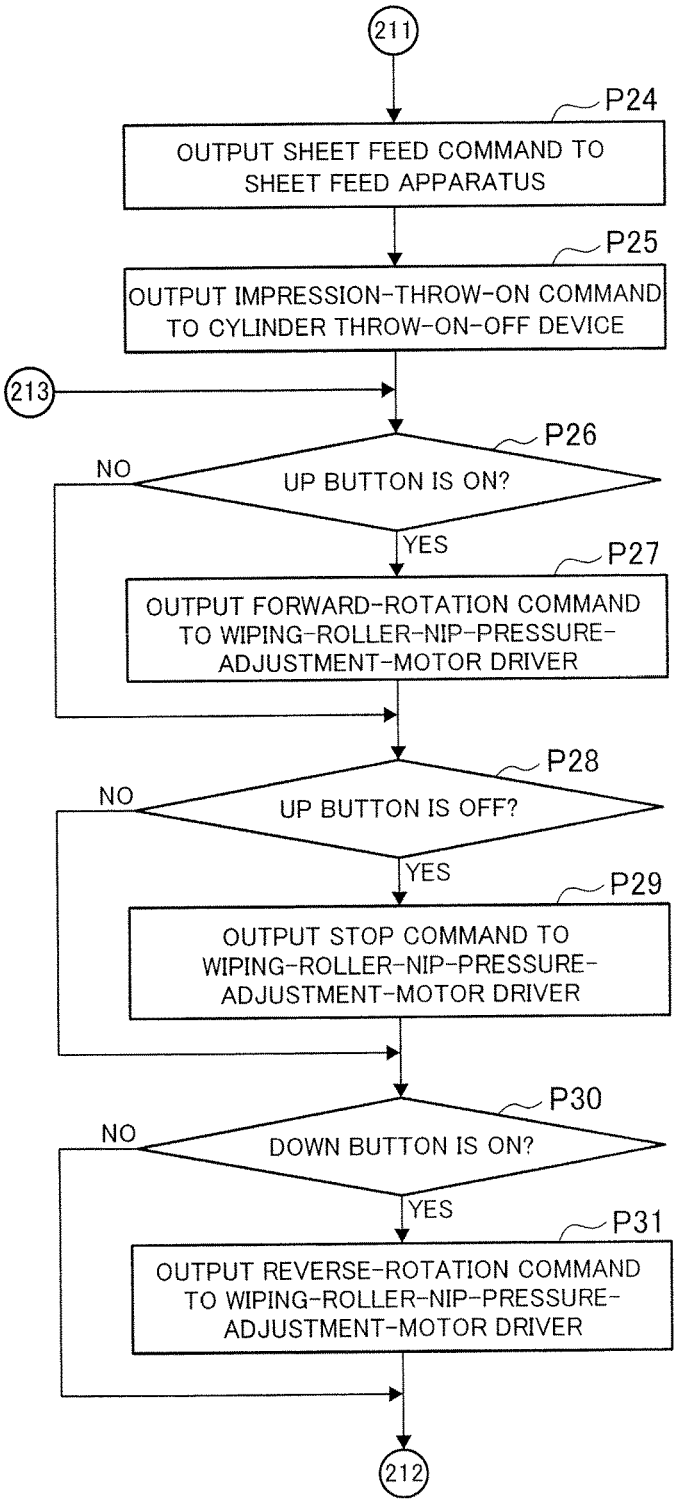
FIG. 9C is an operation flowchart mainly of the nip-pressure adjustment device of the intaglio printing press in the second embodiment of the present invention.
Figure 9D:
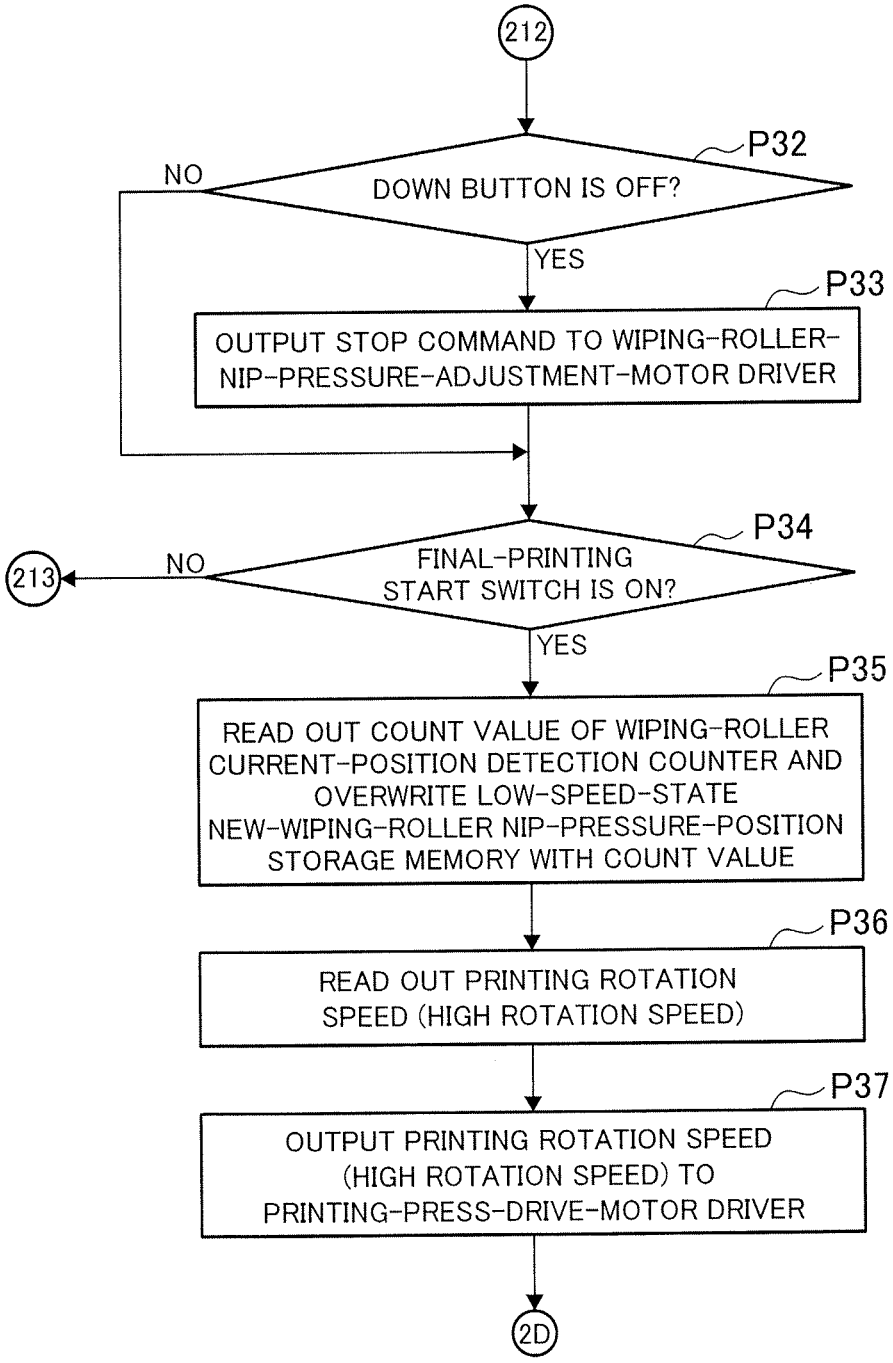
FIG. 9D is an operation flowchart mainly of the nip-pressure adjustment device of the intaglio printing press in the second embodiment of the present invention.
Figure 10A:
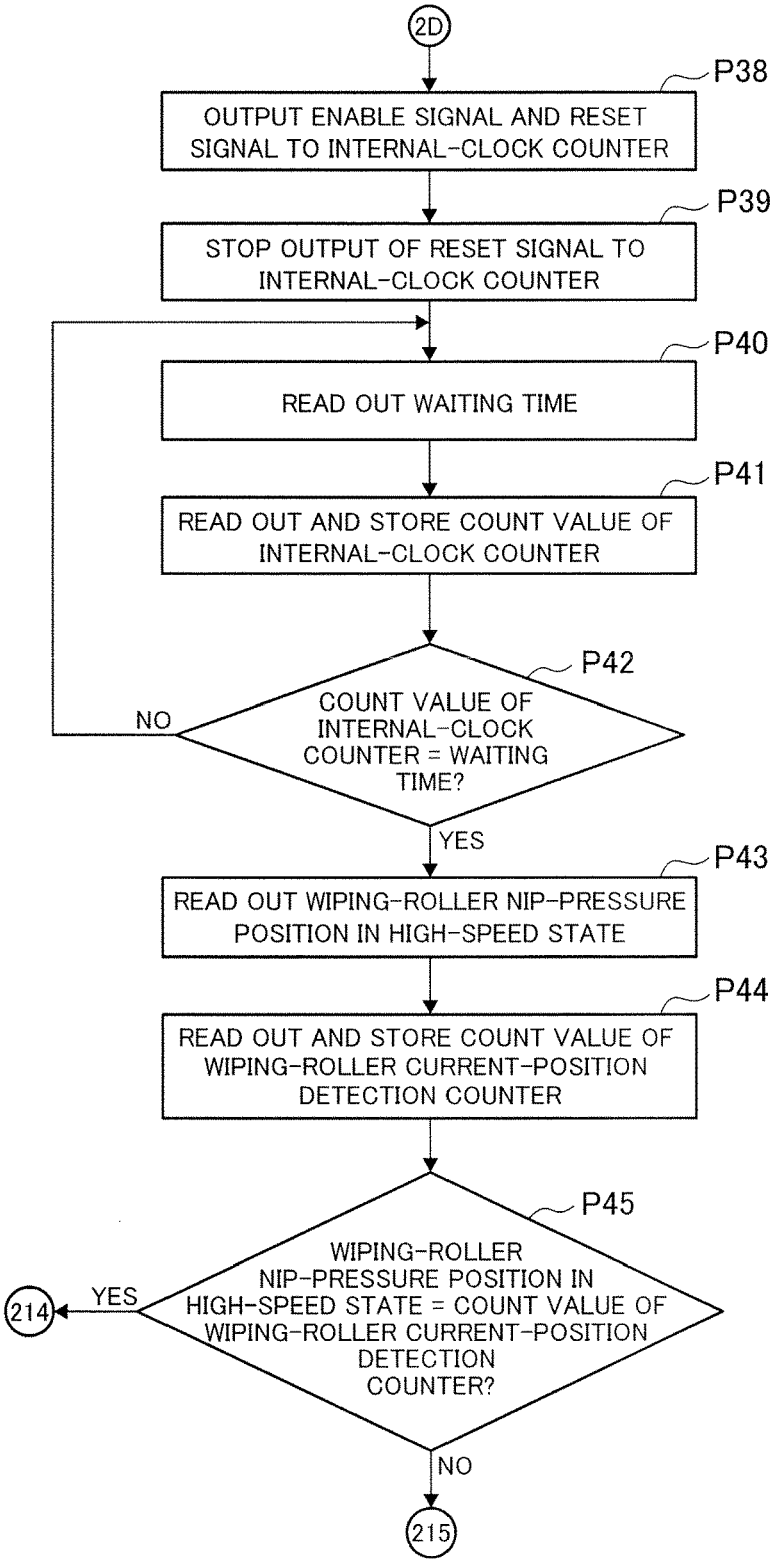
FIG. 10A is an operation flowchart mainly of the nip-pressure adjustment device of the intaglio printing press in the second embodiment of the present invention.
Figure 10B:
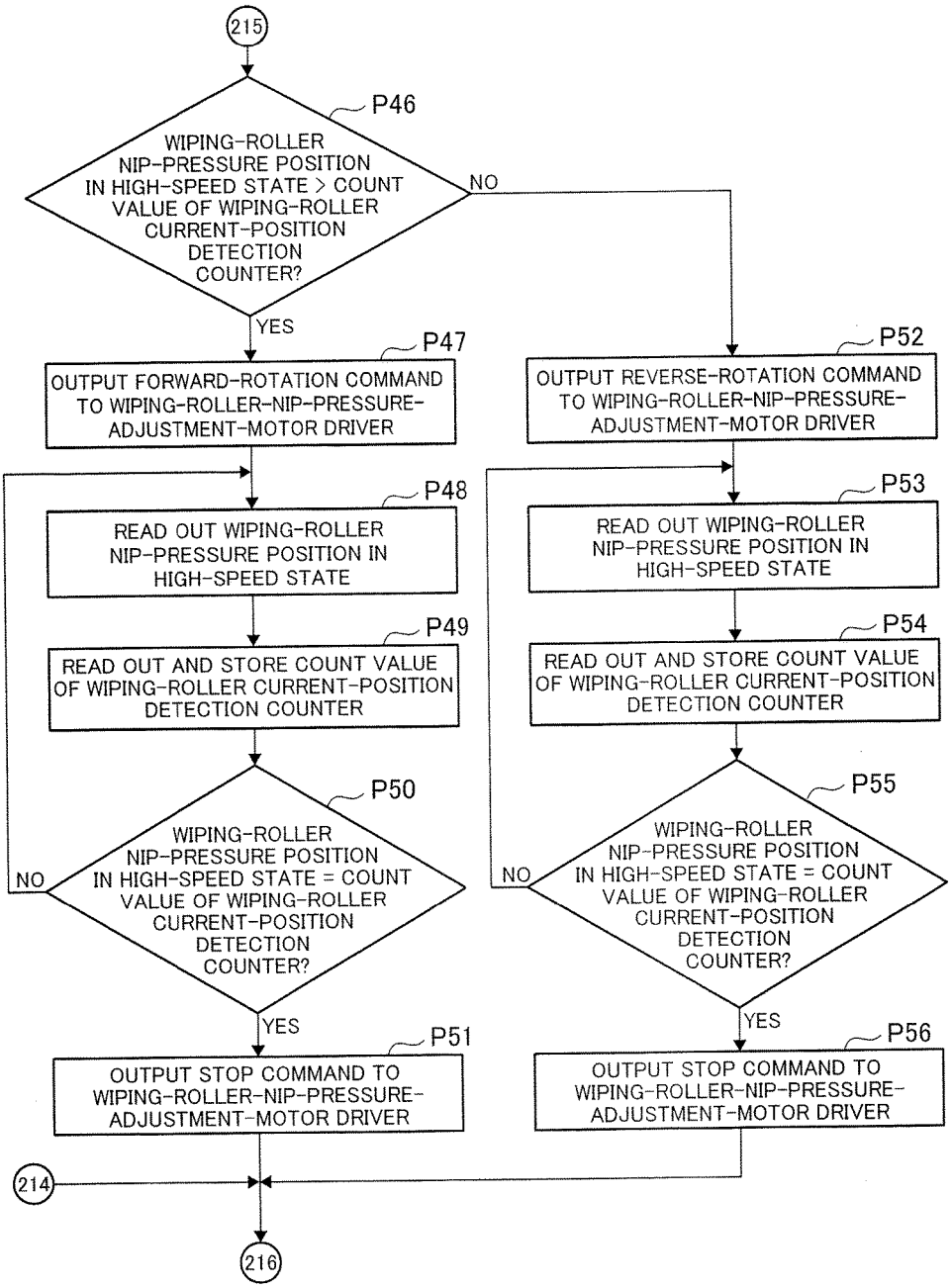
FIG. 10B is an operation flowchart mainly of the nip-pressure adjustment device of the intaglio printing press in the second embodiment of the present invention.
Figure 10C:
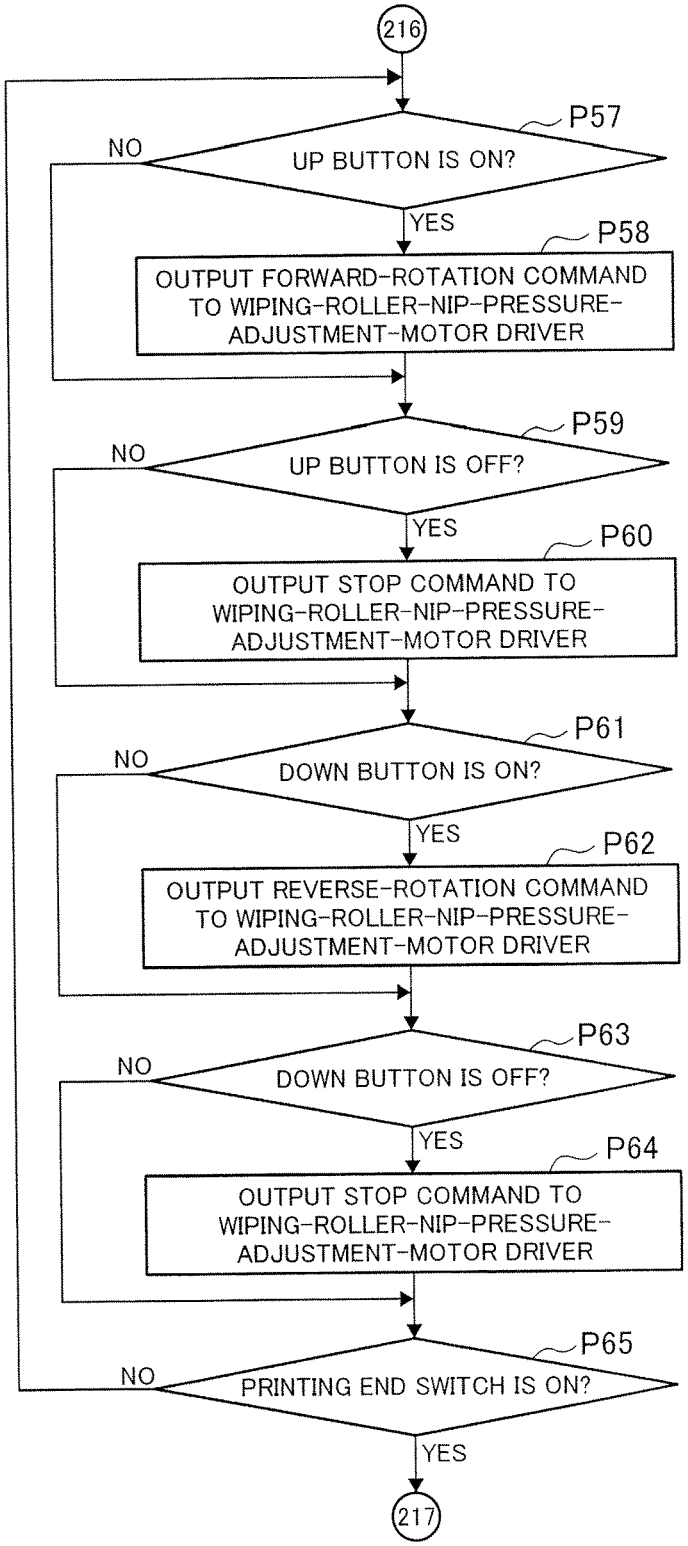
FIG. 10D is an operation flowchart mainly of the nip-pressure adjustment device of the intaglio printing press in the second embodiment of the present invention.
Figure 10D:
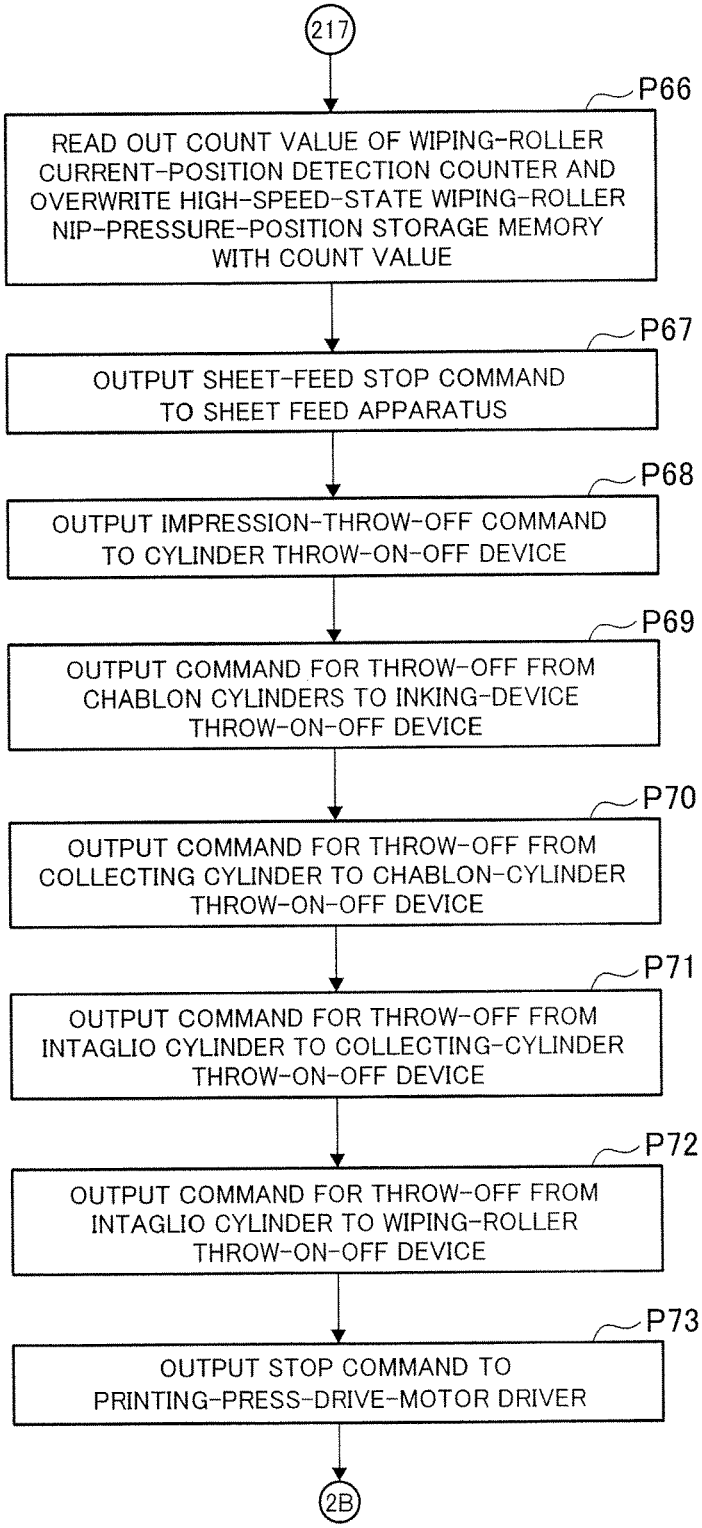

FIG. 1A to FIG. 1D and FIG. 2A to FIG. 2D are operation flowcharts mainly of a nip-pressure adjustment device of an intaglio printing press in a first embodiment of the present invention. FIG. 3A and FIG. 3B are hardware block diagrams mainly of the nip-pressure adjustment device of the intaglio printing press in the first embodiment of the present invention. FIG. 4 is a timing chart of a nip-pressure position and a printing speed. FIG. 5 is a side view of the nip-pressure adjustment device in a wiping device. FIG. 6 is an entire side view of the intaglio printing press.

As illustrated in FIG. 6, the intaglio printing press, which is the final printing press for a plurality of printing steps for printing not only images in general but also numbers and seals, mainly includes a sheet feed apparatus 10, a printing apparatus 20, and a delivery apparatus 30. A feedboard 11 communicates with the sheet feed apparatus 10, in which paper sheets (sheet-shaped objects) W are piled, the feedboard 11 being configured to receive paper sheets W fed one by one from the top by a sucker mechanism of the sheet feed apparatus 10 and register them for printing.

At a tip portion of the feedboard 11 of the intaglio printing press, a swing device 12 is arranged which is configured to grip and swing the paper sheet W on the feedboard 11. At the printing apparatus 20, an impression cylinder 21 communicates with the swing device 12 via a transfer cylinder 22, the impression cylinder 21 being a so-called triple-size cylinder on which three grippers are arranged at equal intervals in the circumferential direction and to which three rubber blankets can thus be attached. The transfer cylinder 22 is provided with grippers similar to the above-mentioned grippers of the impression cylinder 21, and is capable of changing the grip on the paper sheet W from the swing device 12 to the grippers of the impression cylinder 21. An intaglio cylinder 23, which is a so-called triple-size cylinder to which three intaglio printing plates can be attached along the circumferential direction, faces and contacts the impression cylinder 21.

A collecting cylinder (ink-collecting cylinder) 24, which is a so-called quadruple-size cylinder to which four rubber blankets can be attached along the circumferential direction, faces and contacts the intaglio printing plates of the intaglio cylinder 23. Five chablon cylinders 25, each of which is a so-called single-size cylinder with a peripheral surface length corresponding to the length of each blanket of the impression cylinder 21 and the length of each intaglio printing plate of the intaglio cylinder 23, lie side by side in the circumferential direction and face and contact the collecting cylinder 24.

Inking devices 26 configured to feed inks face and contact these chablon cylinders 25, respectively. Inks of mutually different colors are filled in these inking devices 26, respectively. A wiping roller 27 faces and contacts the intaglio printing plates of the intaglio cylinder 23. This wiping roller 27 is dipped in a wiping tank 28 containing cleaning solvent.

At the delivery apparatus 30, a delivery cylinder 31 faces and contacts the impression cylinder 21. Moreover, a delivery chain 33 is endlessly wound between a pair of sprockets not illustrated that are provided coaxially on the delivery cylinder 31 and a pair of sprockets 32 that are disposed at the rearmost part of the delivery apparatus 30. The delivery chain is provided with delivery grippers not illustrated. A plurality of delivery boards 34 are provided on a downstream side in the direction of running of the delivery chain 33. Thus, as paper sheets W are fed one by one from the sheet feed apparatus 10 onto the feedboard 11, each of these paper sheets W is passed by the swing device 12 to the transfer cylinder 22, and then its grip is changed from the grippers of the transfer cylinder 22 to the grippers of the impression cylinder 21, and the paper sheet W is passed to the impression cylinder 21.

On the other hand, the inks in the inking devices 26 are transferred onto the collecting cylinder 24 via the chablon cylinders 25 and fed onto the surfaces of the intaglio printing plates of the intaglio cylinder 23. Excess portions of these inks are removed by the wiping roller 27. Then, when facing and contacting the impression cylinder 21, the inks are transferred and printed onto the paper sheet W held on the impression cylinder 21. Note that the excess portions of the inks removed by the wiping roller 27 are washed off and removed from the wiping roller 27 inside the wiping tank 28 by the wiping liquid.

As illustrated in FIG. 5, at a wiping device 40, the wiping roller 27 is rotatably supported by the inner hole of an eccentric bearing 41. The wiping roller 27 is thrown onto and off the intaglio cylinder 23 when a metal fitting 42 fixed to an outer peripheral side of the eccentric bearing 41 is moved forward and backward.

Specifically, the tip of the piston rod of a wiping-roller throw-on-off hydraulic cylinder 43 is rotatably attached to the metal fitting 42 with a pin 44, whereas a screw shaft 46 is coupled to the head side via a thrust bearing 45. The thrust bearing 45 transmits axial movement of the screw shaft 46 to the wiping-roller throw-on-off hydraulic cylinder 43 but does not transmit rotation of the screw shaft 46 to the wiping-roller throw-on-off hydraulic cylinder 43. This screw shaft 46 is screwed in a screw bearing 48 fixed to the wiping tank 28.

A wiping-roller nip-pressure adjustment motor 50 is fixed to a bracket 49 incorporating the thrust bearing 45. A gear 52 fixed to a motor shaft 51 of the wiping-roller nip-pressure adjustment motor 50 are in mesh with a gear 53 fixed to the screw shaft 46. On the other hand, the wiping-roller throw-on-off hydraulic cylinder 43 is equipped with a detection target 54, and a linear potentiometer 55 is provided to detect the position of this detection target 54.

Thus, the wiping roller 27 comes into contact with the intaglio cylinder 23 when the wiping-roller throw-on-off hydraulic cylinder 43 is actuated to extend, whereas the wiping roller 27 comes out of contact with the intaglio cylinder 23 when the wiping-roller throw-on-off hydraulic cylinder 43 is actuated to contract. Also, upon rotation of the wiping-roller nip-pressure adjustment motor 50 with the wiping roller 27 and the intaglio cylinder 23 in contact with each other, the screw shaft 46 rotates and moves axially, so that the wiping-roller throw-on-off hydraulic cylinder 43 also moves accordingly. Hence, the contact pressure (nip pressure) of the wiping roller 27 on the intaglio cylinder 23 can be adjusted.

Specifically, a nip-pressure adjustment device 60 includes components such as the wiping-roller throw-on-off hydraulic cylinder 43, the screw shaft 46, and the nip-pressure adjustment motor 50, and is also constructed of hardware illustrated in FIG. 3A and FIG. 3B, as will be described later.

Here, the position of the wiping roller 27 relative to the intaglio cylinder 23 for the nip-pressure adjustment (hereinafter, referred to as the nip-pressure position) is measured by a wiping-roller-nip-pressure-adjustment-motor rotary encoder 75 incorporated in the nip-pressure adjustment motor 50 and detected by a wiping-roller current-position detection counter 74, as illustrated in FIG. 3.

Note that FIG. 5 illustrates the left side (work side) of the wiping roller 27, but the devices with the same configurations as those described above are mounted on the right side (drive side) of the wiping roller 27 as well.

As illustrated in FIG. 3A and FIG. 3B, the nip-pressure adjustment device 60 of the intaglio printing press includes a CPU 100, a ROM 101, and a RAM 102, as well as input-output devices (I/O) 103 to 112 and an internal-clock counter 76, which are connected by a bus.

To this bus are connected a low-speed-state wiping-roller nip-pressure-position initial-value storage memory M100, a low-speed-state wiping-roller nip-pressure-position storage memory M101 (first memory), a high-speed-state wiping-roller nip-pressure-position initial-value storage memory M102, a high-speed-state wiping-roller nip-pressure-position storage memory M103 (second memory), a low-rotation-speed storage memory M104, a wiping-roller-current-position-detection-counter count-value storage memory M105, a printing-rotation-speed (high-rotation-speed) storage memory M106, a waiting-time storage memory M107, and an internal-clock-counter count-value storage memory M108.

Further, to the input-output device 103 are connected a printing preparation switch 61, a final-printing start switch 62, a printing end switch 63, an up button 64, a down button 65, an input device 66, a display 67, and an output device 68 such as a floppy (registered trademark) disk drive and a printer.

Further, a printing-press drive motor 71 is connected to the input-output device 104 via a D-A converter 69 and a printing-press-drive-motor driver 70. Moreover, a drive-motor rotary encoder 72 coupled to and driven by the drive motor 71 is connected to the drive-motor driver 70.

Further, the wiping-roller nip-pressure adjustment motor is connected to the input-output device 111 via a wiping-roller-nip-pressure-adjustment-motor driver 73, and a forward-rotation command or a reverse-rotation command is outputted to the motor driver 73. Moreover, the wiping-roller-nip-pressure-adjustment-motor rotary encoder 75, which is coupled to and driven by the nip-pressure adjustment motor 50, is connected to the wiping-roller current-position detection counter 74.

Further, an inking-device throw-on-off device 81 is connected to the input-output device 105, a chablon-cylinder throw-on-off device 82 is connected to the input-output device 106, a collecting-cylinder throw-on-off device 83 is connected to the input-output device 107, a wiping-roller throw-on-off device 84 is connected to the input-output device 108, a cylinder throw-on-off device 85 is connected to the input-output device 109, and the sheet feed apparatus 10 is connected to the input-output device 110.

The operation of the above-mentioned wiping-roller nip-pressure adjustment device 60 will be described below along the operation flowcharts illustrated in FIG. 1A to FIG. 1D and FIG. 2A to FIG. 2D.

Specifically, in Step P1, an initial value of the wiping-roller nip-pressure position in a low-speed state in the low-speed-state wiping-roller nip-pressure-position initial-value storage memory M100 is read out as a counter count value, and the low-speed-state wiping-roller nip-pressure-position storage memory M101 is overwritten with the initial value.

Then in Step P2, an initial value of the wiping-roller nip-pressure position in a high-speed state in the high-speed-state wiping-roller nip-pressure-position initial-value storage memory M102 is read out as a counter count value, and the high-speed-state wiping-roller nip-pressure-position storage memory M103 is overwritten with the initial value.

Then in Step P3, it is determined whether or not the printing preparation switch 61 is on. If not (NO), Step P3 is repeated, but if so (YES), a low rotation speed in the low-rotation-speed storage memory M104 is read out in Step P4, and the low rotation speed is outputted to the printing-press-drive-motor driver 70 via the D-A converter 69 in Step P5. The drive-motor driver 70 controls the printing-press drive motor 71 at the low rotation speed.

Then in Step P6, a command for throw-on to the intaglio cylinder 23 is outputted to the collecting-cylinder throw-on-off device 83. Based on the throw-on command, the collecting-cylinder throw-on-off device 83 brings the collecting cylinder 24 into contact with the intaglio cylinder 23, that is, throws the collecting cylinder 24 onto the intaglio cylinder 23.

Then in Step P7, a command for throw-on to the collecting cylinder 24 is outputted to the chablon-cylinder throw-on-off device 82. Based on the throw-on command, the chablon-cylinder throw-on-off device 82 brings the chablon cylinders 25 into contact with the collecting cylinder 24, that is, throws the chablon cylinders 25 onto the collecting cylinder 24.

Then in Step P8, a command for throw-on to the chablon cylinders 25 is outputted to the inking-device throw-on-off device 81. Based on the throw-on command, the inking-device throw-on-off device 81 brings the inking devices 26 into contact with the chablon cylinders 25, that is, throws the inking devices 26 onto the chablon cylinders 25.

Then in Step P9, a command for throw-on to the intaglio cylinder 23 is outputted to the wiping-roller throw-on-off device 84. Based on the throw-on command, the wiping-roller throw-on-off hydraulic cylinder 43, which is the wiping-roller throw-on-off device 84, is actuated to extend and bring the wiping roller 27 into contact with the intaglio cylinder 23, that is, throw the wiping roller 27 onto the intaglio cylinder 23.

Then in Step P10, the wiping-roller nip-pressure position in the low-speed state in the low-speed-state wiping-roller nip-pressure-position storage memory M101 is read out.

Then in Step P11, the count value of the wiping-roller current-position detection counter 74 is read out and stored in the wiping-roller-current-position-detection-counter count-value storage memory M105.

Then in Step P12, it is determined whether or not the wiping-roller nip-pressure position in the low-speed state is equal to the count value of the wiping-roller current-position detection counter. If so, the operation proceeds to Step P24, but if not, it is determined in Step P13 whether or not the wiping-roller nip-pressure position in the low-speed state is greater than the count value of the wiping-roller current-position detection counter.

Then, if so in Step P13, a forward-rotation command is outputted to the wiping-roller-nip-pressure-adjustment-motor driver 73 in Step P14. Based on the forward-rotation command, the nip-pressure adjustment-motor driver 73 rotates the wiping-roller nip-pressure adjustment motor 50 to move the position of the wiping roller 27 relative to the intaglio cylinder 23 in a direction toward it, i.e. in such a direction as to increase the nip-pressure position.

Then in Step P15, the wiping-roller nip-pressure position in the low-speed state in the low-speed-state wiping-roller nip-pressure-position storage memory M101 is read out.

Then in Step P16, the count value of the wiping-roller current-position detection counter 74 is read out and stored in the wiping-roller-current-position-detection-counter count-value storage memory M105.

Then in Step P17, it is determined whether or not the wiping-roller nip-pressure position in the low-speed state is equal to the count value of the wiping-roller current-position detection counter. If not, the operation returns to Step P15, but if so, a stop command is outputted to the wiping-roller-nip-pressure-adjustment-motor driver 73 in Step P18, and the operation proceeds to Step P24. Based on the stop command, the nip-pressure-adjustment-motor driver 73 stops the wiping-roller nip-pressure adjustment motor 50.

On the other hand, if the wiping-roller nip-pressure position in the low-speed state is not greater than the count value of the wiping-roller current-position detection counter in Step P13, a reverse-rotation command is outputted to the wiping-roller-nip-pressure-adjustment-motor driver 73 in Step P19. Based on the reverse-rotation command, the nip-pressure-adjustment-motor driver 73 rotates the wiping-roller nip-pressure adjustment motor 50 to move the position of the wiping roller 27 relative to the intaglio cylinder 23 in a direction away from it, i.e. in such a direction as to reduce the nip-pressure position.

Then in Step P20, the wiping-roller nip-pressure position in the low-speed state in the low-speed-state wiping-roller nip-pressure-position storage memory M101 is read out.

Then in Step P21, the count value of the wiping-roller current-position detection counter 74 is read out and stored in the wiping-roller-current-position-detection-counter count-value storage memory M105.

Then in Step P22, it is determined whether or not the wiping-roller nip-pressure position in the low-speed state is equal to the count value of the wiping-roller current-position detection counter. If not, the operation returns to Step P20, but if so, a stop command is outputted to the wiping-roller-nip-pressure-adjustment-motor driver 73 in Step P23, and the operation proceeds to Step P24.

Then in Step P24, a sheet feed command is outputted to the sheet feed apparatus 10. Based on the sheet feed command, the sheet feed apparatus 10 feeds paper sheets W to the printing apparatus 20.

Then in Step P25, an impression-throw-on command is outputted to the cylinder throw-on-off device 85. Based on the impression-throw-on command, the cylinder throw-on-off device 85 engages the intaglio cylinder 23 with the impression cylinder 21.

Then in Step P26, it is determined whether or not the up button 64 is on. If not, the operation proceeds to Step P28, but if so, a forward-rotation command is outputted to the wiping-roller-nip-pressure-adjustment-motor driver 73 in Step P27. The operator operates the up button 64 when determining that the nip pressure between the intaglio cylinder and the wiping roller should be increased, by checking printing products printed in test printing in a printing preparation phase.

Then in Step P28, it is determined whether or not the up button 64 is off. If not, the operation proceeds to Step P30, but if so, a stop command is outputted to the wiping-roller-nip-pressure-adjustment-motor driver 73 in Step P29.

Then in Step P30, it is determined whether or not the down button 65 is on. If not, the operation proceeds to Step P32, but if so, a reverse-rotation command is outputted to the wiping-roller-nip-pressure-adjustment-motor driver 73 in Step P31. The operator operates the down button 65 when determining that the nip pressure between the intaglio cylinder and the wiping roller should be reduced, by checking printing products printed in the test printing in the printing preparation phase.

Then in Step P32, it is determined whether or not the down button 65 is off. If not, the operation proceeds to Step P34, but if so, a stop command is outputted to the wiping-roller-nip-pressure-adjustment-motor driver 73 in Step P33.

Then in Step P34, it is determined whether or not the final-printing start switch 62 is on. If not, the operation returns to Step P26, but if so, the count value of the wiping-roller current-position detection counter 74 is read out and the low-speed-state wiping-roller nip-pressure-position storage memory M101 is overwritten with the count value in Step P35.

Then in Step P36, a printing rotation speed (high rotation speed) in the printing-rotation-speed (high-rotation-speed) storage memory M106 is read out. In Step P37, the printing rotation speed (high rotation speed) is outputted to the printing-press-drive-motor driver 70 via the D-A converter 69. The drive-motor driver 70 controls the printing-press drive motor 71 at the printing rotation speed (high rotation speed).

Then in Step P38, an enable signal and a reset signal are outputted to the internal-clock counter 76. Then in Step P39, the output of the reset signal to the internal-clock counter 76 is stopped. The internal-clock counter 76 starts counting time when the output of the reset signal is stopped.

Then, a waiting time in the waiting-time storage memory M107 is read out in Step P40, and the count value of the internal-clock counter 76 is read out and stored in the internal-clock-counter count-value storage memory M108 in Step P41.

Then in Step P42, it is determined whether or not the count value of the internal-clock counter 76 is equal to the waiting time. If not, the operation returns to Step P40, but if so, the wiping-roller nip-pressure position in the high-speed state in the high-speed-state wiping-roller nip-pressure-position storage memory M103 is read out in Step P43.

Then in Step P44, the count value of the wiping-roller current-position detection counter 74 is read out and stored in the wiping-roller-current-position-detection-counter count-value storage memory M105.

Then in Step P45, it is determined whether or not the wiping-roller nip-pressure position in the high-speed state is equal to the count value of the wiping-roller current-position detection counter. If so, the operation proceeds to Step P57, but if not, it is determined in Step P46 whether or not the wiping-roller nip-pressure position in the high-speed state is greater than the count value of the wiping-roller current-position detection counter.

Then, if so in Step P46, a forward-rotation command is outputted to the wiping-roller-nip-pressure-adjustment-motor driver 73 in Step P47.

Then in Step P48, the wiping-roller nip-pressure position in the high-speed state in the high-speed-state wiping-roller nip-pressure-position storage memory M103 is read out.

Then in Step P49, the count value of the wiping-roller current-position detection counter 74 is read out and stored in the wiping-roller-current-position-detection-counter count-value storage memory M105.

Then in Step P50, it is determined whether or not the wiping-roller nip-pressure position in the high-speed state is equal to the count value of the wiping-roller current-position detection counter. If not, the operation returns to Step P48, but if so, a stop command is outputted to the wiping-roller-nip-pressure-adjustment-motor driver 73 in Step P51, and the operation proceeds to Step P57.

On the other hand, if the wiping-roller nip-pressure position in the high-speed state is not greater than the count value of the wiping-roller current-position detection counter in Step P46, a reverse-rotation command is outputted to the wiping-roller-nip-pressure-adjustment-motor driver 73 in Step P52.

Then in Step P53, the wiping-roller nip-pressure position in the high-speed state in the high-speed-state wiping-roller nip-pressure-position storage memory M103 is read out.

Then in Step P54, the count value of the wiping-roller current-position detection counter 74 is read out and stored in the wiping-roller-current-position-detection-counter count-value storage memory M105.

Then in Step P55, it is determined whether or not the wiping-roller nip-pressure position in the high-speed state is equal to the count value of the wiping-roller current-position detection counter. If not, the operation returns to Step P53, but if so, a stop command is outputted to the wiping-roller-nip-pressure-adjustment-motor driver 73 in Step P56, and the operation proceeds to Step P57.

Then in Step P57, it is determined whether or not the up button 64 is on. If not, the operation proceeds to Step P59, but if so, a forward-rotation command is outputted to the wiping-roller-nip-pressure-adjustment-motor driver 73 in Step P58. The operator operates the up button 64 when determining that the nip pressure between the intaglio cylinder and the wiping roller should be increased, by checking printing products printed in final printing.

Then in Step P59, it is determined whether or not the up button 64 is off. If not, the operation proceeds to Step P61, but if so, a stop command is outputted to the wiping-roller-nip-pressure-adjustment-motor driver 73 in Step P60.

Then in Step P61, it is determined whether or not the down button 65 is on. If not, the operation proceeds to Step P63, but if so, a reverse-rotation command is outputted to the wiping-roller-nip-pressure-adjustment-motor driver 73 in Step P62. The operator operates the down button 65 when determining that the nip pressure between the intaglio cylinder and the wiping roller should be reduced, by checking printing products printed in the final printing.

Then in Step P63, it is determined whether or not the down button 65 is off. If not, the operation proceeds to Step P65, but if so, a stop command is outputted to the wiping-roller-nip-pressure-adjustment-motor driver 73 in Step P64.

Then in Step P65, it is determined whether or not the printing end switch 63 is on. If not, the operation returns to Step P57, but if so, the count value of the wiping-roller current-position detection counter 74 is read out and the high-speed-state wiping-roller nip-pressure-position storage memory M103 is overwritten with the count value in Step P66.

Then in Step P67, a sheet-feed stop command is outputted to the sheet feed apparatus 10. Based on the sheet-feed stop command, the sheet feed apparatus 10 stops the feed of paper sheets W to the printing apparatus 20.

Then in Step P68, an impression-throw-off command is outputted to the cylinder throw-on-off device 85. Based on the impression-throw-off command, the cylinder throw-on-off device 85 disengages the intaglio cylinder 23 from the impression cylinder 21.

Then in Step P69, a command for throw-off from the chablon cylinders 25 is outputted to the inking-device throw-on-off device 81. Based on the throw-off command, the inking-device throw-on-off device 81 brings the inking devices 26 out of contact with the chablon cylinders 25, that is, throws the inking devices 26 off the chablon cylinders 25.

Then in Step P70, a command for throw-off from the collecting cylinder 24 is outputted to the chablon-cylinder throw-on-off device 82. Based on the throw-off command, the chablon-cylinder throw-on-off device 82 brings the chablon cylinders 25 out of contact with the collecting cylinder 24, that is, throws the chablon cylinders 25 off the collecting cylinder 24.

Then in Step P71, a command for throw-off from the intaglio cylinder 23 is outputted to the collecting-cylinder throw-on-off device 83. Based on the throw-off command, the collecting-cylinder throw-on-off device 83 brings the collecting cylinder 24 out of contact with the intaglio cylinder 23, that is, throws the collecting cylinder 24 off the intaglio cylinder 23.

Then in Step P72, a command for throw-off from the intaglio cylinder 23 is outputted to the wiping-roller throw-on-off device 84. Based on the throw-off command, the wiping-roller throw-on-off hydraulic cylinder 43, which is the wiping-roller throw-on-off device 84, is actuated to contract and bring the wiping roller 27 out of contact with the intaglio cylinder 23, that is, throw the wiping roller 27 off the intaglio cylinder 23.

Then in Step P73, a stop command is outputted to the printing-press-drive-motor driver 70, and the operation returns to Step P3.

The timing chart of the nip-pressure position and the printing speed illustrated in FIG. 4 will be described. FIG. 4 illustrates the nip-pressure position (broken line) and the printing speed (solid line) over a period of time involving transition from a last print job to the next print job. As illustrated in FIG. 4, each print job includes a printing preparation phase, in which test printing is performed at a low speed, and a final printing phase, in which final printing is performed thereafter with the speed raised to a printing speed.

As illustrated in FIG. 4, in the final printing phase for the last print job, the speed remains at the printing speed from a time 0 to a time t1, drops with time from the time t1, at which the printing end switch 63 is turned on, and reaches 0 at a time t3.

In the final printing phase, the printing speed is high, so that the wiping roller 27 is in a thermally expanded state due to the heat generated by the rotation of the printing apparatus 20. Thus, the wiping-roller nip-pressure position in the high-speed state stored as an initial value in the high-speed-state wiping-roller nip-pressure-position initial-value storage memory M102 is set as such a position that the wiping roller 27 is positioned relatively far from the intaglio cylinder 23, that is, the nip-pressure position is set as a low position (the time 0 to the time t1), as illustrated in FIG. 4.

Here, the time t1 is when the printing end switch 63 is turned on in Step P65, and the nip-pressure position has therefore already been adjusted by the operator's operation on the up button 64 and the down button 65 in the preceding Steps P57 to P64. Hence, the count value with which the high-speed-state wiping-roller nip-pressure-position storage memory M103 is overwritten in Step P66 after the time t1 is the nip-pressure position in the high-speed state after the adjustment by the operation on the up button 64 and the down button 65.

The count value with which the high-speed-state wiping-roller nip-pressure-position storage memory M103 is overwritten as described above will be used in the final printing phase for the next print job.

Meanwhile, before the time 0 in the last print job is its printing preparation phase, in which test printing is performed at the low speed, though it is omitted in FIG. 4.

Between the time t3 and a time t4 after the end of the last print job, the speed is 0, so that the printing apparatus 20 dissipates heat and the amount of thermal expansion of the wiping roller 27 decreases accordingly. The dimension of the wiping roller 27 therefore becomes close to the original dimension.

In the next print job, the speed rises to the low speed for the printing preparation phase from the time t4 to a time t5, remains at the low speed for the printing preparation phase from the time t5 to a time t6, rises to the printing speed for the final printing phase from the time t6 to a time t7, and remains at the printing speed for the final printing phase at and after the time t7.

The time t4 is when the printing preparation switch 61 is turned on in Step P3 and the printing preparation phase thus starts. Here, until the speed reaches the printing speed for the final printing phase, the rotation of the printing apparatus 20 does not generate much heat and therefore the wiping roller 27 is in a hardly thermally expanded state.

For this reason, the wiping-roller nip-pressure position in the low-speed state stored as an initial value in the low-speed-state wiping-roller nip-pressure-position initial-value storage memory M100 is set as such a position that the wiping roller 27 is positioned relatively close to the intaglio cylinder 23, that is, the nip-pressure position is set as a high position (the time t5 to a time t8), as illustrated in FIG. 4. Then, the wiping roller 27 is automatically moved to the stored nip-pressure position in the low-speed state in Steps P14 to P23.

Further, the time t6 is when the final-printing start switch 62 is turned on in Step P34, and the nip-pressure position in the low-speed state has therefore already been adjusted by the operator's operation on the up button 64 and the down button 65 in the preceding Steps P26 to P33. Hence, the count value with which the low-speed-state wiping-roller nip-pressure-position storage memory M101 is overwritten in Step P35 after the time t6 is the nip-pressure position in the low-speed state after the adjustment by the operation on the up button 64 and the down button 65.

The count value with which the low-speed-state wiping-roller nip-pressure-position storage memory M101 is overwritten as described above will be used in the printing preparation phase for the next print job.

Meanwhile, although the speed reaches the printing speed for the final printing phase at the time t7, there is a certain time lag before the wiping roller 27 reaches the thermally expanded state with the heat generated by the rotation of the printing apparatus 20. That is, the wiping roller 27 does not reach the thermally expanded state with the heat generated by the rotation of the printing apparatus 20 until a certain period of time elapses since the time t7, at which the speed reaches the high printing speed.

The waiting time is set in Step P40 for this reason. Specifically, when the final-printing start switch 62 is turned on in Step P34, the nip-pressure position of the wiping roller relative to the intaglio cylinder 23 is not adjusted immediately. Instead, the waiting time in waiting-time storage memory M107 is read out in Step P40 and, after the elapse of the waiting time, the nip-pressure position of the wiping roller 27 relative to the intaglio cylinder 23 is adjusted based on the count value with which the high-speed-state wiping-roller nip-pressure-position storage memory M103 has been overwritten, as illustrated in Steps P47 to P56.

Thus, in the next print job, at and after a time t9 at which the certain period of time elapses since the time t7, at which the speed reaches the high printing speed, the nip-pressure position of the wiping roller 27, which has reached the thermally expanded state, relative to the intaglio cylinder 23 is adjusted as appropriate.

As described above, in the present invention, the wiping-roller position in the low-speed state manually adjusted by the operator in Steps P26 to P33 is stored in Step P35 at the start of printing, and the wiping-roller position in the printing-speed state (high-speed state) manually adjusted by the operator in Steps P57 to P64 is automatically stored at the end of the printing; in the next printing, the wiping roller 27 is automatically moved to the stored wiping-roller position in the low-speed state in Steps P14 to P23 before the start of the printing, and the wiping roller 27 is automatically moved to the stored wiping-roller position in the high-speed state in Steps P47 to P56 upon elapse of the waiting time from the start of the printing to the start of the thermal expansion. In this way, the above-mentioned first problem is solved, which causes a heavy burden on the operator, produces a large amount of defective printing products, and wastes printing materials.

Moreover, the wiping-roller position in the low-speed state is automatically stored in Step P35 when the rotation speed of the printing press reaches the high speed at the start of the printing, and the wiping-roller position in the high-speed state is automatically stored in Step P66 when the printing press stops printing at the end of the printing. In this way, the operator no longer needs to manually control the position storing timing at each single occasion.

Embodiment 2

Figure 11A:
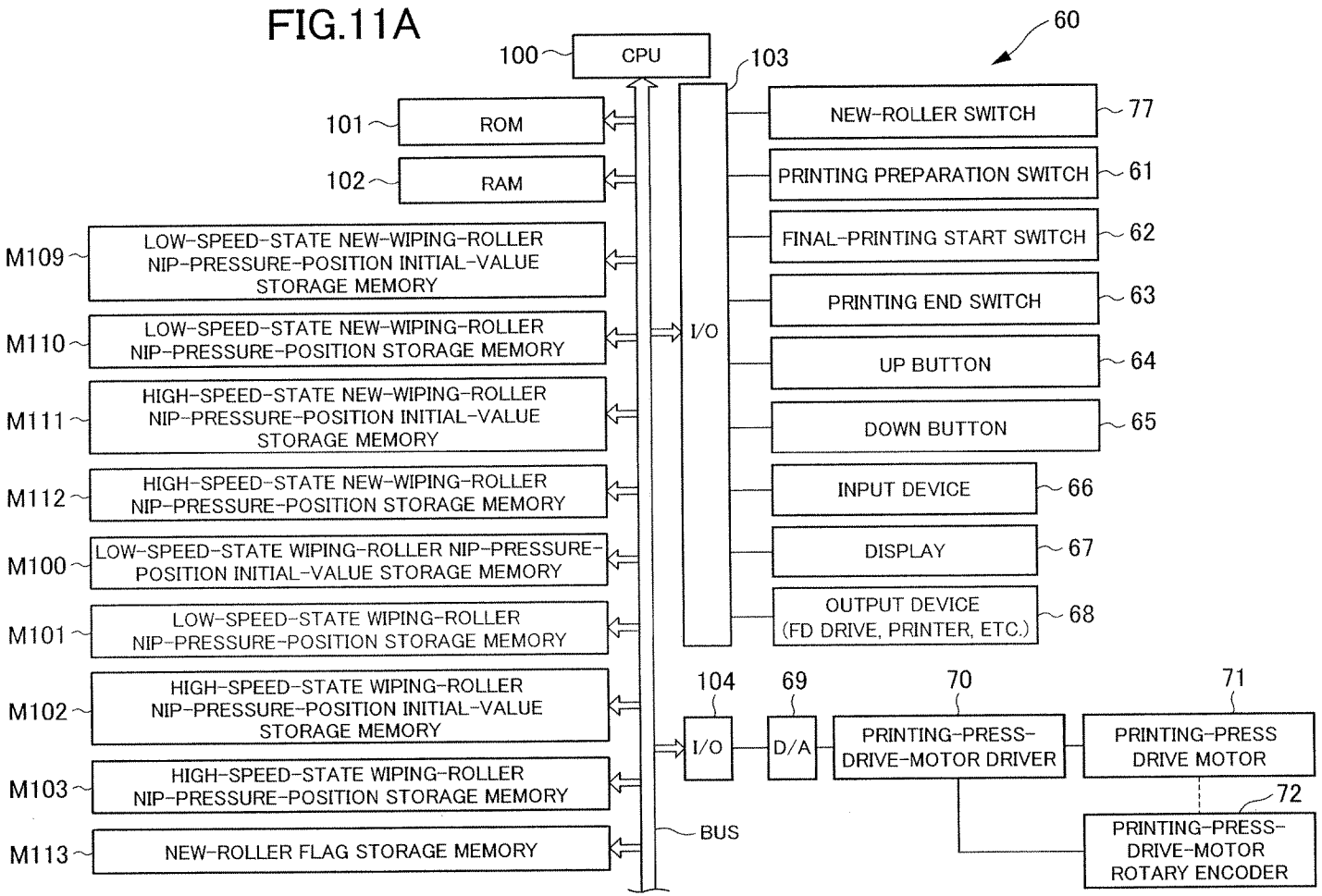
FIG. 11A is a hardware block diagram mainly of the nip-pressure adjustment device of the intaglio printing press in the second embodiment of the present invention.
Figure 11B:
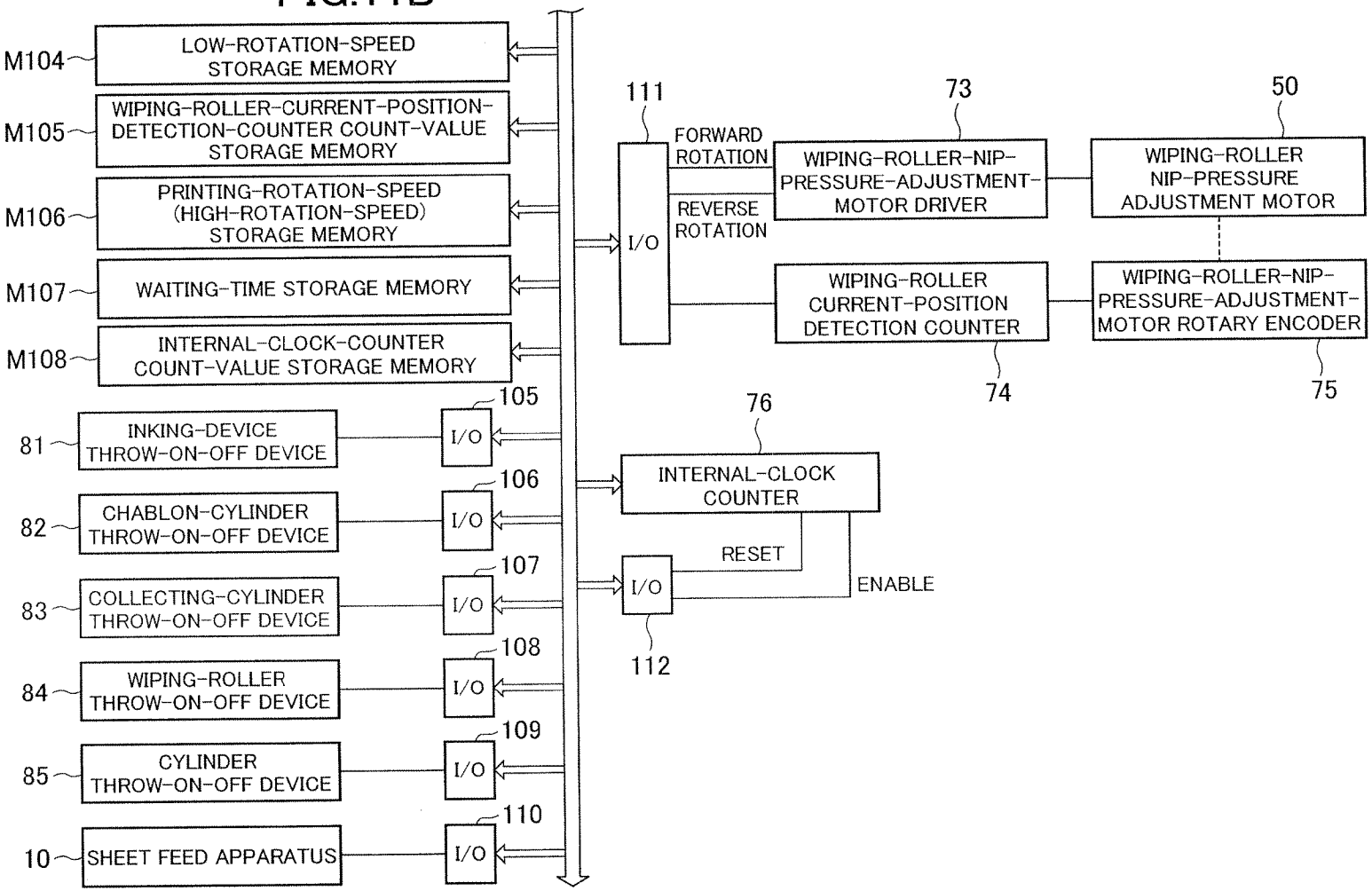
FIG. 11B is a hardware block diagram of the nip-pressure adjustment device of the intaglio printing press in the second embodiment of the present invention.

FIG. 7A to FIG. 7D, FIG. 8A to FIG. 8D, FIG. 9A to FIG. 9D, and FIG. 10A to FIG. 10D are operation flowcharts mainly of a nip-pressure adjustment device of an intaglio printing press in a second embodiment of the present invention. FIG. 11A and FIG. 11B are hardware block diagrams mainly of the nip-pressure adjustment device of the intaglio printing press in the second embodiment of the present invention. FIG. 4 is a timing chart of a nip-pressure position and a printing speed. FIG. 5 is a side view of the nip-pressure adjustment device in a wiping device. FIG. 6 is an entire side view of the intaglio printing press.

As illustrated in FIG. 6, the intaglio printing press, which is the final printing press for a plurality of printing steps of printing not only images in general but also numbers and seals, mainly includes a sheet feed apparatus 10, a printing apparatus 20, and a delivery apparatus 30. A feedboard 11 communicates with the sheet feed apparatus 10, in which paper sheets (sheet-shaped objects) W are piled, the feedboard 11 being configured to receive paper sheets W fed one by one from the top by a sucker mechanism of the sheet feed apparatus 10 and register them for printing.

At a tip portion of the feedboard 11 of the intaglio printing press, a swing device 12 is arranged which is configured to grip and swing the paper sheet W on the feedboard 11. At the printing apparatus 20, an impression cylinder 21 communicates with the swing device 12 via a transfer cylinder 22, the impression cylinder 21 being a so-called triple-size cylinder on which three grippers are arranged at equal intervals in the circumferential direction and to which three rubber blankets can thus be attached.

The transfer cylinder 22 is provided with grippers similar to the above-mentioned grippers of the impression cylinder 21, and is capable of changing the grip on the paper sheet W from the swing device 12 to the grippers of the impression cylinder 21.

An intaglio cylinder 23, which is a so-called triple-size cylinder to which three intaglio printing plates can be attached along the circumferential direction, faces and contacts the impression cylinder 21.

A collecting cylinder (ink-collecting cylinder) 24, which is a so-called quadruple-size cylinder to which four rubber blankets can be attached along the circumferential direction, faces and contacts the intaglio printing plates of the intaglio cylinder 23. Five chablon cylinders 25, each of which is a so-called single-size cylinder with a peripheral surface length corresponding to the length of each blanket of the impression cylinder 21 and the length of each intaglio printing plate of the intaglio cylinder 23, lie side by side in the circumferential direction and face and contact the collecting cylinder 24.

Inking devices 26 configured to feed inks face and contact these chablon cylinders 25, respectively. Inks of mutually different colors are filled in these inking devices 26, respectively. A wiping roller 27 faces and contacts the intaglio printing plates of the intaglio cylinder 23. This wiping roller 27 is dipped in a wiping tank 28 containing cleaning solvent.

At the delivery apparatus 30, a delivery cylinder 31 faces and contacts the impression cylinder 21. Moreover, a delivery chain 33 is endlessly wound between a pair of sprockets not illustrated that are provided coaxially on the delivery cylinder 31 and a pair of sprockets 32 that are disposed at the rearmost part of the delivery apparatus 30. The delivery chain 33 is provided with delivery grippers not illustrated. A plurality of delivery boards 34 are provided on a downstream side in the direction of running of the delivery chain 33. Thus, as paper sheets W are fed one by one from the sheet feed apparatus 10 onto the feedboard 11, each of these paper sheets W is passed by the swing device 12 to the transfer cylinder 22, and then its grip is changed from the grippers of the transfer cylinder 22 to the grippers of the impression cylinder 21, and the paper sheet W is passed to the impression cylinder 21.

On the other hand, the inks in the inking devices 26 are transferred onto the collecting cylinder 24 via the chablon cylinders 25 and fed onto the surfaces of the intaglio printing plates of the intaglio cylinder 23. Excess portions of these inks are removed by the wiping roller 27. Then, when facing and contacting the impression cylinder 21, the inks are transferred and printed onto the paper sheet W held on the impression cylinder 21. Note that the excess portions of the inks removed by the wiping roller 27 are washed off and removed from the wiping roller 27 inside the wiping tank 28 by the wiping liquid.

As illustrated in FIG. 5, at a wiping device 40, the wiping roller 27 is rotatably supported by the inner hole of an eccentric bearing 41. The wiping roller 27 is thrown onto and off the intaglio cylinder 23 when a metal fitting 42 fixed to an outer peripheral side of the eccentric bearing 41 is moved forward and backward.

Specifically, the tip of the piston rod of a wiping-roller throw-on-off hydraulic cylinder 43 is rotatably attached to the metal fitting 42 with a pin 44, whereas a screw shaft 46 is coupled to the head side via a thrust bearing 45. The thrust bearing 45 transmits axial movement of the screw shaft 46 to the wiping-roller throw-on-off hydraulic cylinder 43 but does not transmit rotation of the screw shaft 46 to the wiping-roller throw-on-off hydraulic cylinder 43. This screw shaft 46 is screwed in a screw bearing 48 fixed to the wiping tank 28.

A wiping-roller nip-pressure adjustment motor 50 is fixed to a bracket 49 incorporating the thrust bearing 45. A gear 52 fixed to a motor shaft 51 of the wiping-roller nip-pressure adjustment motor 50 are in mesh with a gear 53 fixed to the screw shaft 46. On the other hand, the wiping-roller throw-on-off hydraulic cylinder 43 is equipped with a detection target 54, and a linear potentiometer 55 is provided to detect the position of this detection target 54.

Thus, the wiping roller 27 comes into contact with the intaglio cylinder 23 when the wiping-roller throw-on-off hydraulic cylinder 43 is actuated to extend, whereas the wiping roller 27 moves away from the intaglio cylinder 23 when the wiping-roller throw-on-off hydraulic cylinder 43 is actuated to contract. Also, upon rotation of the wiping-roller nip-pressure adjustment motor 50 with the wiping roller 27 and the intaglio cylinder 23 in contact with each other, the screw shaft 46 rotates and moves axially, so that the wiping-roller throw-on-off hydraulic cylinder 43 also moves accordingly. Hence, the contact pressure (nip pressure) of the wiping roller 27 on the intaglio cylinder 23 can be adjusted.

Specifically, a nip-pressure adjustment device 60 includes components such as the wiping-roller throw-on-off hydraulic cylinder 43, the screw shaft 46, and the nip-pressure adjustment motor 50, and is also constructed of hardware illustrated in FIG. 11A and FIG. 11B, as will be described later.

Here, the position of the wiping roller 27 relative to the intaglio cylinder 23 for the nip-pressure adjustment (hereinafter, referred to as the nip-pressure position) is measured by a wiping-roller-nip-pressure-adjustment-motor rotary encoder 75 and detected by a wiping-roller current-position detection counter 74 incorporated in the nip-pressure adjustment motor 50, as illustrated in FIG. 11.

Note that FIG. 5 illustrates the left side (work side) of the wiping roller 27, but the devices with the same configurations as those described above are mounted on the right side (drive side) of the wiping roller 27 as well.

As illustrated in FIG. 11A and FIG. 11B, the nip-pressure adjustment device 60 of the intaglio printing press includes a CPU 100, a ROM 101, and a RAM 102, as well as input-output devices (I/O) 103 to 112 and an internal-clock counter 76, which are connected by a bus.

To this bus are connected a low-speed-state wiping-roller nip-pressure-position initial-value storage memory M100, a low-speed-state wiping-roller nip-pressure-position storage memory M101 (first memory), a high-speed-state wiping-roller nip-pressure-position initial-value storage memory M102, a high-speed-state wiping-roller nip-pressure-position storage memory M103 (second memory), a low-rotation-speed storage memory M104, a wiping-roller-current-position-detection-counter count-value storage memory M105, a printing-rotation-speed (high-rotation-speed) storage memory M106, a waiting-time storage memory M107, an internal-clock-counter count-value storage memory M108, a low-speed-state new-wiping-roller nip-pressure-position initial-value storage memory M109, a low-speed-state new-wiping-roller nip-pressure-position storage memory M110 (third memory), a high-speed-state new-wiping-roller nip-pressure-position initial-value storage memory M111, a high-speed-state new-wiping-roller nip-pressure-position storage memory M112 (fourth memory), and a new-roller flag storage memory M113.

Further, to the input-output device 103 are connected a printing preparation switch 61, a final-printing start switch 62, a printing end switch 63, an up button 64, a down button 65, an input device 66, a display 67, an output device 68 such as a floppy (registered trademark) disk drive and a printer, and a new-roller switch 77.

Further, a printing-press drive motor 71 is connected to the input-output device 104 via a D-A converter 69 and a printing-press-drive-motor driver 70. Moreover, a drive-motor rotary encoder 72 coupled to and driven by the drive motor 71 is connected to the drive-motor driver 70.

Further, the wiping-roller nip-pressure adjustment motor is connected to the input-output device 111 via a wiping-roller-nip-pressure-adjustment-motor driver 73, and a forward-rotation command or a reverse-rotation command is outputted to the motor driver 73. Moreover, the wiping-roller-nip-pressure-adjustment-motor rotary encoder 75, which is coupled to and driven by the nip-pressure adjustment motor 50, is connected to the wiping-roller current-position detection counter 74.

Further, an inking-device throw-on-off device 81 is connected to the input-output device 105, a chablon-cylinder throw-on-off device 82 is connected to the input-output device 106, a collecting-cylinder throw-on-off device 83 is connected to the input-output device 107, a wiping-roller throw-on-off device 84 is connected to the input-output device 108, a cylinder throw-on-off device 85 is connected to the input-output device 109, and the sheet feed apparatus 10 is connected to the input-output device 110.

The operation of the above-mentioned wiping-roller nip-pressure adjustment device 60 will be described below along the operation flowcharts illustrated in FIG. 7A to FIG. 7D, FIG. 8A to FIG. 8D, FIG. 9A to FIG. 9D, and FIG. 10A to FIG. 10D.

Specifically, in Step S1, an initial value of the new-wiping-roller nip-pressure position in a low-speed state in the low-speed-state new-wiping-roller nip-pressure-position initial-value storage memory M109 is read out as a counter count value, and the low-speed-state new-wiping-roller nip-pressure-position storage memory M110 is overwritten with the initial value.

Then in Step S2, an initial value of the new-wiping-roller nip-pressure position in a high-speed state in the high-speed-state new-wiping-roller nip-pressure-position initial-value storage memory M111 is read out as a counter count value, and the high-speed-state new-wiping-roller nip-pressure-position storage memory M112 is overwritten with the initial value.

Then in Step S3, an initial value of the new-wiping-roller nip-pressure position in the low-speed state in the low-speed-state wiping-roller nip-pressure-position initial-value storage memory M100 is read out as a counter count value, and the low-speed-state wiping-roller nip-pressure-position storage memory M101 is overwritten with the initial value.

Then in Step S4, an initial value of the new-wiping-roller nip-pressure position in the high-speed state in the high-speed-state wiping-roller nip-pressure-position initial-value storage memory M102 is read out as a counter count value, and the high-speed-state wiping-roller nip-pressure-position storage memory M103 is overwritten with the initial value.

Then in Step S5, it is determined whether or not the new-roller switch 77 is on. If not (NO), the operation proceeds to Step S10, but if so (YES), a new-roller flag in the new-roller flag storage memory M113 is read out in Step S6. The operator turns on the new-roller switch 77 when the wiping roller 27 is replaced with a new roller; otherwise the operator turns off the new-roller switch 77.

Then in Step S7, it is determined whether or not the new-roller flag is equal to 0. If so, the new-roller flag storage memory M113 is overwritten with 1 in Step S8, but if not, the new-roller flag storage memory M113 is overwritten with 0 in Step S9. When the new-roller flag is 1, it means that the wiping roller 27 has been replaced with a new roller. When the new-roller flag is 0, it means that the wiping roller 27 has not been replaced with a new roller, that is, the wiping roller 27 is still a used roller.

Then in Step S10, it is determined whether or not the printing preparation switch 61 is on. If not, the operation returns to Step S5, but if so, the new-roller flag in the new-roller flag storage memory M113 is read out in Step S11.

Then in Step S12, it is determined whether or not the new-roller flag is equal to 1. If not, that is, if the wiping roller 27 is a used roller, the operation proceeds to Step P4. If so, that is, the wiping roller 27 is a new roller, the operation proceeds to Step S13.

Then in Step S13, a low rotation speed in the low-rotation-speed storage memory M104 is read out, and the low rotation speed is outputted to the printing-press-drive-motor driver 70 via the D-A converter 69 in Step S14. The drive-motor driver 70 controls the printing-press drive motor 71 at the low rotation speed.

Then in Step S15, a command for throw-on to the intaglio cylinder 23 is outputted to the collecting-cylinder throw-on-off device 83. Based on the throw-on command, the collecting-cylinder throw-on-off device 83 brings the collecting cylinder 24 into contact with the intaglio cylinder 23, that is, throws the collecting cylinder 24 onto the intaglio cylinder 23.

Then in Step S16, a command for throw-on to the collecting cylinder 24 is outputted to the chablon-cylinder throw-on-off device 82. Based on the throw-on command, the chablon-cylinder throw-on-off device 82 brings the chablon cylinders 25 into contact with the collecting cylinder 24, that is, throws the chablon cylinders 25 onto the collecting cylinder 24.

Then in Step S17, a command for throw-on to the chablon cylinders 25 is outputted to the inking-device throw-on-off device 81. Based on the throw-on command, the inking-device throw-on-off device 81 brings the inking devices 26 into contact with the chablon cylinders 25, that is, throws the inking devices 26 onto the chablon cylinders 25.

Then in Step S18, a command for throw-on to the intaglio cylinder 23 is outputted to the wiping-roller throw-on-off device 84. Based on the throw-on command, the wiping-roller throw-on-off hydraulic cylinder 43, which is the wiping-roller throw-on-off device 84, is actuated to extend and bring the wiping roller 27 into contact with the intaglio cylinder 23, that is, throw the wiping roller 27 onto the intaglio cylinder 23.

Then in Step S19, the new-wiping-roller nip-pressure position in the low-speed state in the low-speed-state new-wiping-roller nip-pressure-position storage memory M110 is read out.

Then in Step S20, the count value of the wiping-roller current-position detection counter 74 is read out and stored in the wiping-roller-current-position-detection-counter count-value storage memory M105.

Then in Step S21, it is determined whether or not the new-wiping-roller nip-pressure position in the low-speed state is equal to the count value of the wiping-roller current-position detection counter. If so, the operation proceeds to Step S33, but if not, it is determined in Step S22 whether or not the new-wiping-roller nip-pressure position in the low-speed state is greater than the count value of the wiping-roller current-position detection counter.

Then, if so in Step S22, a forward-rotation command is outputted to the wiping-roller-nip-pressure-adjustment-motor driver 73 in Step S23. Based on the forward-rotation command, the nip-pressure adjustment-motor driver 73 rotates the wiping-roller nip-pressure adjustment motor 50 to move the position of the wiping roller 27 relative to the intaglio cylinder 23 in a direction toward it, i.e. in such a direction as to increase the nip-pressure position.

Then in Step S24, the new-wiping-roller nip-pressure position in the low-speed state in the low-speed-state new-wiping-roller nip-pressure-position storage memory M110 is read out.

The in Step S25, the count value of the wiping-roller current-position detection counter 74 is read out and stored in the wiping-roller-current-position-detection-counter count-value storage memory M105.

Then in Step S26, it is determined whether or not the new-wiping-roller nip-pressure position in the low-speed state is equal to the count value of the wiping-roller current-position detection counter. If not, the operation returns to Step S24, but if so, a stop command is outputted to the wiping-roller-nip-pressure-adjustment-motor driver 73 in Step S27, and the operation proceeds to Step S33. Based on the stop command, the nip-pressure-adjustment-motor driver 73 stops the wiping-roller nip-pressure adjustment motor 50.

On the other hand, if the new-wiping-roller nip-pressure position in the low-speed state is not greater than the count value of the wiping-roller current-position detection counter in Step S22, a reverse-rotation command is outputted to the wiping-roller-nip-pressure-adjustment-motor driver 73 in Step S28. Based on the reverse-rotation command, the nip-pressure-adjustment-motor driver 73 rotates the wiping-roller nip-pressure adjustment motor 50 to move the position of the wiping roller 27 relative to the intaglio cylinder 23 in a direction away from it, i.e. in such a direction as to reduce the nip-pressure position.

Then in Step S29, the new-wiping-roller nip-pressure position in the low-speed state in the low-speed-state new-wiping-roller nip-pressure-position storage memory M110 is read out.

Then in Step S30, the count value of the wiping-roller current-position detection counter 74 is read out and stored in the wiping-roller-current-position-detection-counter count-value storage memory M105.

Then in Step S31, it is determined whether or not the new-wiping-roller nip-pressure position in the low-speed state is equal to the count value of the wiping-roller current-position detection counter. If not, the operation returns to Step S29, but if so, a stop command is outputted to the wiping-roller-nip-pressure-adjustment-motor driver 73 in Step S32, and the operation proceeds to Step S33.

Then in Step S33, a sheet feed command is outputted to the sheet feed apparatus 10. Based on the sheet feed command, the sheet feed apparatus 10 feeds paper sheets W to the printing apparatus 20.

Then in Step S34, an impression-throw-on command is outputted to the cylinder throw-on-off device 85. Based on the impression-throw-on command, the cylinder throw-on-off device 85 engages the intaglio cylinder 23 with the impression cylinder 21.

Then in Step S35, it is determined whether or not the up button 64 is on. If not, the operation proceeds to Step S37, but if so, a forward-rotation command is outputted to the wiping-roller-nip-pressure-adjustment-motor driver 73 in Step S36. The operator operates the up button 64 when determining that the nip pressure between the intaglio cylinder and the wiping roller should be increased, by checking printing products printed in test printing in a printing preparation phase.

Then in Step S37, it is determined whether or not the up button 64 is off. If not, the operation proceeds to Step S39, but if so, a stop command is outputted to the wiping-roller-nip-pressure-adjustment-motor driver 73 in Step S38.

Then in Step S39, it is determined whether or not the down button 65 is on. If not, the operation proceeds to Step S41, but if so, a reverse-rotation command is outputted to the wiping-roller-nip-pressure-adjustment-motor driver 73 in Step S40. The operator operates the down button 65 when determining that the nip pressure between the intaglio cylinder and the wiping roller should be reduced, by checking printing products printed in the test printing in the printing preparation phase.

Then in Step S41, it is determined whether or not the down button 65 is off. If not, the operation proceeds to Step S43, but if so, a stop command is outputted to the wiping-roller-nip-pressure-adjustment-motor driver 73 in Step S42.

Then in Step S43, it is determined whether or not the final-printing start switch 62 is on. If not, the operation returns to Step S35, but if so, the count value of the wiping-roller current-position detection counter 74 is read out and the low-speed-state new-wiping-roller nip-pressure-position storage memory M110 is overwritten with the count value in Step S44.

The count value with which the memory M110 is overwritten as described above is the position of the wiping roller 27 relative to the intaglio cylinder 23 (nip-pressure position) detected by the current-position detection counter 74 in the low-speed state before the wiping roller 27 is worn. Thus, after replacement of the wiping roller 27 with another new roll, the nip-pressure position of the wiping roller 27 in the low-speed state can be quickly adjusted based on the count value with which the memory M110 has been overwritten.

Then in Step S45, a printing rotation speed (high rotation speed) in the printing-rotation-speed (high-rotation-speed) storage memory M106 is read out. In Step S46, the printing rotation speed (high rotation speed) is outputted to the printing-press-drive-motor driver 70 via the D-A converter 69. The drive-motor driver 70 controls the printing-press drive motor 71 at the printing rotation speed (high rotation speed).

Then in Step S47, an enable signal and a reset signal are outputted to the internal-clock counter 76. Then in Step S48, the output of the reset signal to the internal-clock counter 76 is stopped. The internal-clock counter 76 starts counting time when the output of the reset signal is stopped.

Then, a waiting time in the waiting-time storage memory M107 is read out in Step S49, and the count value of the internal-clock counter 76 is read out and stored in the internal-clock-counter count-value storage memory M108 in Step S50.

Then in Step S51, it is determined whether or not the count value of the internal-clock counter 76 is equal to the waiting time. If not, the operation returns to Step S49, but if so, the new-wiping-roller nip-pressure position in the high-speed state in the high-speed-state new-wiping-roller nip-pressure-position storage memory M112 is read out in Step S52.

Then in Step S53, the count value of the wiping-roller current-position detection counter 74 is read out and stored in the wiping-roller-current-position-detection-counter count-value storage memory M105.

Then in Step S54, it is determined whether or not the new-wiping-roller nip-pressure position in the high-speed state is equal to the count value of the wiping-roller current-position detection counter. If so, the operation proceeds to Step S66, but if not, it is determined in Step S55 whether or not the new-wiping-roller nip-pressure position in the high-speed state is greater than the count value of the wiping-roller current-position detection counter.

Then, if so in Step S55, a forward-rotation command is outputted to the wiping-roller-nip-pressure-adjustment-motor driver 73 in Step S56.

Then in Step S57, the new-wiping-roller nip-pressure position in the high-speed state in the high-speed-state new-wiping-roller nip-pressure-position storage memory M112 is read out.

Then in Step S58, the count value of the wiping-roller current-position detection counter 74 is read out and stored in the wiping-roller-current-position-detection-counter count-value storage memory M105.

Then in Step S59, it is determined whether or not the new-wiping-roller nip-pressure position in the high-speed state is equal to the count value of the wiping-roller current-position detection counter. If not, the operation returns to Step S57, but if so, a stop command is outputted to the wiping-roller-nip-pressure-adjustment-motor driver 73 in Step S60, and the operation proceeds to Step S66.

On the other hand, if the new-wiping-roller nip-pressure position in the high-speed state is not greater than the count value of the wiping-roller current-position detection counter in Step S55, a reverse-rotation command is outputted to the wiping-roller-nip-pressure-adjustment-motor driver 73 in Step S61.

Then in Step S62, the new-wiping-roller nip-pressure position in the high-speed state in the high-speed-state new-wiping-roller nip-pressure-position storage memory M112 is read out.

Then in Step S63, the count value of the wiping-roller current-position detection counter 74 is read out and stored in the wiping-roller-current-position-detection-counter count-value storage memory M105.

Then in Step S64, it is determined whether or not the new-wiping-roller nip-pressure position in the high-speed state is equal to the count value of the wiping-roller current-position detection counter. If not, the operation returns to Step S62, but if so, a stop command is outputted to the wiping-roller-nip-pressure-adjustment-motor driver 73 in Step S65, and the operation proceeds to Step S66.

Then in Step S66, it is determined whether or not the up button 64 is on. If not, the operation proceeds to Step S68, but if so, a forward-rotation command is outputted to the wiping-roller-nip-pressure-adjustment-motor driver 73 in Step S67. The operator operates the up button 64 when determining that the nip pressure between the intaglio cylinder and the wiping roller should be increased, by checking printing products printed in final printing.

Then in Step S68, it is determined whether or not the up button 64 is off. If not, the operation proceeds to Step S70, but if so, a stop command is outputted to the wiping-roller-nip-pressure-adjustment-motor driver 73 in Step S69.

Then in Step S70, it is determined whether or not the down button 65 is on. If not, the operation proceeds to Step S72, but if so, a reverse-rotation command is outputted to the wiping-roller-nip-pressure-adjustment-motor driver 73 in Step S71. The operator operates the down button 65 when determining that the nip pressure between the intaglio cylinder and the wiping roller should be reduced, by checking printing products printed in the final printing.

Then in Step S72, it is determined whether or not the down button 65 is off. If not, the operation proceeds to Step S74, but if so, a stop command is outputted to the wiping-roller-nip-pressure-adjustment-motor driver 73 in Step S73.

Then in Step S74, it is determined whether or not the printing end switch 63 is on. If not, the operation returns to Step S66, but if so, the count value of the wiping-roller current-position detection counter 74 is read out and the high-speed-state new-wiping-roller nip-pressure-position storage memory M112 is overwritten with the count value in Step S75.

The count value with which the memory M112 is overwritten as described above is the position of the wiping roller 27 relative to the intaglio cylinder 23 (nip-pressure position) detected by the current-position detection counter 74 in the high-speed state before the wiping roller 27 is worn. Thus, after replacement of the wiping roller 27 with another new roll, the nip-pressure position of the wiping roller 27 in the high-speed state can be quickly adjusted based on the count value with which the memory M112 has been overwritten.

Then in Step S76, the new-roller flag storage memory M113 is overwritten with 0.

Then in Step S77, a sheet-feed stop command is outputted to the sheet feed apparatus 10. Based on the sheet-feed stop command, the sheet feed apparatus 10 stops the feed of paper sheets W to the printing apparatus 20.

Then in Step S78, an impression-throw-off command is outputted to the cylinder throw-on-off device 85. Based on the impression-throw-off command, the cylinder throw-on-off device 85 disengages the intaglio cylinder 23 from the impression cylinder 21.

Then in Step S79, a command for throw-off from the chablon cylinders 25 is outputted to the inking-device throw-on-off device 81. Based on the throw-off command, the inking-device throw-on-off device 81 brings the inking devices 26 out of contact with the chablon cylinders 25, that is, throws the inking devices 26 off the chablon cylinders 25.

Then in Step S80, a command for throw-off from the collecting cylinder 24 is outputted to the chablon-cylinder throw-on-off device 82. Based on the throw-off command, the chablon-cylinder throw-on-off device 82 brings the chablon cylinders 25 out of contact with the collecting cylinder 24, that is, throws the chablon cylinders 25 off the collecting cylinder 24.

Then in Step S81, a command for throw-off from the intaglio cylinder 23 is outputted to the collecting-cylinder throw-on-off device 83. Based on the throw-off command, the collecting-cylinder throw-on-off device 83 brings the collecting cylinder 24 out of contact with the intaglio cylinder 23, that is, throws the collecting cylinder 24 off the intaglio cylinder 23.

Then in Step S82, a command for throw-off from the intaglio cylinder 23 is outputted to the wiping-roller throw-on-off device 84. Based on the throw-off command, the wiping-roller throw-on-off hydraulic cylinder 43, which is the wiping-roller throw-on-off device 84, is actuated to contract and bring the wiping roller 27 out of contact with the intaglio cylinder 23, that is, throw the wiping roller 27 off the intaglio cylinder 23.

Then in Step S83, a stop command is outputted to the printing-press-drive-motor driver 70, and the operation returns to Step S5.

On the other hand, if the new-roller flag is not equal to 1 in Step S12, the low rotation speed in the low-rotation-speed storage memory M104 is read out in Step P4, and the low rotation speed is outputted to the printing-press-drive-motor driver 70 via the D-A converter 69 in Step P5. The drive-motor driver 70 controls the printing-press drive motor 71 at the low rotation speed.

Then in Step P6, a command for throw-on to the intaglio cylinder 23 is outputted to the collecting-cylinder throw-on-off device 83. Based on the throw-on command, the collecting-cylinder throw-on-off device 83 brings the collecting cylinder 24 into contact with the intaglio cylinder 23, that is, throws the collecting cylinder 24 onto the intaglio cylinder 23.

Then in Step P7, a command for throw-on to the collecting cylinder 24 is outputted to the chablon-cylinder throw-on-off device 82. Based on the throw-on command, the chablon-cylinder throw-on-off device 82 brings the chablon cylinders 25 into contact with the collecting cylinder 24, that is, throws the chablon cylinders 25 onto the collecting cylinder 24.

Then in Step P8, a command for throw-on to the chablon cylinders 25 is outputted to the inking-device throw-on-off device 81. Based on the throw-on command, the inking-device throw-on-off device 81 brings the inking devices 26 into contact with the chablon cylinders 25, that is, throws the inking devices 26 onto the chablon cylinders 25.

Then in Step P9, a command for throw-on to the intaglio cylinder 23 is outputted to the wiping-roller throw-on-off device 84. Based on the throw-on command, the wiping-roller throw-on-off hydraulic cylinder 43, which is the wiping-roller throw-on-off device 84, is actuated to extend and bring the wiping roller 27 into contact with the intaglio cylinder 23, that is, throw the wiping roller 27 onto the intaglio cylinder 23.

Then in Step P10, the wiping-roller nip-pressure position in the low-speed state in the low-speed-state wiping-roller nip-pressure-position storage memory M101 is read out.

Then in Step P11, the count value of the wiping-roller current-position detection counter 74 is read out and stored in the wiping-roller-current-position-detection-counter count-value storage memory M105.

Then in Step P12, it is determined whether or not the wiping-roller nip-pressure position in the low-speed state is equal to the count value of the wiping-roller current-position detection counter. If so, the operation proceeds to Step P24 and, if not, it is determined in Step P13 whether or not the wiping-roller nip-pressure position in the low-speed state is greater than the count value of the wiping-roller current-position detection counter.

Then, if so in Step P13, a forward-rotation command is outputted to the wiping-roller-nip-pressure-adjustment-motor driver 73 in Step P14. Based on the forward-rotation command, the nip-pressure adjustment-motor driver 73 rotates the wiping-roller nip-pressure adjustment motor 50 to move the position of the wiping roller 27 relative to the intaglio cylinder 23 in the direction toward it, i.e. in such a direction as to increase the nip-pressure position.

Then in Step P15, the wiping-roller nip-pressure position in the low-speed state in the low-speed-state wiping-roller nip-pressure-position storage memory M101 is read out.

Then in Step P16, the count value of the wiping-roller current-position detection counter 74 is read out and stored in the wiping-roller-current-position-detection-counter count-value storage memory M105.

Then in Step P17, it is determined whether or not the wiping-roller nip-pressure position in the low-speed state is equal to the count value of the wiping-roller current-position detection counter. If not, the operation returns to Step P15, but if so, a stop command is outputted to the wiping-roller-nip-pressure-adjustment-motor driver 73 in Step P18, and the operation proceeds to Step P24. Based on the stop command, the nip-pressure-adjustment-motor driver 73 stops the wiping-roller nip-pressure adjustment motor 50.

On the other hand, if the wiping-roller nip-pressure position in the low-speed state is not greater than the count value of the wiping-roller current-position detection counter in Step P13, a reverse-rotation command is outputted to the wiping-roller-nip-pressure-adjustment-motor driver 73 in Step P19. Based on the reverse-rotation command, the nip-pressure-adjustment-motor driver 73 rotates the wiping-roller nip-pressure adjustment motor 50 to move the position of the wiping roller 27 relative to the intaglio cylinder 23 in the direction away from it, i.e. in such a direction as to reduce the nip-pressure position.

Then in Step P20, the wiping-roller nip-pressure position in the low-speed state in the low-speed-state wiping-roller nip-pressure-position storage memory M101 is read out.

Then in Step P21, the count value of the wiping-roller current-position detection counter 74 is read out and stored in the wiping-roller-current-position-detection-counter count-value storage memory M105.

Then in Step P22, it is determined whether or not the wiping-roller nip-pressure position in the low-speed state is equal to the count value of the wiping-roller current-position detection counter. If not, the operation returns to Step P20, but if so, a stop command is outputted to the wiping-roller-nip-pressure-adjustment-motor driver 73 in Step P23, and the operation proceeds to Step P24.

Then in Step P24, a sheet feed command is outputted to the sheet feed apparatus 10. Based on the sheet feed command, the sheet feed apparatus 10 feeds paper sheets W to the printing apparatus 20.

Then in Step P25, an impression-throw-on command is outputted to the cylinder throw-on-off device 85. Based on the impression-throw-on command, the cylinder throw-on-off device 85 engages the intaglio cylinder 23 with the impression cylinder 21.

Then in Step P26, it is determined whether or not the up button 64 is on. If not, the operation proceeds to Step P28, but if so, a forward-rotation command is outputted to the wiping-roller-nip-pressure-adjustment-motor driver 73 in Step P27. The operator operates the up button 64 when determining that the nip pressure between the intaglio cylinder and the wiping roller should be increased, by checking printing products printed in test printing in a printing preparation phase.

Then in Step P28, it is determined whether or not the up button 64 is off. If not, the operation proceeds to Step P30, but if so, a stop command is outputted to the wiping-roller-nip-pressure-adjustment-motor driver 73 in Step P29.

Then in Step P30, it is determined whether or not the down button 65 is on. If not, the operation proceeds to Step P32, but if so, a reverse-rotation command is outputted to the wiping-roller-nip-pressure-adjustment-motor driver 73 in Step P31. The operator operates the down button 65 when determining that the nip pressure between the intaglio cylinder and the wiping roller should be reduced, by checking printing products printed in the test printing in the printing preparation phase.

Then in Step P32, it is determined whether or not the down button 65 is off. If not, the operation proceeds to Step P34, but if so, a stop command is outputted to the wiping-roller-nip-pressure-adjustment-motor driver 73 in Step P33.

Then in Step P34, it is determined whether or not the final-printing start switch 62 is on. If not, the operation returns to Step P26, but if so, the count value of the wiping-roller current-position detection counter 74 is read-out and the low-speed-state wiping-roller nip-pressure-position storage memory M101 is overwritten with the count value in Step P35.

Then in Step P36, the printing rotation speed (high rotation speed) in the printing-rotation-speed (high-rotation-speed) storage memory M106 is read out. In Step P37, the printing rotation speed (high rotation speed) is outputted to the printing-press-drive-motor driver 70 via the D-A converter 69. The drive-motor driver 70 controls the printing-press drive motor 71 at the printing rotation speed (high rotation speed).

Then in Step P38, an enable signal and a reset signal are outputted to the internal-clock counter 76. Then in Step P39, the output of the reset signal to the internal-clock counter 76 is stopped. The internal-clock counter 76 starts counting time when the output of the reset signal is stopped.

Then, the waiting time in the waiting-time storage memory M107 is read out in Step P40, and the count value of the internal-clock counter 76 is read out and stored in the internal-clock-counter count-value storage memory M108 in Step P41.

Then in Step P42, it is determined whether or not the count value of the internal-clock counter 76 is equal to the waiting time. If not, the operation returns to Step P40, but if so, the wiping-roller nip-pressure position in the high-speed state in the high-speed-state wiping-roller nip-pressure-position storage memory M103 is read out in Step P43.

Then in Step P44, the count value of the wiping-roller current-position detection counter 74 is read out and stored in the wiping-roller-current-position-detection-counter count-value storage memory M105.

Then in Step P45, it is determined whether or not the wiping-roller nip-pressure position in the high-speed state is equal to the count value of the wiping-roller current-position detection counter. If so, the operation proceeds to Step P57, but if not, it is determined in Step P46 whether or not the wiping-roller nip-pressure position in the high-speed state is greater than the count value of the wiping-roller current-position detection counter.

Then, if so in Step P46, a forward-rotation command is outputted to the wiping-roller-nip-pressure-adjustment-motor driver 73 in Step P47.

Then in Step P48, the wiping-roller nip-pressure position in the high-speed state in the high-speed-state wiping-roller nip-pressure-position storage memory M103 is read out.

Then in Step P49, the count value of the wiping-roller current-position detection counter 74 is read out and stored in the wiping-roller-current-position-detection-counter count-value storage memory M105.

Then in Step P50, it is determined whether or not the wiping-roller nip-pressure position in the high-speed state is equal to the count value of the wiping-roller current-position detection counter. If not, the operation returns to Step P48, but if so, a stop command is outputted to the wiping-roller-nip-pressure-adjustment-motor driver 73 in Step P51, and the operation proceeds to Step P57.

On the other hand, if the wiping-roller nip-pressure position in the high-speed state is not greater than the count value of the wiping-roller current-position detection counter in Step P46, a reverse-rotation command is outputted to the wiping-roller-nip-pressure-adjustment-motor driver 73 in Step P52.

Then in Step P53, the wiping-roller nip-pressure position in the high-speed state in the high-speed-state wiping-roller nip-pressure-position storage memory M103 is read out.

Then in Step P54, the count value of the wiping-roller current-position detection counter 74 is read out and stored in the wiping-roller-current-position-detection-counter count-value storage memory M105.

Then in Step P55, it is determined whether or not the wiping-roller nip-pressure position in the high-speed state is equal to the count value of the wiping-roller current-position detection counter. If not, the operation returns to Step P53, but if so, a stop command is outputted to the wiping-roller-nip-pressure-adjustment-motor driver 73 in Step P56, and the operation proceeds to Step P57.

Then in Step P57, it is determined whether or not the up button 64 is on. If not, the operation proceeds to Step P59, but if so, a forward-rotation command is outputted to the wiping-roller-nip-pressure-adjustment-motor driver 73 in Step P58. The operator operates the up button 64 when determining that the nip pressure between the intaglio cylinder and the wiping roller should be increased, by checking printing products printed in final printing.

Then in Step P59, it is determined whether or not the up button 64 is off. If not, the operation proceeds to Step P61, but if so, a stop command is outputted to the wiping-roller-nip-pressure-adjustment-motor driver 73 in Step P60.

Then in Step P61, it is determined whether or not the down button 65 is on. If not, the operation proceeds to Step P63, but if so, a reverse-rotation command is outputted to the wiping-roller-nip-pressure-adjustment-motor driver 73 in Step P62. The operator operates the down button 65 when determining that the nip pressure between the intaglio cylinder and the wiping roller should be reduced, by checking printing products printed in the final printing.

Then in Step P63, it is determined whether or not the down button 65 is off. If not, the operation proceeds to Step P65, but if so, a stop command is outputted to the wiping-roller-nip-pressure-adjustment-motor driver 73 in Step P64.

Then in Step P65, it is determined whether or not the printing end switch 63 is on. If not, the operation returns to Step P57, but if so, the count value of the wiping-roller current-position detection counter 74 is read out and the high-speed-state wiping-roller nip-pressure-position storage memory M103 is overwritten with the count value in Step P66.

Then in Step P67, a sheet-feed stop command is outputted to the sheet feed apparatus 10. Based on the sheet-feed stop command, the sheet feed apparatus 10 stops the feed of paper sheets W to the printing apparatus 20.

Then in Step P68, an impression-throw-off command is outputted to the cylinder throw-on-off device 85. Based on the impression-throw-off command, the cylinder throw-on-off device 85 disengages the intaglio cylinder 23 from the impression cylinder 21.

Then in Step P69, a command for throw-off from the chablon cylinders 25 is outputted to the inking-device throw-on-off device 81. Based on the throw-off command, the inking-device throw-on-off device 81 brings the inking devices 26 out of contact with the chablon cylinders 25, that is, throws the inking devices 26 off the chablon cylinders 25.

Then in Step P70, a command for throw-off from the collecting cylinder 24 is outputted to the chablon-cylinder throw-on-off device 82. Based on the throw-off command, the chablon-cylinder throw-on-off device 82 brings the chablon cylinders 25 out of contact with the collecting cylinder 24, that is, throws the chablon cylinders 25 off the collecting cylinder 24.

Then in Step P71, a command for throw-off from the intaglio cylinder 23 is outputted to the collecting-cylinder throw-on-off device 83. Based on the throw-off command, the collecting-cylinder throw-on-off device 83 brings the collecting cylinder 24 out of contact with the intaglio cylinder 23, that is, throws the collecting cylinder 24 off the intaglio cylinder 23.

Then in Step P72, a command for throw-off from the intaglio cylinder 23 is outputted to the wiping-roller throw-on-off device 84. Based on the throw-off command, the wiping-roller throw-on-off hydraulic cylinder 43, which is the wiping-roller throw-on-off device 84, is actuated to contract and bring the wiping roller 27 out of contact with the intaglio cylinder 23, that is, throw the wiping roller 27 off the intaglio cylinder 23.

Then in Step P73, a stop command is outputted to the printing-press-drive-motor driver 70, and the operation returns to Step S5.

The timing chart of the nip-pressure position and the printing speed illustrated in FIG. 4 will be described. FIG. 4 illustrates the nip-pressure position (broken line) and the printing speed (solid line) over a period of time involving transition from a last print job to the next print job. As illustrated in FIG. 4, each print job includes a printing preparation phase, in which test printing is performed at a low speed, and a final printing phase, in which final printing is performed thereafter with the speed raised to a printing speed.

As illustrated in FIG. 4, in the final printing phase for the last print job, the speed remains at the printing speed from a time 0 to a time t1, drops with time from the time t1, at which the printing end switch 63 is turned on, and reaches 0 at a time t3.

In the final printing phase, the printing speed is high, so that the wiping roller 27 is in a thermally expanded state due to the heat generated by the rotation of the printing apparatus 20. Thus, the wiping-roller nip-pressure position in the high-speed state stored as an initial value in the high-speed-state wiping-roller nip-pressure-position initial-value storage memory M102 is set as such a position that the wiping roller 27 is positioned relatively far from the intaglio cylinder 23, that is, the nip-pressure position is set as a low position (the time 0 to the time t1), as illustrated in FIG. 4.

Here, the time t1 is when the printing end switch 63 is turned on in Step P65, and the nip-pressure position has therefore already been adjusted by the operator's operation on the up button 64 and the down button 65 in the preceding Steps P57 to P64. Hence, the count value with which the high-speed-state wiping-roller nip-pressure-position storage memory M103 is overwritten in Step P66 after the time t1 is the nip-pressure position in the high-speed state after the adjustment by the operation on the up button 64 and the down button 65.

The count value with which the high-speed-state wiping-roller nip-pressure-position storage memory M103 is overwritten as described above will be used in the final printing phase for the next print job.

Meanwhile, before the time 0 in the last print job is its printing preparation phase, in which test printing is performed at the low speed, though it is omitted in FIG. 4.

Between the time t3 and a time t4 after the end of the last print job, the speed is 0, so that the printing apparatus 20 dissipates heat and the amount of thermal expansion of the wiping roller 27 decreases accordingly. The dimension of the wiping roller 27 therefore becomes close to the original dimension.

In the next print job, the speed rises to the low speed for the printing preparation phase from the time t4 to a time t5, remains at the low speed for the printing preparation phase from the time t5 to a time t6, rises to the printing speed for the final printing phase from the time t6 to a time t7, and remains at the printing speed for the final printing phase at and after the time t7.

The time t4 is when the printing preparation switch 61 is turned on in Step P3 and the printing preparation phase thus starts. Here, until the speed reaches the printing speed for the final printing phase, the rotation of the printing apparatus 20 does not generate much heat and therefore the wiping roller 27 is in a hardly thermally expanded state.

For this reason, the wiping-roller nip-pressure position in the low-speed state stored as an initial value in the low-speed-state wiping-roller nip-pressure-position initial-value storage memory M100 is set as such a position that the wiping roller 27 is positioned relatively close to the intaglio cylinder 23, that is, the nip-pressure position is set as a high position (the time t5 to a time t8), as illustrated in FIG. 4. Then, the wiping roller 27 is automatically moved to the stored nip-pressure position in the low-speed state in Steps P14 to P23.

Further, the time t6 is when the final-printing start switch 62 is turned on in Step P34, and the nip-pressure position in the low-speed state has therefore already been adjusted by the operator's operation on the up button 64 and the down button 65 in the preceding Steps P24 to P33. Hence, the count value with which the low-speed-state wiping-roller nip-pressure-position storage memory M101 is overwritten in Step P35 after the time t6 is the nip-pressure position in the low-speed state after the adjustment by the operation on the up button 64 and the down button 65.

The count value with which the low-speed-state wiping-roller nip-pressure-position storage memory M101 is overwritten as described above will be used in the printing preparation phase for the next print job.

Meanwhile, although the speed reaches the printing speed for the final printing phase at the time t7, there is a certain time lag before the wiping roller 27 reaches the thermally expanded state with the heat generated by the rotation of the printing apparatus 20. That is, the wiping roller 27 does not reach the thermally expanded state with the heat generated by the rotation of the printing apparatus 20 until a certain period of time elapses since the time t7, at which the speed reaches the high printing speed.

The waiting time is set in Step P40 for this reason. Specifically, when the final-printing start switch 62 is turned on in Step P34, the nip-pressure position of the wiping roller relative to the intaglio cylinder 23 is not adjusted immediately. Instead, the waiting time in waiting-time storage memory M107 is read out in Step P40 and, after the elapse of the waiting time, the nip-pressure position of the wiping roller 27 relative to the intaglio cylinder 23 is adjusted based on the count value with which the high-speed-state wiping-roller nip-pressure-position storage memory M103 has been overwritten, as illustrated in Steps P47 to P56.

Thus, in the next print job, at and after a time t9 at which the certain period of time elapses since the time t7, at which the speed reaches the high printing speed, the nip-pressure position of the wiping roller 27, which has reached the thermally expanded state, relative to the intaglio cylinder 23 is adjusted as appropriate.

Like the above description, in the present invention, in a case where the wiping roller 27 is replaced with a new roller, the positions of the wiping roller 27 in an unworn state are stored in Steps S44, S75; and the wiping roller 27 is automatically moved to the stored positions of the wiping roller 27 in the unworn state in Steps S23 to S32 and Steps S56 to S65 in a case where the wiping roller 27 is replaced with another new roller. In this way, the above-mentioned second problem is solved, which causes a heavy burden on the operator, produces a large amount of defective printing products, and wastes printing materials.

In the present invention, at the start of printing following replacement of the wiping roller 27 with a new roller, the position of the wiping roller 27 in the low-speed state manually adjusted by the operator in Steps P26 to P33 is stored in Step P44, and the position of the wiping roller 27 in the printing-speed (high-speed) state manually adjusted by the operator in Steps P66 to P73 is automatically stored in Step P75 at the end of the printing; in printing following replacement of the wiping roller 27 with another new roller, the wiping roller 27 is automatically moved to the stored position of the wiping roller 27 in the low-speed state in Steps P23 to P32 before the start of the printing, and the wiping roller 27 is automatically moved to the stored position of the wiping roller 27 in the high-speed state in Steps P56 to P65 upon elapse of the waiting time from the start of the printing to the start of the thermal expansion. In this way, the above-mentioned first and second problems are solved, which cause a heavy burden on the operator, produce a large amount of defective printing products, and waste printing materials.

Moreover, the position of the wiping roller 27 in the low-speed state is automatically stored in Step P44 when the rotation speed of the printing press reaches the high speed at the start of the printing, and the position of the wiping roller 27 in the high-speed state is automatically stored in Step P75 when the printing press stops printing at the end of the printing. In this way, the operator no longer needs to manually control the position storing timing at each single occasion.

INDUSTRIAL APPLICABILITY

The present invention is widely industrially applicable as a method of and a device for adjusting the contact pressure of a wiping roller of an intaglio printing press.

EXPLANATION OF THE REFERENCE NUMERALS

10 SHEET FEED APPARATUS
20 PRINTING APPARATUS
23 INTAGLIO CYLINDER
27 WIPING ROLLER
30 DELIVERY APPARATUS
50 WIPING-ROLLER NIP-PRESSURE ADJUSTMENT MOTOR
60 NIP-PRESSURE ADJUSTMENT DEVICE
61 PRINTING PREPARATION SWITCH
62 FINAL-PRINTING START SWITCH
63 PRINTING END SWITCH
64 UP BUTTON
65 DOWN BUTTON
66 INPUT DEVICE
67 DISPLAY
68 OUTPUT DEVICE (FD DRIVE, PRINTER, ETC.)
70 PRINTING-PRESS-DRIVE-MOTOR DRIVER
71 PRINTING-PRESS DRIVE MOTOR
72 PRINTING-PRESS-DRIVE-MOTOR ROTARY ENCODER
73 WIPING-ROLLER-NIP-PRESSURE-ADJUSTMENT-MOTOR DRIVER
74 WIPING-ROLLER CURRENT-POSITION DETECTION COUNTER
75 WIPING-ROLLER-NIP-PRESSURE-ADJUSTMENT-MOTOR ROTARY ENCODER
76 INTERNAL-CLOCK COUNTER
77 NEW-ROLLER SWITCH
81 INKING-DEVICE THROW-ON-OFF DEVICE
82 CHABLON-CYLINDER THROW-ON-OFF DEVICE
83 COLLECTING-CYLINDER THROW-ON-OFF DEVICE
84 WIPING-ROLLER THROW-ON-OFF DEVICE
85 CYLINDER THROW-ON-OFF DEVICE
100 CPU
101 ROM
102 RAM
103 TO 112 INPUT-OUTPUT DEVICE (I/O)
M100 LOW-SPEED-STATE WIPING-ROLLER NIP-PRESSURE-POSITION INITIAL-VALUE STORAGE MEMORY
M101 LOW-SPEED-STATE WIPING-ROLLER NIP-PRESSURE-POSITION STORAGE MEMORY (FIRST MEMORY)
M102 HIGH-SPEED-STATE WIPING-ROLLER NIP-PRESSURE-POSITION INITIAL-VALUE STORAGE MEMORY
M103 HIGH-SPEED-STATE WIPING-ROLLER NIP-PRESSURE-POSITION STORAGE MEMORY (SECOND MEMORY)
M104 LOW-ROTATION-SPEED STORAGE MEMORY
M105 WIPING-ROLLER-CURRENT-POSITION-DETECTION-COUNTER COUNT-VALUE STORAGE MEMORY
M106 PRINTING-ROTATION-SPEED (HIGH-ROTATION-SPEED) STORAGE MEMORY
M107 WAITING-TIME STORAGE MEMORY
M108 INTERNAL-CLOCK-COUNTER COUNT-VALUE STORAGE MEMORY
M109 LOW-SPEED-STATE NEW-WIPING-ROLLER NIP-PRESSURE-POSITION INITIAL-VALUE STORAGE MEMORY
M110 LOW-SPEED-STATE NEW-WIPING-ROLLER NIP-PRESSURE-POSITION STORAGE MEMORY (THIRD MEMORY)
M111 HIGH-SPEED-STATE NEW-WIPING-ROLLER NIP-PRESSURE-POSITION INITIAL-VALUE STORAGE MEMORY
M112 HIGH-SPEED-STATE NEW-WIPING-ROLLER NIP-PRESSURE-POSITION STORAGE MEMORY (FOURTH MEMORY)
M113 NEW-ROLLER FLAG STORAGE MEMORY

The invention claimed is:

1. A method of adjusting a contact pressure of a wiping roller of an intaglio printing press including
- an intaglio cylinder,
- the wiping roller configured to wipe excess ink off the intaglio cylinder,
- a contact-pressure adjustment mechanism configured to adjust the contact pressure of the wiping roller on the intaglio cylinder, and
- a contact-pressure adjustment motor configured to move the wiping roller by driving the contact-pressure adjustment mechanism, and
- a controller configured to control operation of the printing press,
- characterized in that the method comprises:
- storing an adjusted position of the wiping roller in a low-speed state at a time at or before a start of final printing;
- storing an adjusted position of the wiping roller in a printing-speed state at a time at or after an end of the final printing; and
- controlling the contact-pressure adjustment motor in a next printing operation in such a way as to
  - move the wiping roller at a time at or before a start of final printing to the position stored at the time at or before the start of the final printing in the last printing operation, and
  - move the wiping roller at a time at or after the start of the final printing to the position stored at the time at or after the end of the final printing in the last printing operation.

2. The method of adjusting a contact pressure of a wiping roller of an intaglio printing press according to claim 1, characterized in that
- the time at or before the start of the final printing in the last printing operation includes when a rotation speed of the printing press reaches a high speed,
- the time at or after the end of the final printing in the last printing operation includes when the printing press stops printing,
- the time at or before the start of the final printing in the next printing operation includes when the wiping roller is thrown onto the intaglio cylinder, and
- the time at or after the start of the final printing in the next printing operation includes when the rotation speed of the printing press reaches the high speed.

3. The method of adjusting a contact pressure of a wiping roller of an intaglio printing press according to claim 2, characterized in that the time at or after the start of the final printing in the next printing operation includes when a predetermined period of time elapses since the rotation speed of the printing press reaches the high speed.

4. The method of adjusting a contact pressure of a wiping roller of an intaglio printing press according to claim 1, characterized in that the method further comprises:

storing an adjusted position of the wiping roller in the low-speed state at a time at or before a start of final printing following replacement of the wiping roller with a new roller;

storing an adjusted position of the wiping roller in the printing-speed state at a time at or after an end of the final printing following the replacement of the wiping roller with the new roller; and controlling the contact-pressure adjustment motor after replacement of the wiping roller with another new roller in such a way as to move the wiping roller at a time at or before a start of final printing to the position stored at the time at or before the start of the final printing following the replacement of the wiping roller with the new roller, and move the wiping roller at a time at or after the start of the final printing to the position stored at the time at or after the end of the final printing following the replacement of the wiping roller with the new roller.

5. The method of adjusting a contact pressure of a wiping roller of an intaglio printing press according to claim 4, characterized in that the time at or before the start of the final printing following the replacement of the wiping roller with the new roller includes when a rotation speed of the printing press reaches a high speed, the time at or after the end of the final printing following the replacement of the wiping roller with the new roller includes when the printing press stops printing, the time at or before the start of the final printing following the replacement of the wiping roller with the another new roller includes when the wiping roller is thrown onto the intaglio cylinder, and the time at or after the start of the final printing following the replacement of the wiping roller with the another new roller includes when the rotation speed of the printing press reaches the high speed.

6. The method of adjusting a contact pressure of a wiping roller of an intaglio printing press according to claim 5, characterized in that the time at or after the start of the final printing following the replacement of the wiping roller with the another new roller includes when a predetermined period of time elapses since the rotation speed of the printing press reaches the high speed.

7. The method of adjusting a contact pressure of a wiping roller of an intaglio printing press according to claim 1, characterized in that the method comprises:

storing a position of the wiping roller after replacement of the wiping roller with a new roller, instead of storing the adjusted positions of the wiping roller in the low-speed state and the printing-speed state; and moving the wiping roller to the position stored after the replacement of the wiping roller with the new roller, after replacement of the wiping roller with another new roller, instead of moving the wiping roller in the next printing operation to the position stored at the time at or before the start of the final printing in the last printing operation and to the position stored at the time at or after the end of the final printing in the last printing operation.

8. A device for adjusting a contact pressure of a wiping roller of an intaglio printing press including an intaglio cylinder, the wiping roller configured to wipe excess ink off the intaglio cylinder, a contact-pressure adjustment mechanism configured to adjust the contact pressure of the wiping roller on the intaglio cylinder, and a contact-pressure adjustment motor configured to move the wiping roller by driving the contact-pressure adjustment mechanism, and a controller configured to control operation of the printing press, characterized in that the device is configured to:

store an adjusted position of the wiping roller in a low-speed state into a first memory at a time at or before a start of final printing;

store an adjusted position of the wiping roller in a printing-speed state into a second memory at a time at or after an end of the final printing; and control the contact-pressure adjustment motor in a next printing operation in such a way as to move the wiping roller at a time at or before a start of final printing to the position stored into the first memory at the time at or before the start of the final printing in the last printing operation, and move the wiping roller at a time at or after the start of the final printing to the position stored into the second memory at the time at or after the end of the final printing in the last printing operation.

9. The device for adjusting a contact pressure of a wiping roller of an intaglio printing press according to claim 8, characterized in that the time at or before the start of the final printing in the last printing operation includes when a rotation speed of the printing press reaches a high speed, the time at or after the end of the final printing in the last printing operation includes when the printing press stops printing, the time at or before the start of the final printing in the next printing operation includes when the wiping roller is thrown onto the intaglio cylinder, and the time at or after the start of the final printing in the next printing operation includes when the rotation speed of the printing press reaches the high speed.

10. The device for adjusting a contact pressure of a wiping roller of an intaglio printing press according to claim 9, characterized in that the time at or after the start of the final printing in the next printing operation includes when a predetermined period of time elapses since the rotation speed of the printing press reaches the high speed.

11. The device for adjusting a contact pressure of a wiping roller of an intaglio printing press according to claim 8, characterized in that the device is further configured to:

store an adjusted position of the wiping roller in the low-speed state into a third memory at a time at or before a start of final printing following replacement of the wiping roller with a new roller;

store an adjusted position of the wiping roller in the printing-speed state into a fourth memory at a time at or after an end of the final printing following the replacement of the wiping roller with the new roller; and control the contact-pressure adjustment motor after replacement of the wiping roller with another new roller in such a way as to move the wiping roller at a time at or before a start of final printing to the position stored into the third memory at the time at or before the start of the final printing following the replacement of the wiping roller with the new roller, and move the wiping roller at a time at or after the start of the final printing to the position stored into the fourth memory at the time at or after the end of the final printing following the replacement of the wiping roller with the new roller.

12. The device for adjusting a contact pressure of a wiping roller of an intaglio printing press according to claim 11, characterized in that the time at or before the start of the final printing following the replacement of the wiping roller with the new roller includes when a rotation speed of the printing press reaches a high speed, the time at or after the end of the final printing following the replacement of the wiping roller with the new roller includes when the printing press stops printing, the time at or before the start of the final printing following the replacement of the wiping roller with the another new roller includes when the wiping roller is thrown onto the intaglio cylinder, and the time at or after the start of the final printing following the replacement of the wiping roller with the another new roller includes when the rotation speed of the printing press reaches the high speed.

13. The device for adjusting a contact pressure of a wiping roller of an intaglio printing press according to claim 12, characterized in that the time at or after the start of the final printing following the replacement of the wiping roller with the another new roller includes when a predetermined period of time elapses since the rotation speed of the printing press reaches the high speed.

14. The device for adjusting a contact pressure of a wiping roller of an intaglio printing press according to claim 8, characterized in that the device is configured to:

store a position of the wiping roller after replacement of the wiping roller with a new roller into a third memory or a fourth memory, instead of storing the adjusted positions of the wiping roller in the low-speed state and the printing-speed state into the first memory and the second memory; and move the wiping roller to the position stored into the third memory or the fourth memory after the replacement of the wiping roller with the new roller, after replacement of the wiping roller with another new roller, instead of moving the wiping roller in the next printing operation to the position stored into the first memory and the second memory at the time at or before the start of the final printing in the last printing operation and at the time at or after the end of the final printing in the last printing operation.

* * * * *